US010641566B2

(12) United States Patent
Cottrell et al.

(10) Patent No.: US 10,641,566 B2
(45) Date of Patent: May 5, 2020

(54) HANDGUN MAGAZINE LOADER HAVING CARTRIDGE DRIVER

(71) Applicant: Battenfeld Technologies, Inc., Columbia, MO (US)

(72) Inventors: Michael Cottrell, Ashland, MO (US); James Gianladis, Harrisburg, MO (US); Adam J. Birk, Hallsville, MO (US); Michael Poehlman, Columbia, MO (US); Tim Kinney, Warrenton, MO (US)

(73) Assignee: Battenfeld Technologies, Inc., Columbia, MO (US)

( * ) Notice: Subject to any disclaimer, the term of this patent is extended or adjusted under 35 U.S.C. 154(b) by 0 days.

(21) Appl. No.: 16/449,800

(22) Filed: Jun. 24, 2019

(65) Prior Publication Data

US 2020/0033087 A1 Jan. 30, 2020

Related U.S. Application Data

(62) Division of application No. 15/177,043, filed on Jun. 8, 2016, now Pat. No. 10,330,411.

(60) Provisional application No. 62/207,223, filed on Aug. 19, 2015.

(51) Int. Cl.
*F41A 9/83* (2006.01)

(52) U.S. Cl.
CPC ..... *F41A 9/83* (2013.01)

(58) Field of Classification Search
CPC ..... F41A 9/83; F41A 9/84; F41A 9/82
USPC ..... 42/87, 49.02
See application file for complete search history.

(56) References Cited

U.S. PATENT DOCUMENTS

| | | | |
|---|---|---|---|
| 452,447 | A | 5/1891 | Bruce |
| 1,011,541 | A | 12/1911 | West |
| 1,178,785 | A | 4/1916 | Debuchy |
| 1,295,038 | A | 2/1919 | Johnson |
| 1,295,039 | A | 2/1919 | Johnson |
| 1,355,684 | A | 10/1920 | Northover |
| 1,786,537 | A | 12/1930 | Holek |
| 1,840,477 | A | 1/1932 | Von Frommer |
| 2,014,177 | A | 9/1935 | Herlach et al. |
| 2,191,130 | A | 2/1940 | Ludwig |
| 2,345,593 | A | 4/1944 | Garand |
| 2,402,195 | A | 6/1946 | Woodberry |
| 2,403,012 | A | 7/1946 | McPheters |
| 2,462,836 | A | 3/1949 | Barker |
| 2,487,040 | A | 11/1949 | Bilobeau |

(Continued)

FOREIGN PATENT DOCUMENTS

| | | |
|---|---|---|
| CA | 2 416 448 | 1/2002 |
| EP | 0205661 A2 | 12/1986 |

(Continued)

OTHER PUBLICATIONS

Amazon.com: ProMag RD USGI Magazine Loader Black Polymer http://www.amazon.com/ProMag-Magazine-Loader-Black-Polymer/dp/B002IWRFLK, 2 pages, Jul. 15, 2014.

(Continued)

*Primary Examiner* — Jonathan C Weber
(74) *Attorney, Agent, or Firm* — Stinson LLP

(57) ABSTRACT

A loader for loading ammunition into a magazine for a handgun. The loader may be universal in that it is capable of loading various types of ammunition cartridges into various types of magazines. A cartridge driver of the loader drives the cartridges into the magazine.

25 Claims, 47 Drawing Sheets

(56) References Cited

U.S. PATENT DOCUMENTS

| | | | |
|---|---|---|---|
| 2,526,195 | A | 10/1950 | Brownsey |
| 2,542,842 | A | 2/1951 | Saunders |
| 2,783,570 | A | 3/1957 | Kunz |
| 2,887,811 | A | 5/1959 | Johnson |
| 2,894,350 | A | 7/1959 | Janson |
| 3,030,724 | A | 4/1962 | Curran |
| 3,099,958 | A | 8/1963 | Daubenspeck et al. |
| 3,292,293 | A | 12/1966 | Chiasera |
| 3,628,273 | A | 12/1971 | Lach |
| 4,034,644 | A | 7/1977 | Hupp et al. |
| 4,506,588 | A | 3/1985 | Kazanjy |
| 4,538,371 | A | 9/1985 | Howard |
| 4,570,371 | A | 2/1986 | Mears |
| 4,574,511 | A | 3/1986 | Csonger |
| 4,706,402 | A | 11/1987 | Csonger |
| 4,707,941 | A | 11/1987 | Eastman |
| 4,726,296 | A | 2/1988 | Leshner et al. |
| 4,739,572 | A | 4/1988 | Brandenburg |
| 4,879,829 | A | 11/1989 | Miller et al. |
| 4,939,862 | A | 7/1990 | Brandenberg |
| 4,949,495 | A | 8/1990 | Mari |
| 4,970,820 | A | 11/1990 | Miller et al. |
| 5,249,386 | A | 10/1993 | Switzer |
| 5,301,449 | A | 4/1994 | Jackson |
| 5,319,872 | A | 6/1994 | Bammate |
| 5,377,436 | A | 1/1995 | Switzer |
| 5,402,594 | A | 4/1995 | Switzer |
| 5,555,661 | A | 9/1996 | Yap |
| 5,563,365 | A | 10/1996 | Dineen et al. |
| 5,566,488 | A | 10/1996 | Yap |
| 5,669,171 | A | 9/1997 | Sally |
| 6,178,683 | B1 | 1/2001 | Williams |
| 6,668,479 | B1 | 12/2003 | Obong |
| 6,754,987 | B1 | 6/2004 | Cheng et al. |
| 6,810,616 | B2 | 11/2004 | Tal et al. |
| 6,817,134 | B2 | 11/2004 | Newman |
| 7,059,077 | B2 | 6/2006 | Tal et al. |
| 7,383,657 | B2 | 6/2008 | Pikielny |
| 7,503,138 | B2 | 3/2009 | Tal et al. |
| 7,637,048 | B2 | 12/2009 | Tal et al. |
| 7,805,874 | B2 | 10/2010 | Tal et al. |
| 7,866,080 | B2 | 1/2011 | Tucker |
| 8,356,441 | B2 | 1/2013 | Meinel |
| 8,453,366 | B2 | 6/2013 | Gray |
| 8,484,874 | B2 | 7/2013 | Kim |
| 8,650,792 | B1 | 2/2014 | Overmars |
| D715,888 | S | 10/2014 | Padgett |
| 8,915,007 | B1 | 12/2014 | Williams |
| 8,931,199 | B1 | 1/2015 | Cauley, Jr. et al. |
| 9,003,687 | B2 | 4/2015 | Cauley, Jr. et al. |
| 9,212,859 | B1 | 12/2015 | Tal et al. |
| 9,273,917 | B1 | 3/2016 | Buckner |
| D753,781 | S | 4/2016 | Cauley, Jr. et al. |
| D755,325 | S | 5/2016 | Cauley, Jr. et al. |
| 9,335,108 | B2 | 5/2016 | Cauley, Jr. et al. |
| 9,354,008 | B1 | 5/2016 | Cifers et al. |
| 9,404,697 | B2 | 8/2016 | Cobb |
| 9,574,836 | B1 | 2/2017 | Cauley, Jr. et al. |
| 9,612,070 | B2 | 4/2017 | Hatch |
| 9,719,741 | B1 | 8/2017 | Cifers et al. |
| 10,060,692 | B2 | 8/2018 | Couie |
| 2003/0046854 | A1 | 3/2003 | Urchek |
| 2004/0020096 | A1 | 2/2004 | Tal et al. |
| 2004/0159035 | A1 | 8/2004 | Newman |
| 2004/0159036 | A1 | 8/2004 | Newman |
| 2005/0081421 | A1 | 4/2005 | Guy et al. |
| 2007/0017140 | A1 | 1/2007 | Pikielny |
| 2007/0107291 | A1 | 5/2007 | Tal et al. |
| 2008/0184608 | A1 | 8/2008 | Tal et al. |
| 2009/0044440 | A1 | 9/2009 | Tal et al. |
| 2010/0175294 | A1 | 7/2010 | Meinel |
| 2012/0192477 | A1 | 8/2012 | Kim |
| 2012/0222343 | A1 | 9/2012 | Kim |
| 2013/0061505 | A1 | 3/2013 | Faifer |
| 2013/0067788 | A1 | 3/2013 | Gray |
| 2013/0074393 | A1 | 3/2013 | Curry |
| 2013/0192117 | A1 | 8/2013 | Meinel |
| 2013/0232843 | A1 | 9/2013 | Bajuelo |
| 2014/0033592 | A1 | 2/2014 | Fiorucci |
| 2014/0223792 | A1 | 8/2014 | Socivoi |
| 2014/0298704 | A1 | 10/2014 | Niccum |
| 2014/0317985 | A1 | 10/2014 | Cauley et al. |
| 2014/0373421 | A1 | 12/2014 | Hatch |
| 2014/0373744 | A1 | 12/2014 | Padgett et al. |
| 2015/0007480 | A1 | 1/2015 | Cauley et al. |
| 2015/0075053 | A1 | 3/2015 | Kim |
| 2015/0219415 | A1 | 8/2015 | Cauley et al. |
| 2015/0316341 | A1 | 11/2015 | Aguilar |

FOREIGN PATENT DOCUMENTS

| | | | |
|---|---|---|---|
| GB | 379179 | | 8/1932 |
| KR | 102011011338 | A | 10/2011 |
| WO | 1985003119 | | 7/1985 |
| WO | 88/01725 | | 3/1988 |
| WO | 89/04454 | | 5/1989 |
| WO | 2014152848 | A4 | 9/2014 |
| WO | 2015/162578 | A2 | 10/2015 |
| WO | 2015/171081 | A1 | 11/2015 |

OTHER PUBLICATIONS

McFadden Machine Company Incorporated Clip Loader the Ultimate Clip Loader, http://www.mcfaden.com/cliploader.html, 3 pages, Jul. 15, 2014.

McFadden Machine Company Incorporated Lightnin' Grip Loader, http://www.mcfaden.com/product-p/lightnin-grip.htm, Aug. 12, 2015, 3 pages.

McFadden Machine Company Incorporated Lightnin' Grip Loader Instructions, admitted prior art, 1 page.

Youtube 3pointi.com Box-to-Mag Loader, 3 screenshots of video, https://www.youtube.com/watch?v=2m1rYDpiQIw, 1 page, video uploaded Jun. 21 2011.

Three Point Innovation's Box-to-Mag AR-15 Speed Loader—The Firearm Blog http://www.thefirearmblog.com/blog/2011/06/30/three-point-innovations-box-to-mag-ar-15-speed-loader/, 2 pages, posted Jun. 30, 2011.

HANDGUN MAGAZINE LOADER HAVING CARTRIDGE DRIVER

CROSS-REFERENCE TO RELATED APPLICATION

This application is a divisional application which claims priority to U.S. patent application Ser. No. 15/177,043, filed Jun. 8, 2016, which claims priority to U.S. Patent Application No. 62/207,223, filed Aug. 19, 2015, which is hereby incorporated by reference in its entirety.

FIELD

The present disclosure generally relates to a loader for loading ammunition, and more particularly to a loader for loading ammunition into a magazine for a handgun.

BACKGROUND

Various types of firearms including rifles and handguns (e.g., pistols) are configured to receive a magazine for feeding rounds of ammunition to a firing mechanism of the firearm. There are many types of firearm magazines, some of which are adapted to hold only a few rounds of ammunition, and others of which are adapted to hold tens to hundreds of rounds of ammunition. Loading ammunition into a magazine is conventionally performed by grabbing rounds by hand one at a time and inserting them individually into the magazine. This process can be time consuming, depending on the type and size of the magazine. In addition, this process can be tedious and cause hand fatigue.

SUMMARY

One aspect of the present invention is directed to a handgun magazine loader for loading a cartridge into a handgun magazine. The handgun magazine includes a housing having a distal end, a mouth end opposite the distal end, a pair of lips at least partially closing the mouth end, and a spring for urging cartridges in the magazine toward the lips. The loader includes a magazine receiver having a magazine well for receiving at least a portion of the magazine therein for loading the magazine. The loader includes a cartridge driver supported by the magazine receiver for driving a cartridge into the magazine well for loading the magazine. The cartridge driver includes an actuator and a plunger. The actuator is selectively movable with respect to the magazine receiver. The plunger is positioned with respect to the actuator and movable with respect to the actuator for driving the cartridge toward the magazine well in response to movement of the actuator. The cartridge driver is configured for driving the cartridge with the plunger in a first direction with respect to the magazine well for introducing the cartridge into the mouth end of the magazine. The cartridge driver is configured for driving the cartridge in a second direction with respect to the magazine well nonparallel to the first direction for fully seating the cartridge in the mouth end of the magazine between the spring and the lips of the magazine.

Another aspect of the present invention is directed to a method of loading a cartridge into a handgun magazine using a handgun magazine loader. The handgun magazine includes a housing having a distal end, a mouth end opposite the distal end, a pair of lips at least partially closing the mouth end, and a spring for urging cartridges in the magazine toward the lips. The method includes inserting the handgun magazine at least partially into a magazine well of the loader. The method includes positioning a cartridge with respect to a cartridge driver of the loader for being driven into the magazine by the cartridge driver. The method includes introducing the cartridge into the mouth end of the magazine in a first direction by actuating an actuator of the cartridge driver to drive the cartridge with a plunger of the cartridge driver. The plunger moves with respect to the actuator while the plunger drives the cartridge toward the mouth end of the magazine. The method includes fully seating the cartridge in the mouth end of the magazine between the spring and lips of the magazine by driving the cartridge with the cartridge driver in a second direction nonparallel to the first direction.

Another aspect of the present invention is directed to a handgun magazine loader for loading a cartridge into a handgun magazine. The handgun magazine includes a housing having a distal end, a mouth end opposite the distal end, a pair of lips at least partially closing the mouth end, and a spring for urging cartridges in the magazine toward the lips. The loader includes a magazine receiver having a magazine well for receiving at least a portion of the magazine therein for loading the magazine. The loader includes a cartridge driver supported by the magazine receiver for driving a cartridge into the magazine well for loading the magazine. The cartridge driver includes an actuator and at least one plunger. The actuator is selectively movable with respect to the magazine receiver in an actuating stroke from a home position to an actuated position and in a return stroke from the actuated position back to the home position. The at least one plunger is movable by the actuator for driving the cartridge in response to movement of the actuator. The cartridge driver is configured for, in the actuating stroke, driving the cartridge in a first direction with respect to the magazine well for introducing the cartridge into the mouth end of the magazine and driving the cartridge in a second direction with respect to the magazine well nonparallel to the first direction for fully seating the cartridge in the mouth end of the magazine between the spring and lips of the magazine.

Another aspect of the present invention is directed to a handgun magazine loader for loading a cartridge into a handgun magazine. The handgun magazine includes a housing having a distal end, a mouth end opposite the distal end, a pair of lips at least partially closing the mouth end, and a spring for urging cartridges in the magazine toward the lips. The cartridges each include a case and a bullet seated in the case. The loader includes a magazine receiver having a magazine well for receiving at least a portion of the magazine therein for loading the magazine. The loader includes a cartridge driver supported by the magazine receiver for driving a cartridge into the magazine well for loading the magazine. The cartridge driver is configured for pushing against a side of the case of the cartridge for introducing the cartridge into the mouth end of the magazine. The cartridge driver is configured for, after introducing the cartridge into the mouth end, pushing against the bullet of the cartridge for fully seating the cartridge in the mouth end of the magazine between the spring and the lips of the magazine.

Yet another aspect of the present invention is directed to a method of loading a cartridge into a handgun magazine using a handgun magazine loader. The handgun magazine includes a housing having a distal end, a mouth end opposite the distal end, a pair of lips at least partially closing the mouth end, and a spring for urging cartridges in the magazine toward the lips. The cartridge includes a case and a bullet seated in the case. The method includes inserting the handgun magazine at least partially into a magazine well of the loader. The method includes positioning a cartridge with respect to a cartridge driver of the loader for being driven into the magazine by the cartridge driver. The method includes introducing the cartridge into the mouth end of the magazine by pushing against a side of the case of the cartridge with the cartridge driver. The method includes, after introducing the cartridge into the mouth end, fully seating the cartridge in the mouth end of the magazine between the spring and lips of the magazine by pushing against the bullet of the cartridge with the cartridge driver.

Other objects and features of the present invention will be in part apparent and in part pointed out herein.

BRIEF DESCRIPTION OF THE DRAWINGS

Corresponding reference characters indicate corresponding parts throughout the drawings.

DETAILED DESCRIPTION

Figure 1:
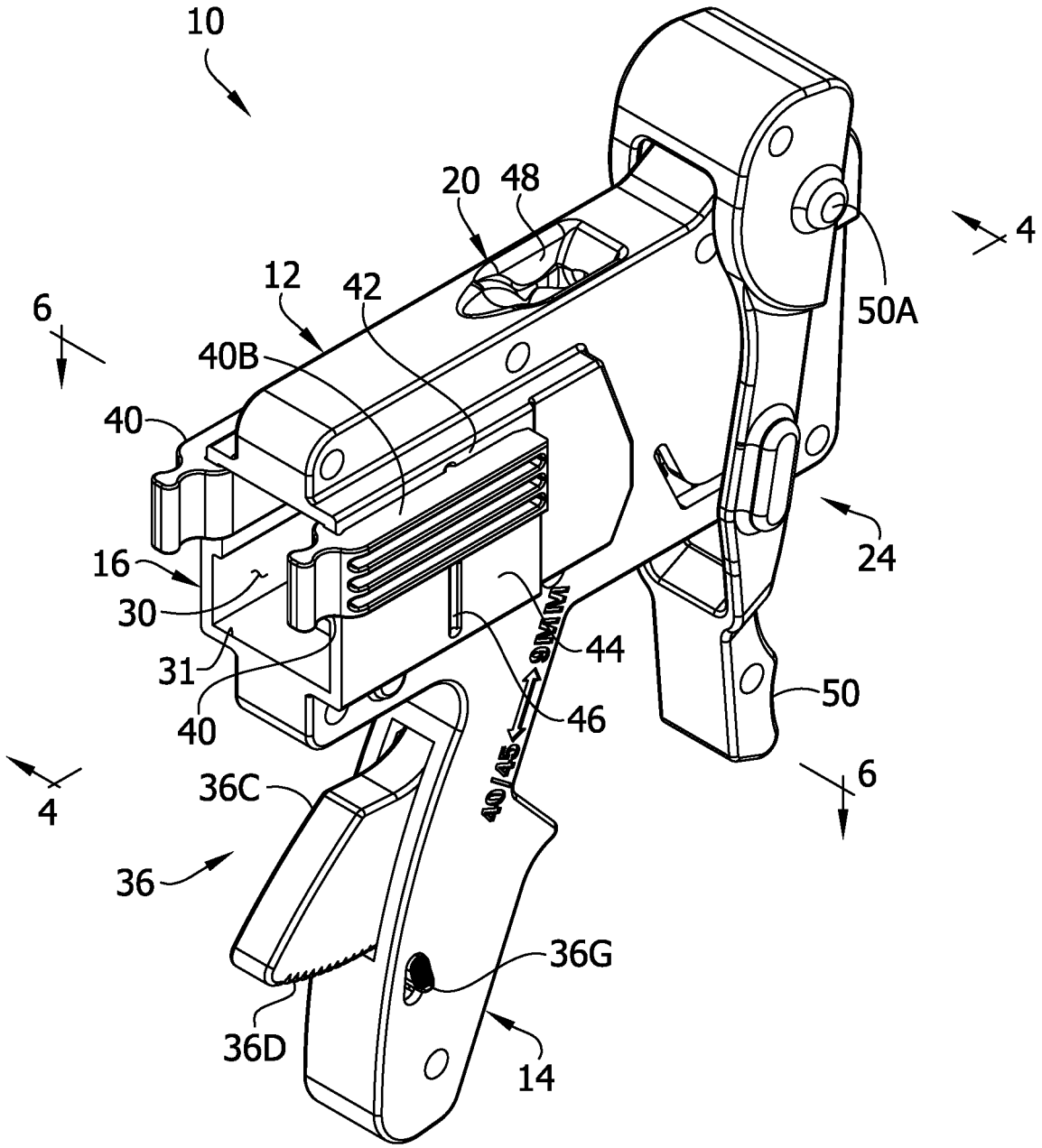
FIG. 1 is a rear perspective of a magazine loader embodying aspects of the present invention.
Figure 2:
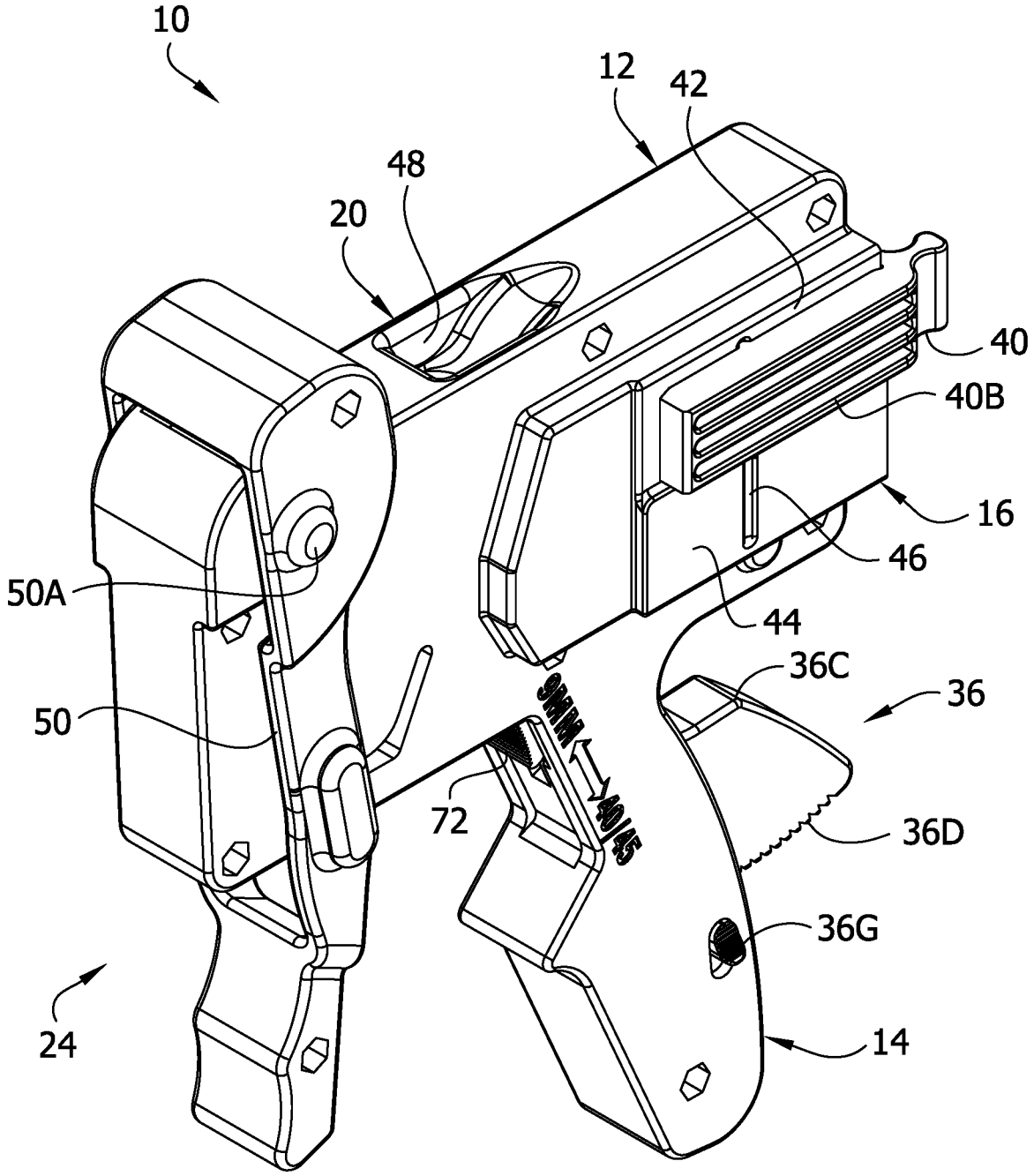
FIG. 2 is a front perspective of the magazine loader of FIG. 1.

Referring to FIGS. 1 and 2, a first embodiment of a handgun magazine loader embodying aspects of the present invention is designated generally by the reference number 10. The loader 10 is configured for loading several rounds of ammunition, also referred to as cartridges, into a handgun magazine M in a relatively short time period. The loader 10 reduces hand fatigue associated with loading the magazine M. As will become apparent, in the illustrated embodiment, the loader 10 is a universal handgun loader in that it can be used to load a plurality of types of cartridges (e.g., ranging from 9 mm to .45 caliber) into a plurality of types of handgun magazines, including "single stack" and "double stack" magazines, for various types of handguns.

As shown in FIGS. 1 and 2, the loader 10 includes a generally rectangular main body 12 and a handle 14 in the form of a pistol grip extending downward from a lower end of the main body. The loader 10 includes a magazine receiver 16 on a rear end of the main body 12. The loader 10 also includes a cartridge receiver 20 in the main body 12 opening out the top of the main body. A cartridge driver 24 is provided for moving cartridges from the cartridge receiver 20 into the magazine receiver 16. As will become apparent, a user can hold the loader by the handle 14, insert the magazine into the magazine receiver 16, and repeatedly load cartridges into the cartridge receiver 20 and actuate the cartridge driver 24 to place a plurality of cartridges in the handgun magazine. The various parts of the loader can be made of any suitable material, such as molded plastic and/or metal.

Figure 3:
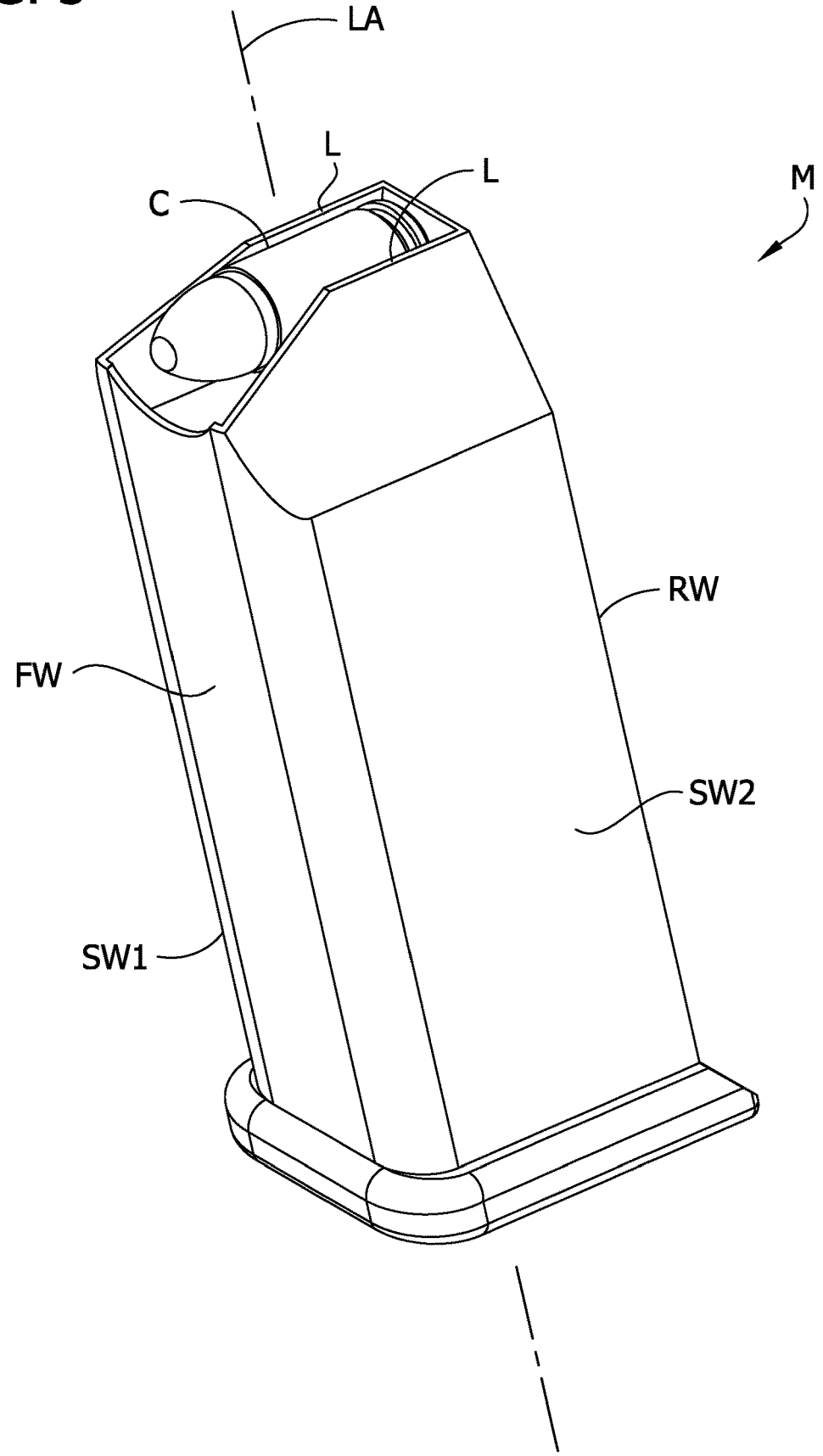
FIG. 3 is a perspective of a magazine having a cartridge seated therein.
Figure 20:
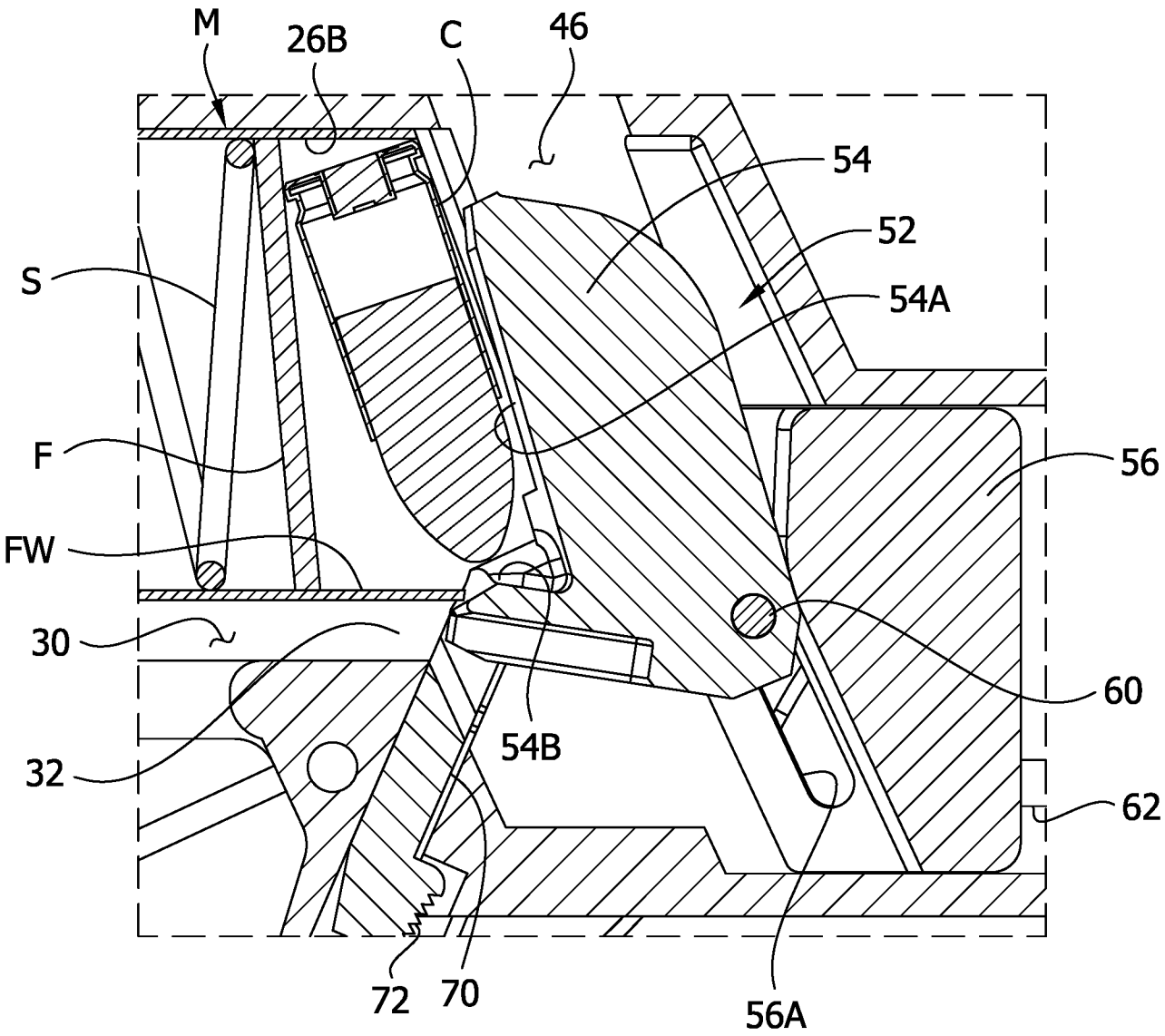
FIG. 20 is an enlarged fragmentary view similar to FIG. 19 but showing a plunger of the loader retracting from the cartridge.

Referring to FIG. 3, an example handgun magazine M is illustrated having a cartridge C loaded therein. The cartridge C includes a case, a bullet seated therein, a propellant behind the bullet, and primer for igniting the propellant. The cartridge has a primer end, a bullet end (including a tip), and a generally circumferential side (defined by the case) extending between the primer end and the bullet end. The magazine M has a generally hollow housing sized for holding a plurality of cartridges therein. The housing includes a front wall FW, rear wall RW, and opposite side walls SW1, SW2. The magazine M includes a bottom (distal) end, a mouth (proximal) end, and a longitudinal axis LA extending therebetween. The mouth end includes a pair of lips L partially closing the mouth end for retaining a cartridge therein. A gap between the lips L is smaller than the diameter of the cartridge C. The mouth end has a cartridge opening in front of the lips L sized for permitting a cartridge to pass into and out of the interior of the magazine M. A cartridge enters the cartridge opening primer end first and exits the cartridge opening bullet end first. A spring S and follower F (e.g., see FIG. 5) are provided inside the magazine M for urging cartridges received therein toward the lips L. In FIGS. 3 and 20, the cartridge is shown fully seated in the mouth end of the magazine M. As used herein, the cartridge being fully seated in the mouth end of the magazine means the cartridge is between the spring S and lips L (e.g., with one or more other cartridges or no other cartridge between the spring and the seated cartridge) and has its bullet end inboard of the front wall FW of the magazine M so the cartridge can move toward the distal end of the magazine as additional cartridges are loaded into the magazine. In the fully seated position, the cartridge C can have its primer end against a cartridge stop (e.g., part of the magazine rear wall RW) that prevents rearward axial movement of the cartridge in the magazine. In the illustrated embodiment, the cartridge C is a 9 mm caliber round, and the magazine M is a "double stack" magazine configured for holding 9 mm rounds. It will be understood other types of cartridges (e.g., other calibers) and magazines (e.g., single stack and/or for holding other calibers, etc.) can be used without departing from the scope of the present invention.

Figure 4:
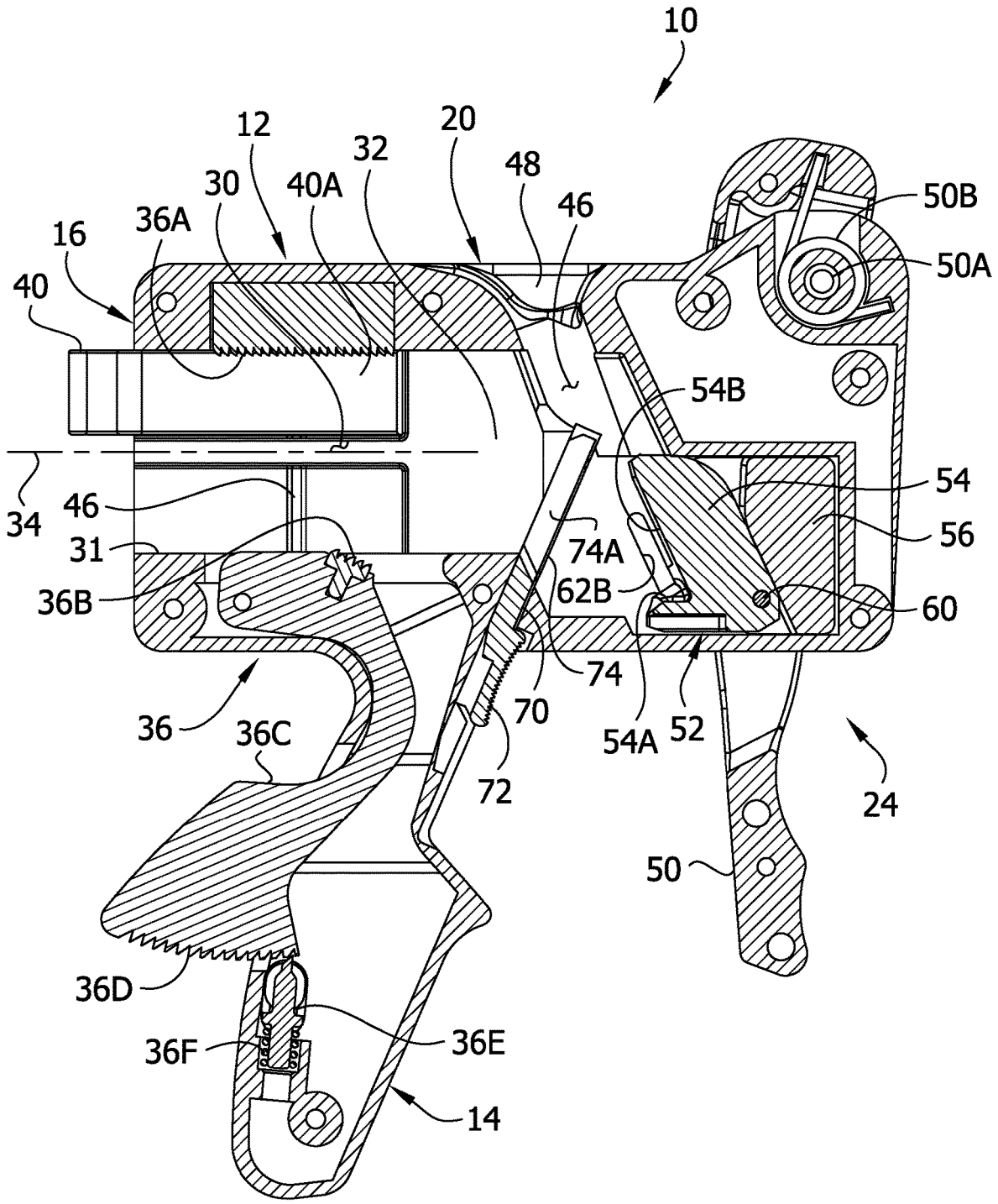
FIG. 4 is a section of the magazine loader taken in the plane including line 4-4 shown in FIG. 1.

Referring now to FIG. 4, the magazine receiver 16 is shown in closer detail. The magazine receiver 16 includes a magazine well 30 for receiving the handgun magazine. The magazine well 30 extends from an outer (rear) end 31 to an inner (forward) end 32. The inner end 32 is positioned for receiving the mouth end of the magazine M when received in the magazine well. When the magazine M is received in the magazine well 30, the mouth end is in the inner end 32, and the cartridge opening of the magazine faces downward and to the right, as viewed in FIG. 5. The inner end 32 opens to the cartridge receiver 20 for receiving cartridges therefrom. As shown in FIG. 4, the magazine well 30 has a magazine well axis 34 (e.g., longitudinal axis) along which the longitudinal axis LA of the magazine M extends when received therein for loading the magazine. In the illustrated embodiment, the magazine M is inserted in the magazine well 30 along the magazine well axis 34. Other types or configurations of magazine wells can be used without departing from the scope of the present invention.

The magazine receiver 20 includes a magazine retainer 36 for releasably retaining the magazine in the magazine well. In the illustrated embodiment, the magazine retainer 36 includes a clamp having opposing upper and lower clamp members 36A, 36B. For example, the clamp members are rubber pads 36A, 36B having teeth thereon for enhancing a frictional grip on the front and rear walls FW, RW of the magazine. The upper clamp member 36A is mounted in an upper wall of the magazine well 30 and is stationary. The lower clamp member 36B is mounted on an arm 36C. The arm 36C and clamp member 36B can be referred to collectively and broadly as a press configured for pressing against the magazine M for retaining the magazine in the magazine well 30. The arm has a pivot connection with the main body 12 at a proximal end of the arm. The arm has a set of teeth 36D on a distal end thereof for engagement with a ratcheting keeper 36E. The keeper 36E is biased toward the set of teeth 36D by a compression spring (biasing member) 36F. The magazine retainer 36 has a non-retaining position (e.g., FIG. 4) in which the clamp is open and not clamped on a magazine, and a retaining position (e.g., FIG. 5) in which the clamp is clamped on the magazine M for retaining it in the magazine well 30. After the magazine M is positioned in the magazine well 30, the arm 36C can be pivoted upward (e.g., by the user pressing on a rear of the arm with a palm of their hand while gripping the handle 14) to bring the lower clamp member 36B and upper clamp member 36A into clamping engagement with the magazine front and rear walls FW, RW, respectively. The ratcheting engagement of the teeth 36D with the keeper 36E maintains the clamped engagement. It will be appreciated that the ratcheting engagement makes the magazine retainer 36 capable of retaining handgun magazines of various dimensions (between the front and rear walls of the magazine) in the magazine well. The keeper 36E is selectively disengageable from the teeth 36D, to release the clamping engagement, by moving the keeper against the bias of the spring 36F, such as by pressing downward on a release button 36G connected to the keeper (FIGS. 1, 2). A biasing member (not shown) can be used to bias the arm 36C toward the non-retaining position. Other types or configurations of magazine retainers can be used without departing from the scope of the present invention.

The magazine receiver 16 includes a centering system for centering the mouth end of the magazine M for receiving cartridges from the cartridge driver 24. The magazine well 30 desirably has a sufficient width to permit handgun magazines of various widths to be inserted therein. For example, double stack magazines are usually wider than single stack magazines, and the widths of single and double stack magazines can vary based on the type of handgun and/or caliber of cartridges receivable in the magazines. To assist in centering the magazines, the centering system includes a set of reducers 40 mountable on the magazine receiver 20 in a variety of configurations for reducing the width of the magazine well 30 an amount selected to provide the magazine well with an effective width corresponding closely to the width of the selected magazine. In the illustrated embodiment, two reducers 40 are provided, and the reducers are mountable on opposite left and right walls of the magazine receiver 16. Referring to FIGS. 1, 4, 6, and 22, the reducers 40 have identical construction and comprise generally U-shaped clips. The opposite sides of the reducers (i.e., opposite legs of the U-shape) are first and second shims 40A, 40B having respective outward facing side faces. The second shim 40B has a greater thickness than the first shim 40A. When a reducer 40 is mounted on a side wall of the magazine receiver 16, either the first shim 40A or the second shim 40B is positioned in the magazine well 30 for reducing the effective width of the magazine well. When the first shim 40A is positioned in the magazine well 30 the side face of the first shim faces the magazine well axis 34, and when the second shim 40B is positioned in the magazine well the side face of the second shim faces the magazine well axis. Accordingly, the shims 40A, 40B are configured for reducing the width of the magazine well 30 by different amounts, depending on whether the first shims 40A or the second shims 40B are positioned in the magazine well.

Figure 7:
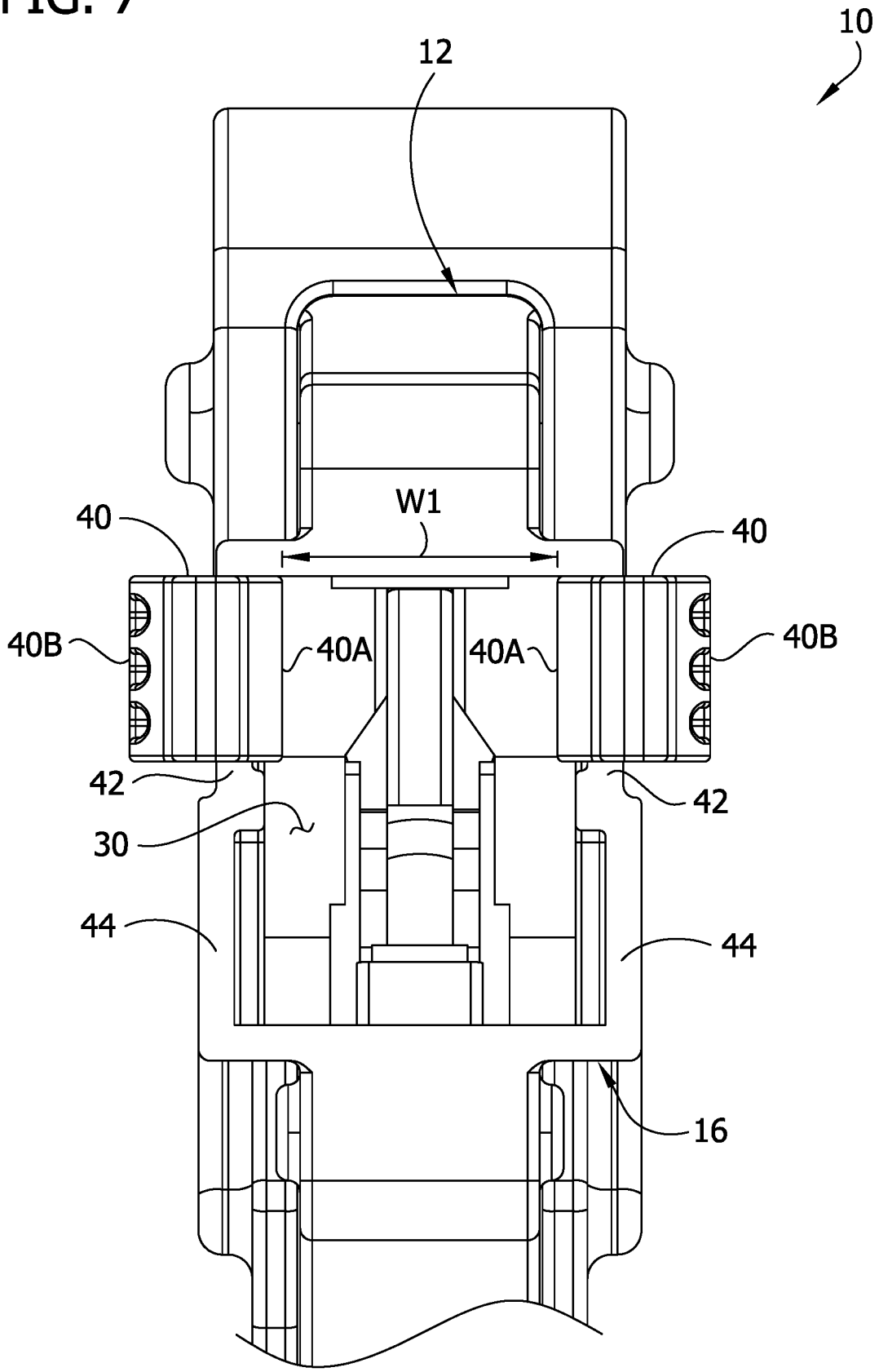
FIG. 7 is a fragmentary rear elevation of the magazine loader.

Referring to FIG. 7, the opposite side walls of the magazine receiver 16 have upper and lower portions 42, 44 each sized for mounting the reducers 40. The upper and lower side wall portions 42, 44 have openings 46 for receiving detents 40C of the reducers for releasably maintaining the reducers on the side wall portions (see FIGS. 1 and 6). Positions of the upper side wall portions 42 and lower side wall portions 44 can be described with respect to a magazine well plane that extends parallel to the side wall portions and includes the magazine well axis 34. For example, the upper side wall portions 42 are positioned closer to well plane than the lower side wall portions 44 are positioned with respect to the well plane.

Figure 8:
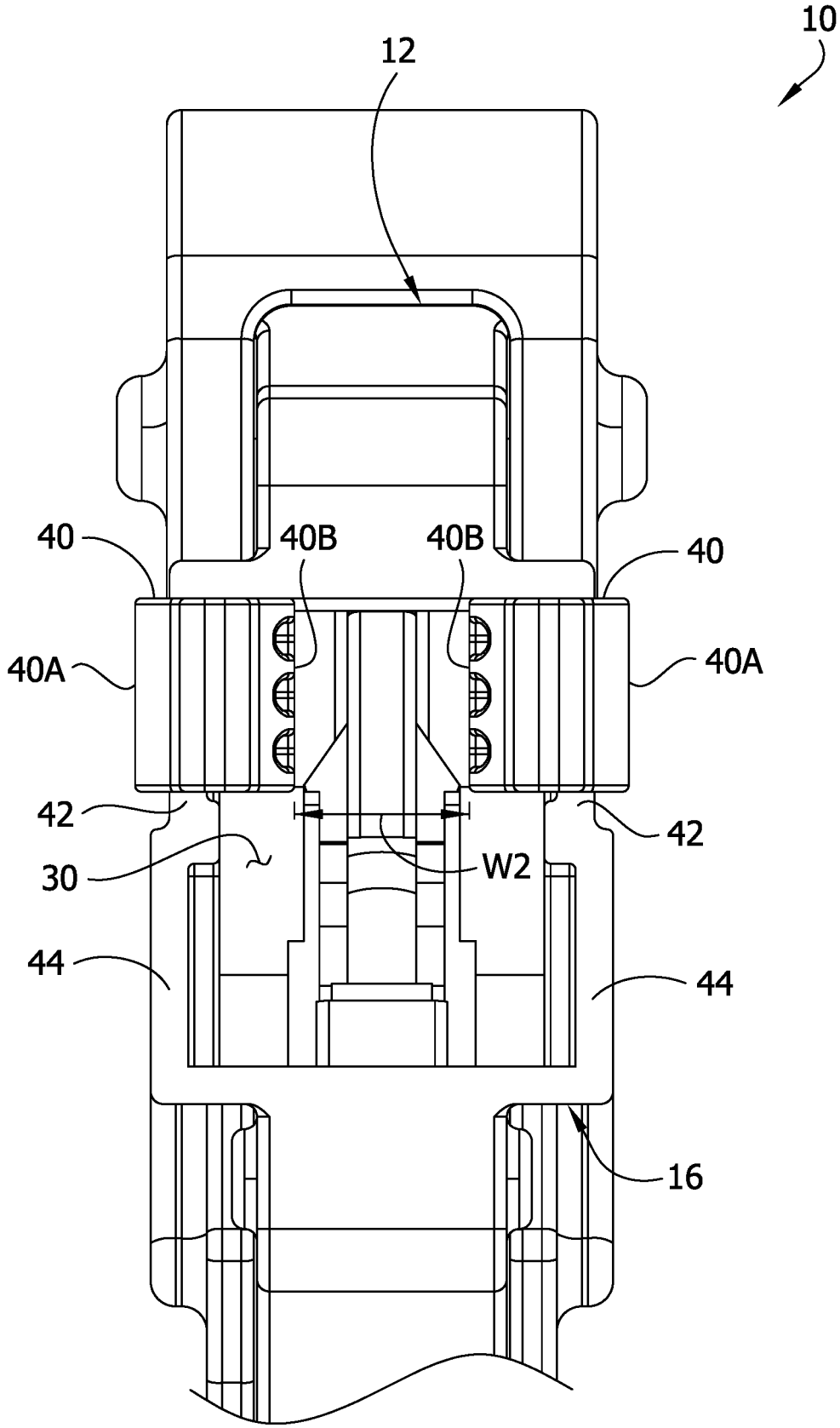
FIG. 8 is a fragmentary rear elevation similar to FIG. 7 but showing reducers of the magazine loader configured differently to provide a different magazine well width.
Figure 9:
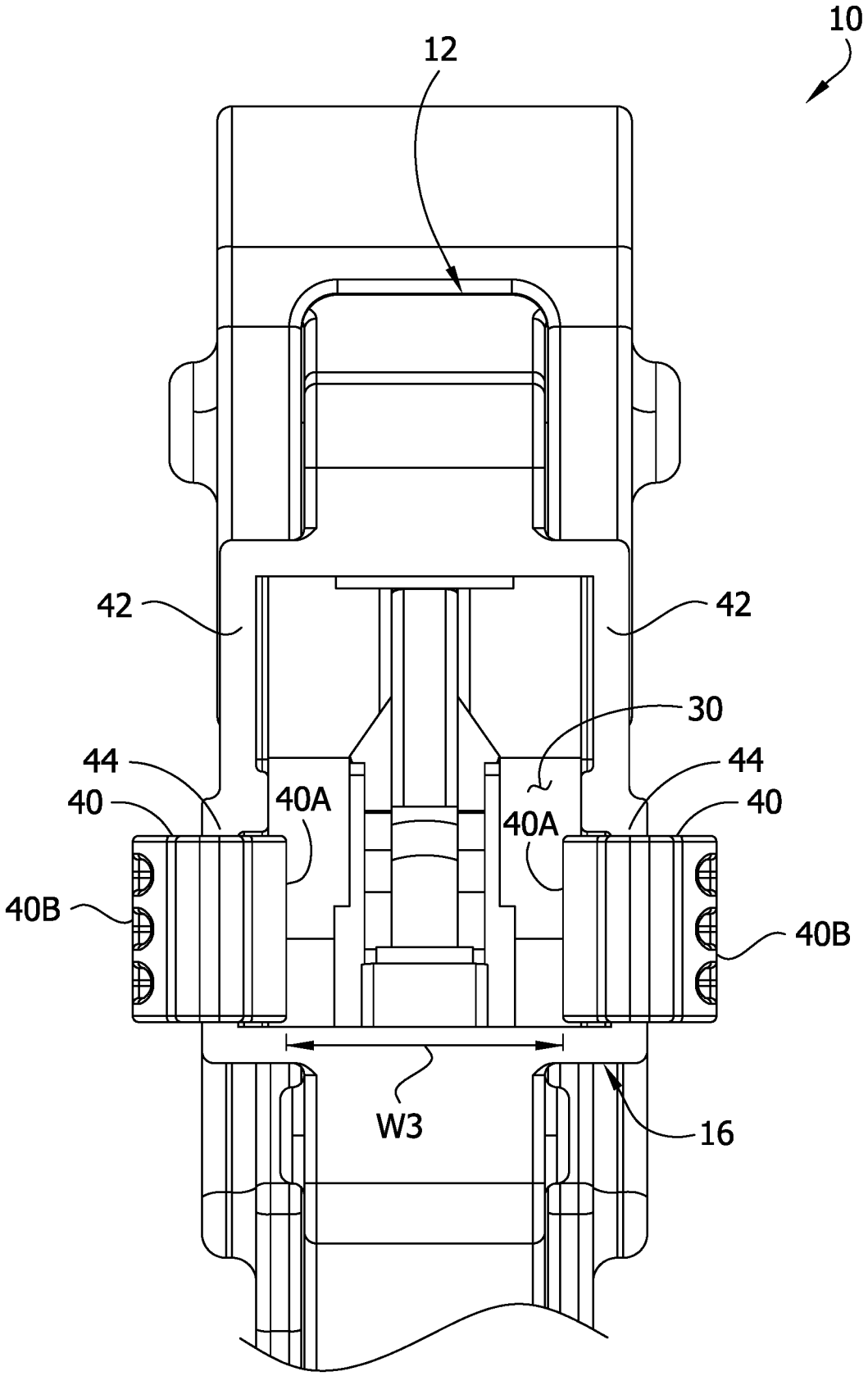
FIG. 9 is a fragmentary rear elevation similar to FIG. 7 but showing the reducers configured differently to provide a different magazine well width.
Figure 10:
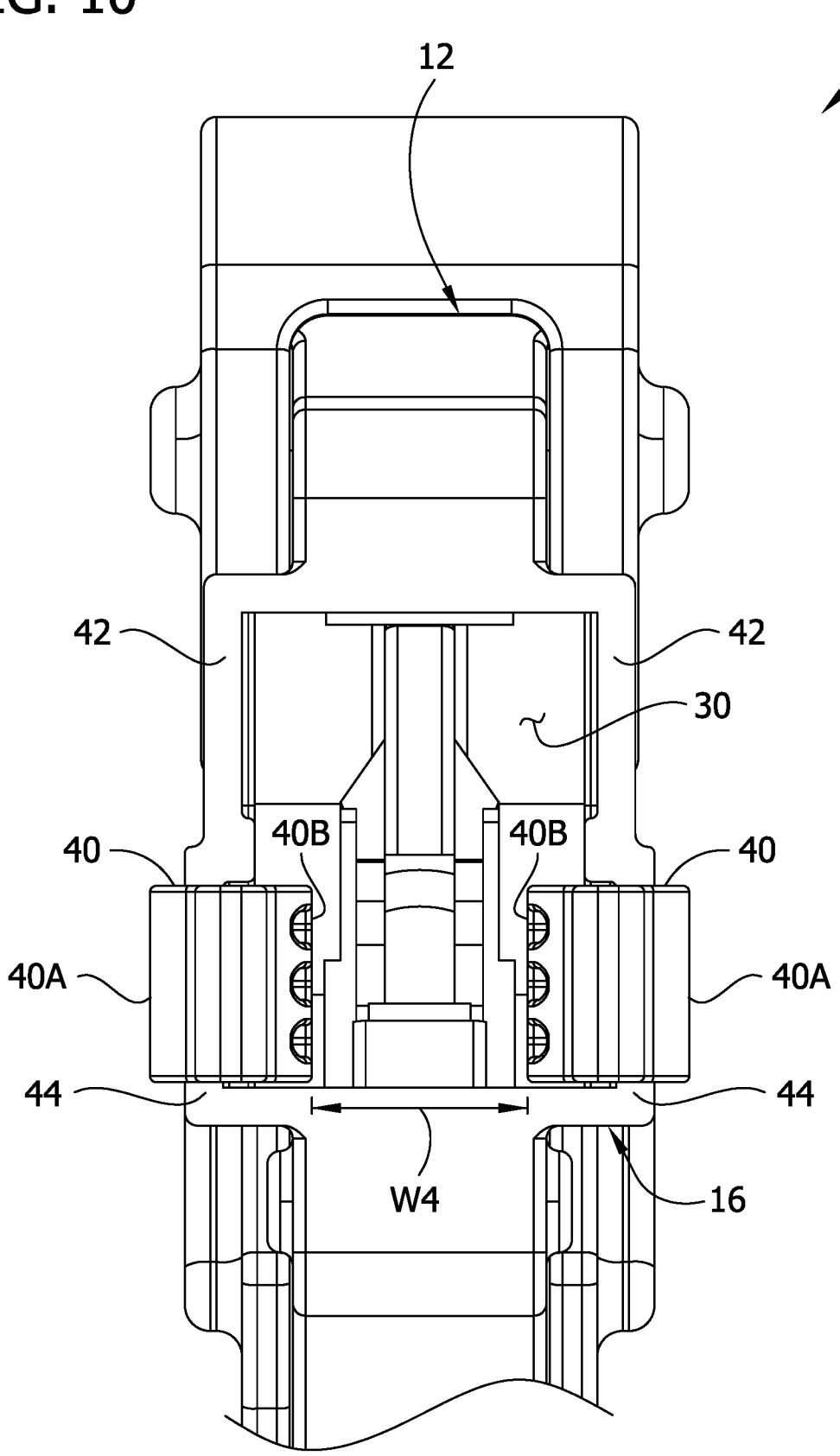
FIG. 10 is yet another fragmentary rear elevation similar to FIG. 7 but showing the reducers configured differently to provide a different magazine well width.

The arrangement is such that the reducers 40 can be mounted on the magazine receiver 16 in four different configurations for providing four different reduced widths of the magazine receiver W1-W4 (FIGS. 7-10). In the example illustrated in FIGS. 1, 2, 4, 5-7 and 11-20, the reducers 40 are mounted on the magazine receiver 16 for centering the double stack 9 mm magazine M. More specifically, the reducers 40 are mounted on the upper side wall portions 42 and having the thinner first shims 40A in the magazine well 30, providing an effective magazine well thickness of W1. In FIGS. 8-10, the reducers 40 are shown mounted in other configurations for providing other magazine well widths. For example, FIG. 8 shows the reducers 40 mounted on the upper side wall portions 42 but having the thicker second shims 40B in the magazine well 30, providing an effective magazine well width of W2. FIG. 9 shows the reducers 40 mounted on the lower side wall portions 44 and having the thinner first shims 40A inside the magazine well 30, providing an effective magazine well width of W3. FIG. 10 shows the reducers 40 mounted on the lower side wall portions 44 but having the thicker second shims 40B inside the magazine well 30, providing an effective magazine well width of W4. Thus, the reducers 40 have four predetermined configurations. It will be appreciated that using the same mounting configuration for the left and right reducers 40 reduces the magazine well width on center for centering the mouth end of the magazine M with respect to the cartridge driver 24. It has been found that at least two mounting configurations of the reducers 40 can provide flexibility to accommodate many types of handgun magazines, at least three mounting configurations can accommodate more types of handgun magazines, and four mounting configurations, as shown in the illustrated embodiment, can accommodate most types of handgun magazines. Moreover, it will be appreciated that the reducers 40 are arranged in the predetermined configurations without needing to engage the reducers with the magazine M (e.g., to push the reducer into the configuration using the magazine). Other types or configurations of magazine centering systems can be used without departing from the scope of the present invention.

Referring to FIG. 4, in the illustrated embodiment, the cartridge receiver 20 includes a cartridge passage 46 downstream from a cartridge receiving opening 48 for delivering a cartridge to the cartridge driver 24. The cartridge receiver 20 is constructed for presenting one cartridge at a time to the cartridge driver 24. The cartridge passage 46 opens into the magazine well inner end 32. The user can drop a cartridge from above the loader into the cartridge receiver 20, actuate the cartridge driver 24, and then drop another cartridge into the cartridge receiver, etc. Other types and configurations of cartridge receivers can be used without departing from the scope of the present invention. For example, the cartridge receiver can include a hopper sized for holding a plurality of cartridges to be fed to the cartridge driver for being loaded into the magazine.

The cartridge driver 24 will now be described in further detail. The cartridge driver 24 is configured for driving one cartridge at a time into the magazine M. Referring to FIGS. 1, 2, and 4, the cartridge driver 24 comprises a cartridge loading mechanism including an actuator 50 and a plunger 52. The actuator 50 is provided in the form of a lever having a trigger arrangement with respect to the pistol grip handle 14. The lever 50 has a pivot connection 50A at a proximal end of the lever with the upper end of the housing, and a distal end that extends downward from the main body in front of the handle 14. An opening in the intermediate portion of the lever 50 receives the front end of the main body 12 through the lever, such that side portions of the lever are provided on each side of the main body and merge at the distal trigger portion. The lever 50 is selectively pivotable about the pivot connection 50A in an actuation or actuating stroke from a non-actuated position (e.g., FIGS. 1, 13, 14) toward an actuated position (e.g., FIGS. 17, 18), and in a return stroke from the actuated position back to the non-actuated position. The lever 50 is shown in an intermediate position between the non-actuated and actuated positions in FIGS. 15 and 16. As shown in FIG. 4, a spring 50B at the pivot connection biases the lever 50 toward the non-actuated position.

As shown in FIG. 4, the plunger 52 is positioned inside the main body 12, and is configured for moving a cartridge from the cartridge receiver 20 into the inner end 32 of the magazine receiver 16 for entering the cartridge opening of the magazine M. The plunger 52 is positioned with respect to the actuator 50 and movable with respect to the actuator for driving the cartridge C toward the magazine well 30 and into the magazine M in response to movement of the actuator. In the illustrated embodiment, the plunger 52 includes a head (broadly "first follower") 54 and a slide (broadly "second follower") 56. The plunger 52 is movable in a plunging stroke from a retracted position (e.g., FIGS. 12, 14) toward a plunged position (e.g., FIGS. 18, 19), and movable in a retracting stroke from the plunged position back to the retracted position. The plunger 52 is shown in an intermediate position between the retracted and plunged positions in FIG. 16.

The head 54 includes a cartridge side engagement surface 54A (e.g., cartridge case side engagement surface) and a bullet end engagement surface 54B positioned with respect to each other for defining a cartridge seat. The seat receives the cartridge C when the cartridge falls into the cartridge passage 46, or when the plunger 52 is in the plunging stroke. When the cartridge C is received on the seat, it is inclined with respect to the magazine axis 34 of the magazine well 30 so that the primer end of the cartridge is oriented toward the cartridge opening of the magazine. The cartridge side engagement surface 54A and bullet end engagement surface 54B are fixed in position with respect to each other. The side engagement surface 54A and bullet end engagement surface 54B are contoured (e.g., define a valley for receiving a portion of the cartridge) for cradling the cartridge C thereon and each can be referred to broadly as a cradle. The cartridge side engagement surface 54A and bullet end engagement surface 54B will usually simultaneously engage the cartridge C during the plunging stroke of the plunger 52, but other constructions can be used without departing from the scope of the present invention.

The head 54 is pivotally and slidably connected to the lever 50 such that the head is permitted to move by pivoting and translating with respect to the lever. More specifically, the head 54 is connected to the lever 50 by a pivot connection including a pin 60 extending out both sides of the main body 12 and received in slots 50C in the opposite sides of the lever. Covers over slots 50C in the lever 50 are shown partially broken away in FIGS. 13, 15, and 17, to show the pin 60 received in one of the slots. The arrangement is such that the pin 60 permits the head 54 to pivot relative to the lever 50, and the pin can move along the length of the slots 50C in the lever to permit the head to translate relative to the lever.

The slide 56 is pivotally connected to the lever 50 and to the head 54 by the same pin 60 that connects the head to the lever. The slide 56 has opposite side portions that straddle a front portion of the head 54. The straddling side portions of the slide have slots 56A (e.g., FIGS. 12, 18) therein receiving the opposite sides of the pin 60. The pin 60 is movable along the length of the slots 56A to permit the slide 56 to move by translation relative to the pivoting lever 50 and to permit the head 54 to move by translation relative to the slide.

Figure 11:
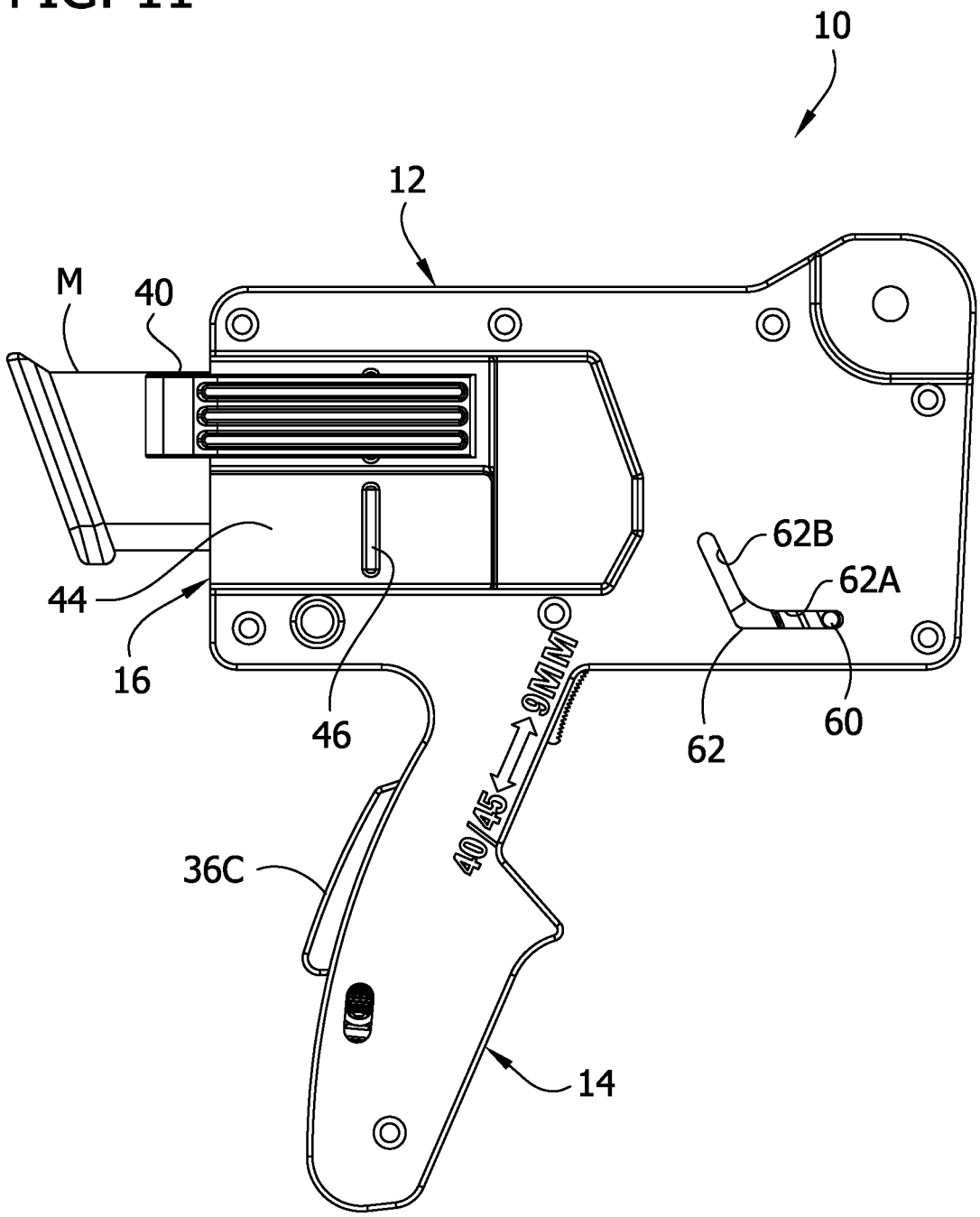
FIG. 11 is a side elevation of the magazine loader having an actuator removed from the loader.
Figure 12:
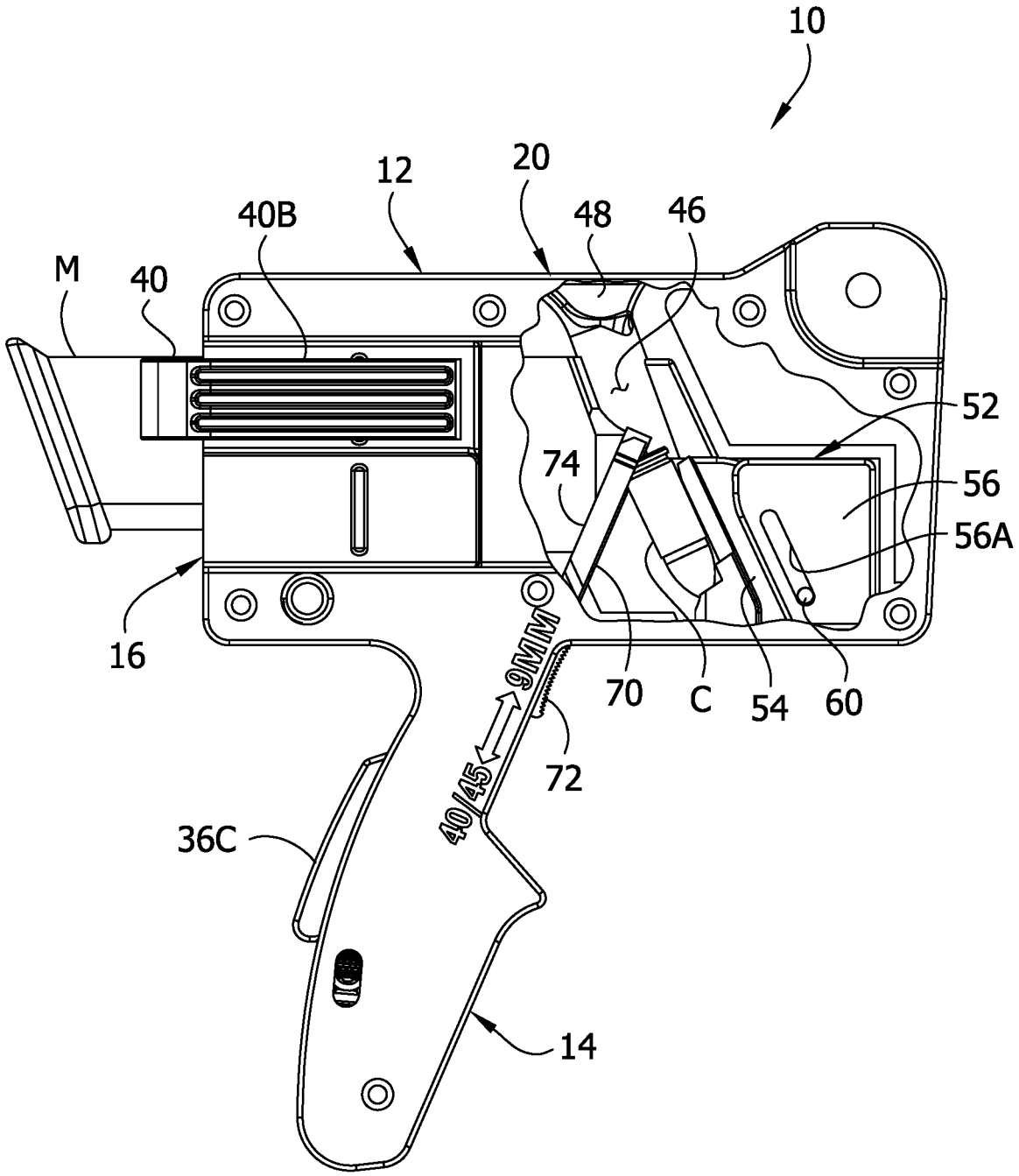
FIG. 12 is a side elevation of the magazine loader having the actuator removed and a portion of a side wall of the loader broken away to show internal components.
Figure 13:
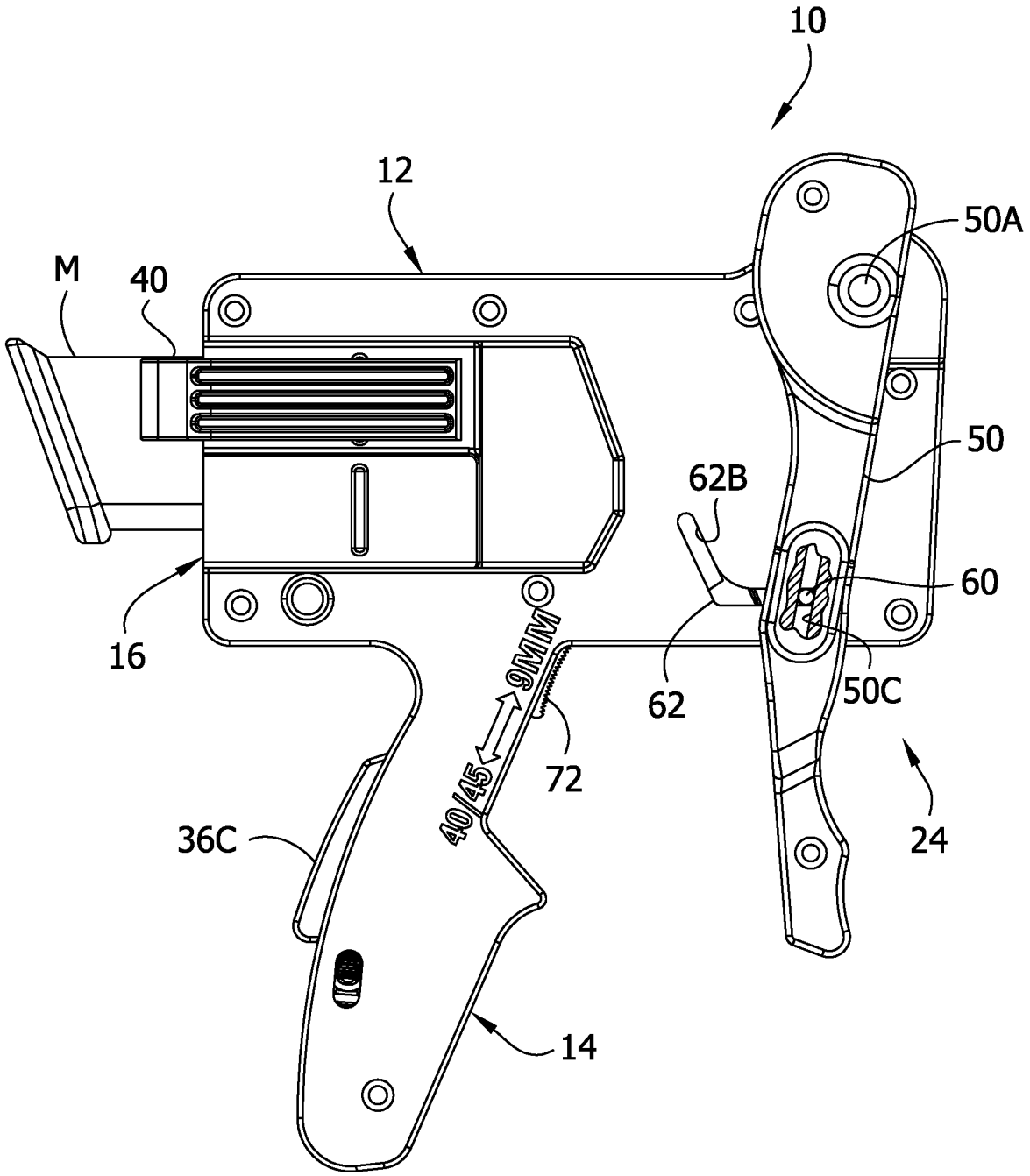
FIG. 13 is a side elevation of the magazine loader with the actuator having a portion broken away to show a pin connection.

As shown in FIG. 11, the main body 12 defines a track 62 for guiding movement of the pin 60 in response to movement of the actuator 50. The track 62 includes left and right track sections in respective opposite sides of the main body 12 for guiding both sides of the pin 60. As shown in FIG. 11, each track section has a forward or first portion 62A that extends substantially parallel with the magazine axis 34 of the magazine well 30, and has a rear or second portion 62B that extends transversely with respect to the forward portion and the magazine axis. In the illustrated embodiment, the track 62 is roughly L-shaped, forming an obtuse angle between the forward and rear portions 62A, 62B of the track.

The arrangement of the sliding pivot connection of the lever 50, slide 56, and head 54, is such that, in the actuating stroke of the lever, the plunger 52 executes sequential and distinct movements during the plunging stroke for loading the cartridge into the mouth end of the handgun magazine M. As shown by comparison of FIGS. 14 and 16, as the lever 50 begins the actuating stroke, the slide 56 and head 54 both move rearward. The pin 60 in the track 62 guides the slide 56 and the head 54 rearward along a slide travel path substantially parallel with the magazine well axis 34. The cartridge side engagement surface 54A moves toward the mouth of the magazine M at the inner end 32 of the magazine well 30. The result is the leading primer end of the cartridge C enters the cartridge opening of the mouth end of the magazine M, compressing the spring S of the magazine.

Figure 16:
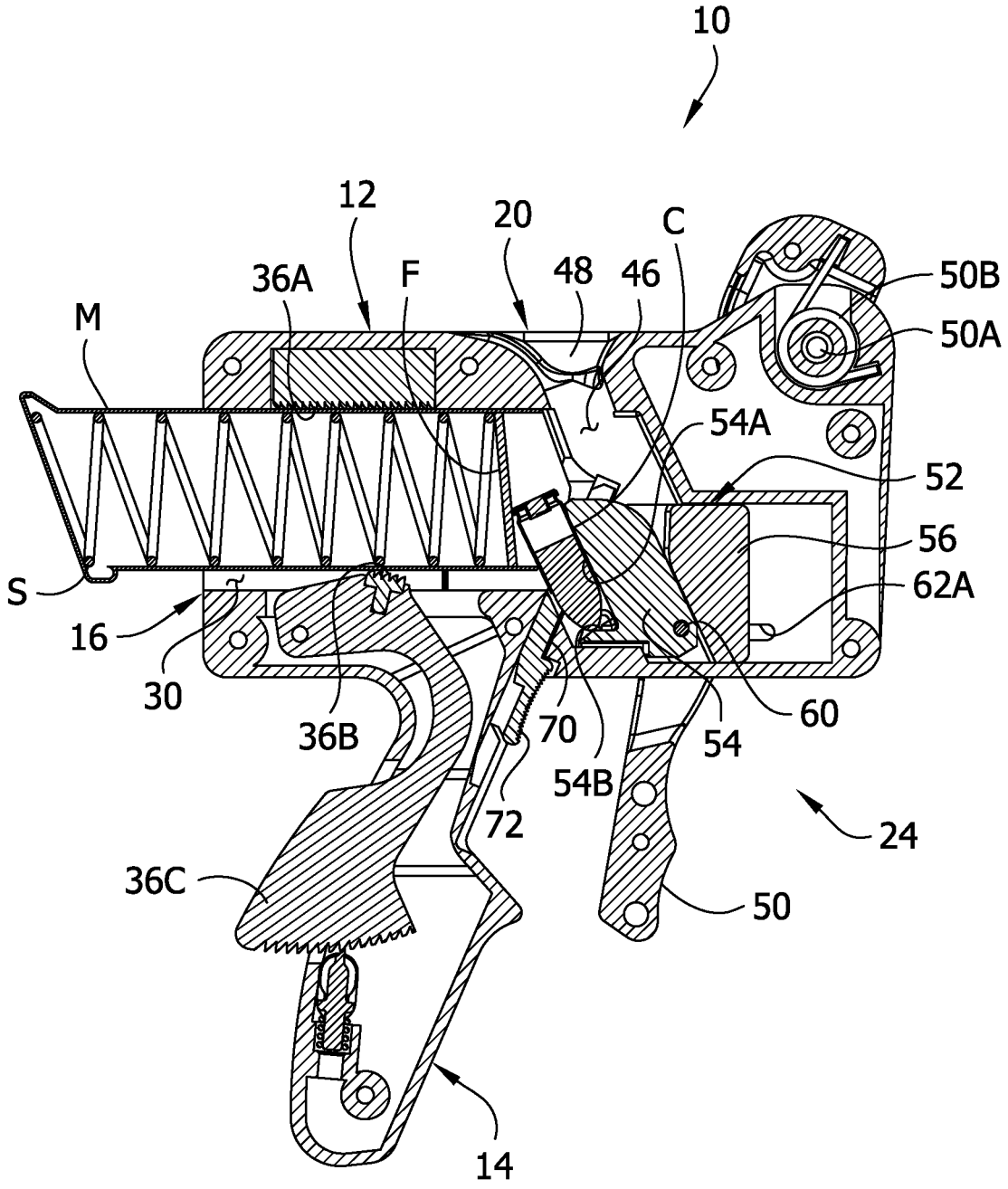
FIG. 16 is a section of the loader similar to FIG. 14 but showing the actuator in the partially actuated position of FIG. 15.
Figure 17:
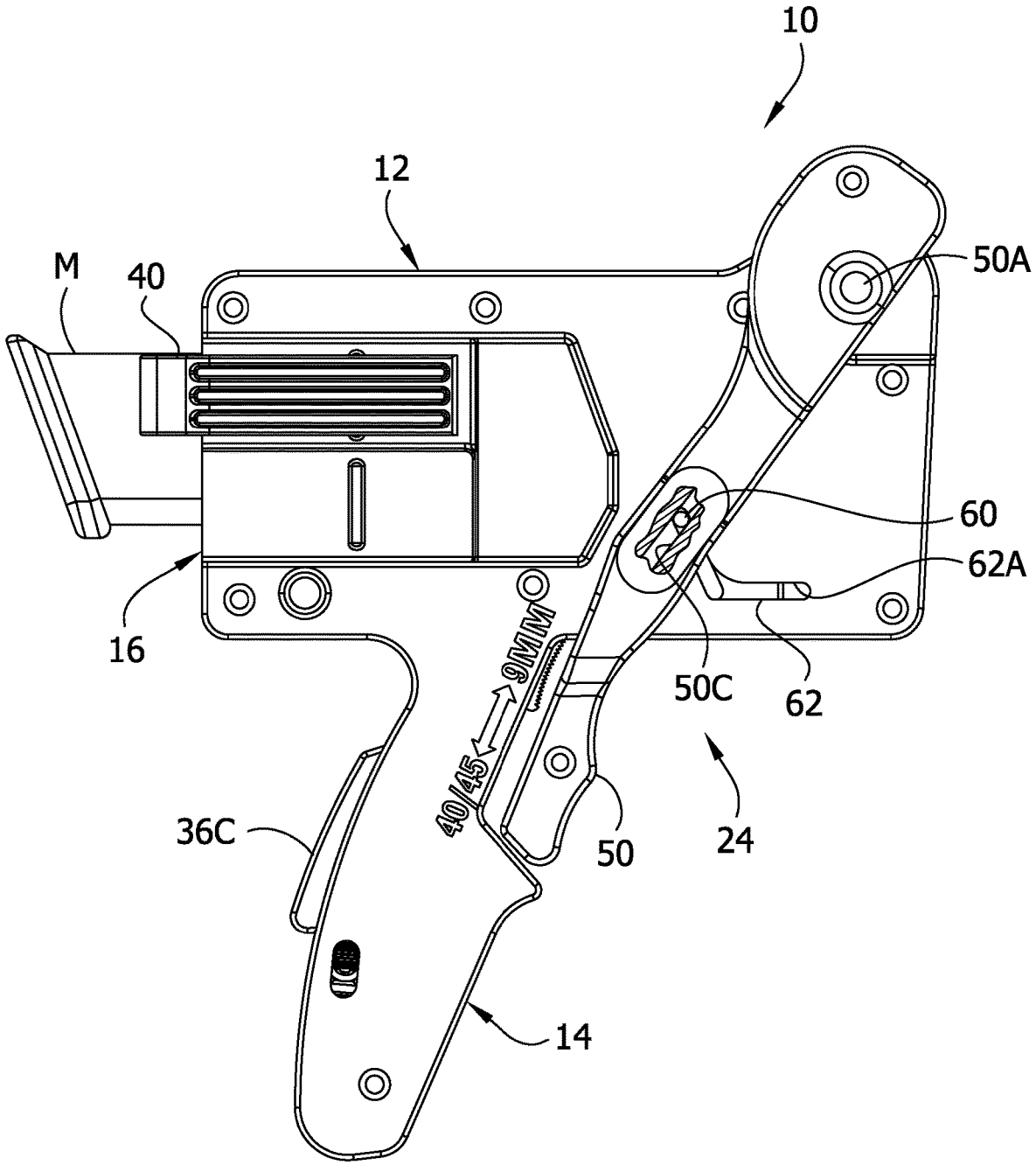
FIG. 17 is a side elevation of the loader showing the actuator in a fully actuated position and having a portion broken away to show the pin connection.
Figure 18:
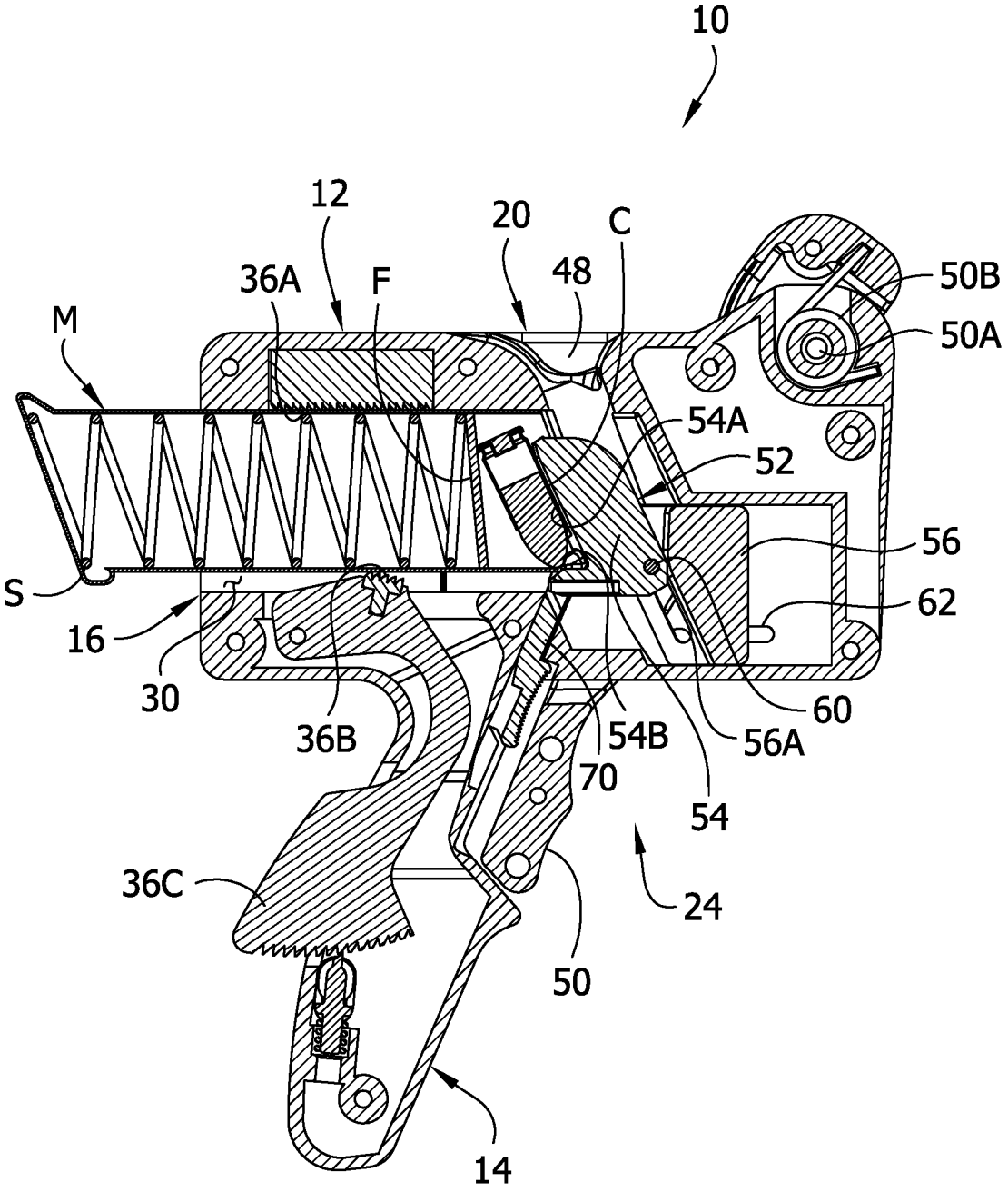
FIG. 18 is a section of the loader similar to FIG. 16 but showing the actuator in the fully actuated position of FIG. 17.
Figure 19:
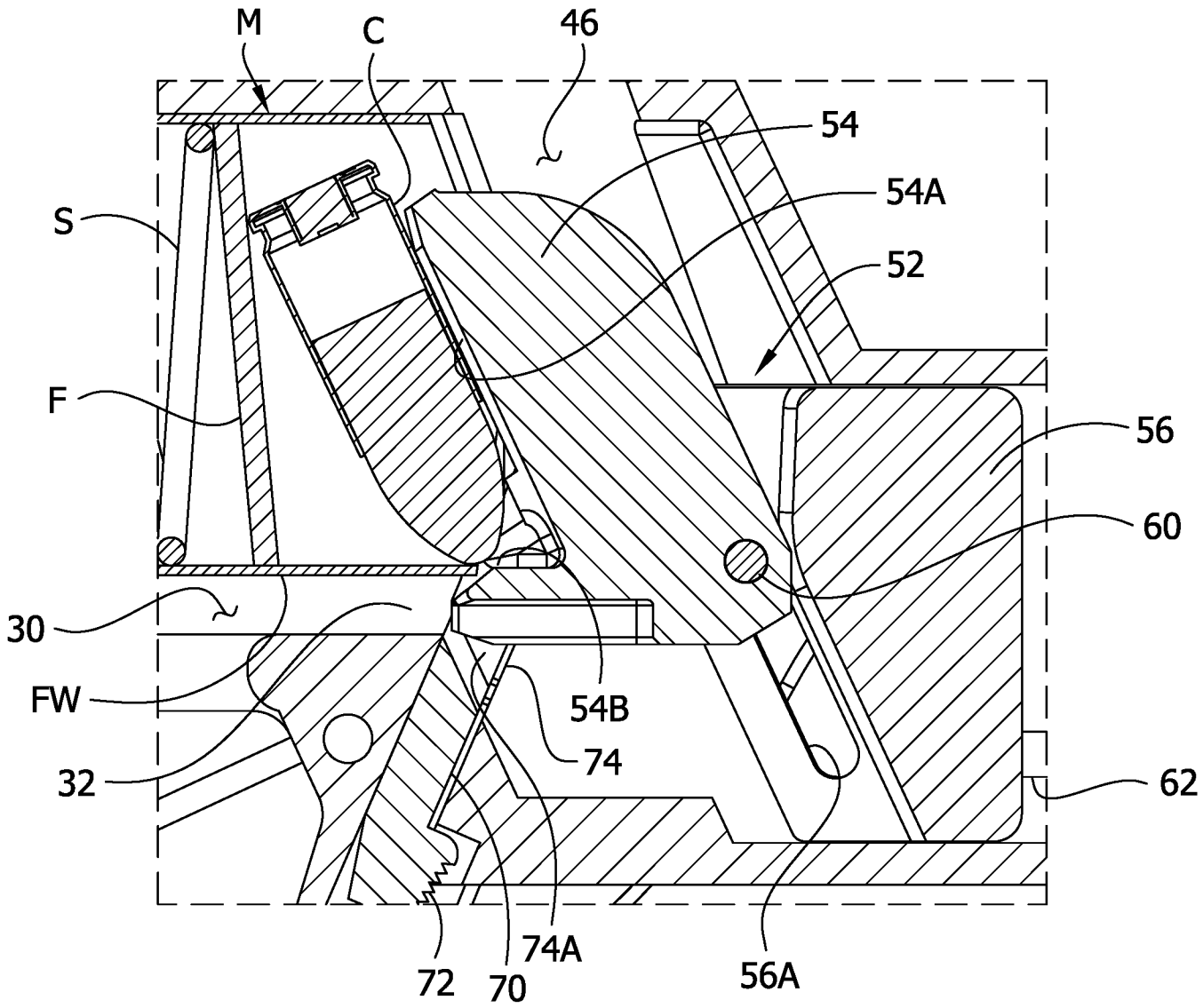
FIG. 19 is an enlarged fragmentary view of the section of FIG. 18.

As shown by comparison of FIGS. 16 and 18, in a second phase of the plunger stroke, the slide 56 remains stationary, and the head 54 and the pin 60 slide upward, transversely with respect to the slide travel path. The pin 60 in the track 62, and sliding engagement of the head 54 with the straddling portions of the slide 56, guide the head upward and laterally. The slots 56A in the slide 56 permit the head 54 to translate with respect to the slide, and the slots 50C in the lever 50 permit the head to translate with respect to the lever. The head 50 moves partially into the gap between the lips L of the mouth end of the magazine M. The bullet end engagement surface 54B moves transversely with respect to the magazine axis 34 for imparting axial movement to the cartridge C. As the cartridge C moves axially in the mouth end of the magazine M, the bullet end of the cartridge moves to a position in which the bullet end is inboard of the front wall FW of the magazine, as shown in FIGS. 18-20. Accordingly, the cartridge driver 24 fully seats the cartridge C in the mouth end of the magazine M. It will be appreciated the cartridge driver 24 moves the cartridge C in a first direction for introducing the cartridge into the mouth end of the magazine M and then in a second direction nonparallel to the first direction for fully seating the cartridge in the mouth end of the magazine.

The plunger 52 is configured for facilitating the removal of the head 54 from the mouth end of the magazine M without undesirably withdrawing the newly loaded cartridge C from the magazine. As shown by comparison of FIGS. 19 and 20, the slide 56 includes recessed portions at upper ends thereof for permitting the head 54 (cartridge side engagement surface 54A) to pivot away from the mouth end of the magazine M. The force of the spring 36F on the cartridge C can force the cartridge into engagement with undersides of the lips L of the mouth end, and the spring force, via the cartridge, can cause the head 54 to pivot away from the mouth end of the magazine M. The head 54 adjacent the cartridge side engagement surface 54B is sized to be narrower than the gap between the lips L of the magazine M. Accordingly, the head is permitted to pivot out of the mouth end of the magazine M without interference with the lips L. The result is the cartridge side engagement surface 54A is disengaged from the cartridge C, or engaged with the cartridge but with less force, such that there is insufficient friction between the cartridge side engagement surface and the cartridge side for causing the cartridge to move out of the mouth end of the magazine as the plunger 52 moves in the retracting stroke. As the plunger 52 moves toward the retracted position, the cartridge remains in the fully seated position, such as shown in FIG. 20, in which the cartridge is between the spring 36F and the lips L, and the bullet end is inboard of the front wall FW of the magazine M. The primer end of the cartridge C can also be in engagement with the rear wall (stop) RW of the magazine. It will be understood that the fully seated position of the cartridge C in the mouth end of the magazine M permits a subsequent cartridge to be loaded in the mouth end of the magazine, with the seated cartridge having sufficient clearance with respect to the magazine front wall FW to move against the bias of the spring S as the subsequent cartridge is loaded according to the steps described above.

Other types or configurations of cartridge drivers can be used without departing from the scope of the present invention. For example, the cartridge side engagement surface and bullet end engagement surface can be movable with respect to each other (e.g., provided on different followers), there can be fewer or more followers (e.g., one, three, four, etc.), and/or the plunger can be integrally formed with the lever (e.g., not have a pivot connection therewith).

Figure 5:
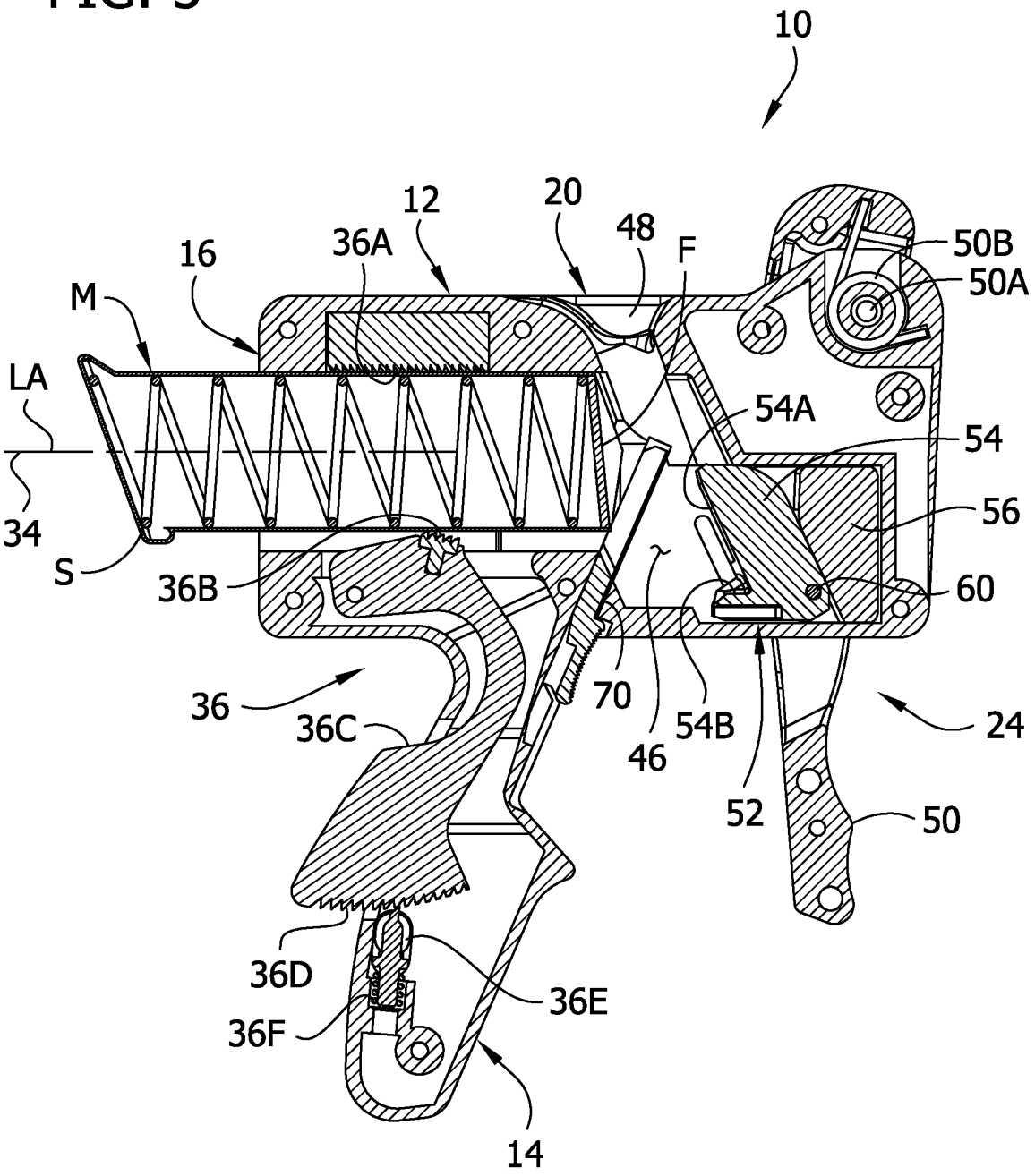
FIG. 5 is a section similar to FIG. 4 but showing the magazine in a magazine well of the loader.
Figure 6:
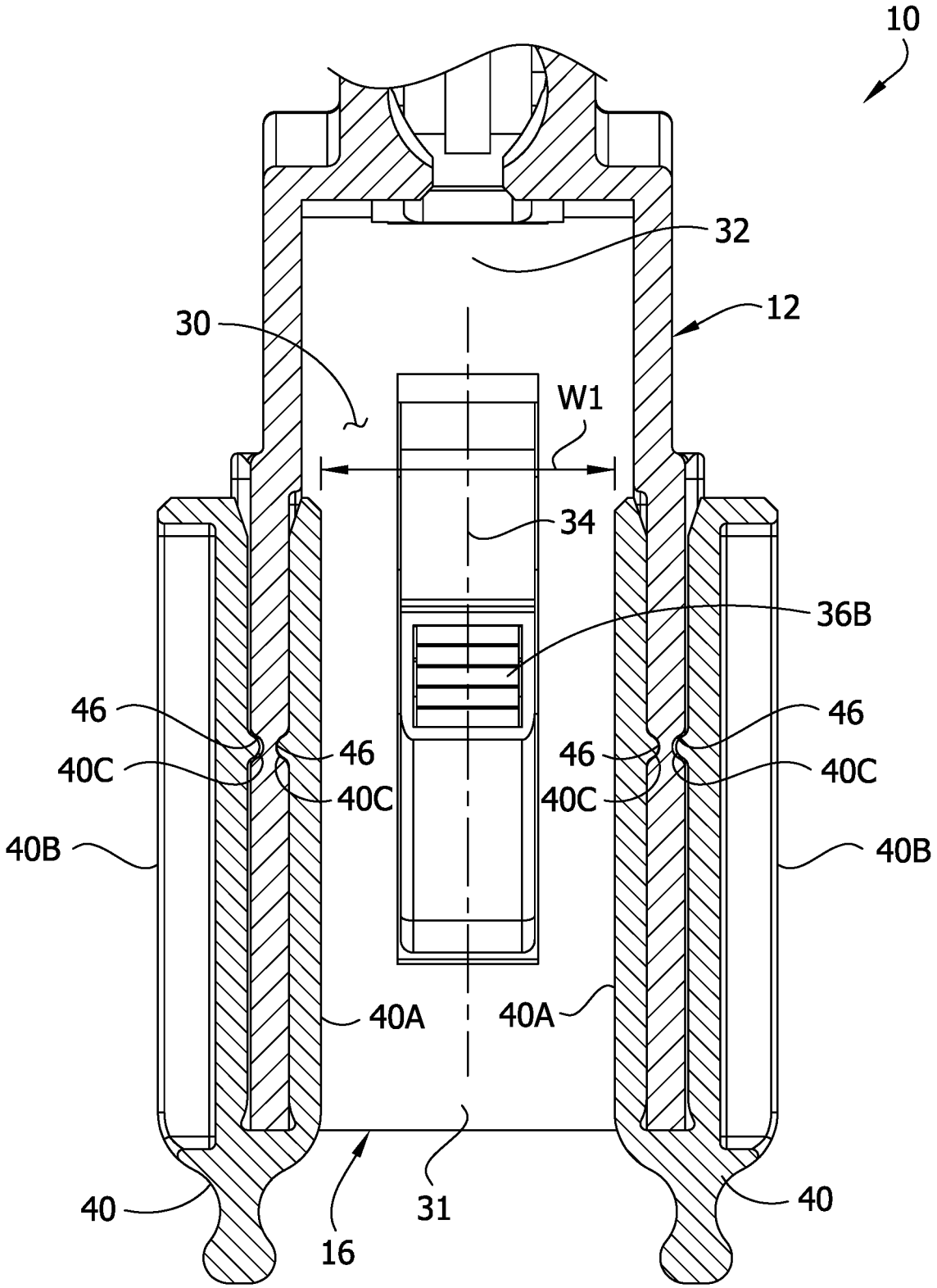
FIG. 6 is a fragmentary section of the magazine loader taken in the plane including line 6-6 shown in FIG. 1.
Figure 14:
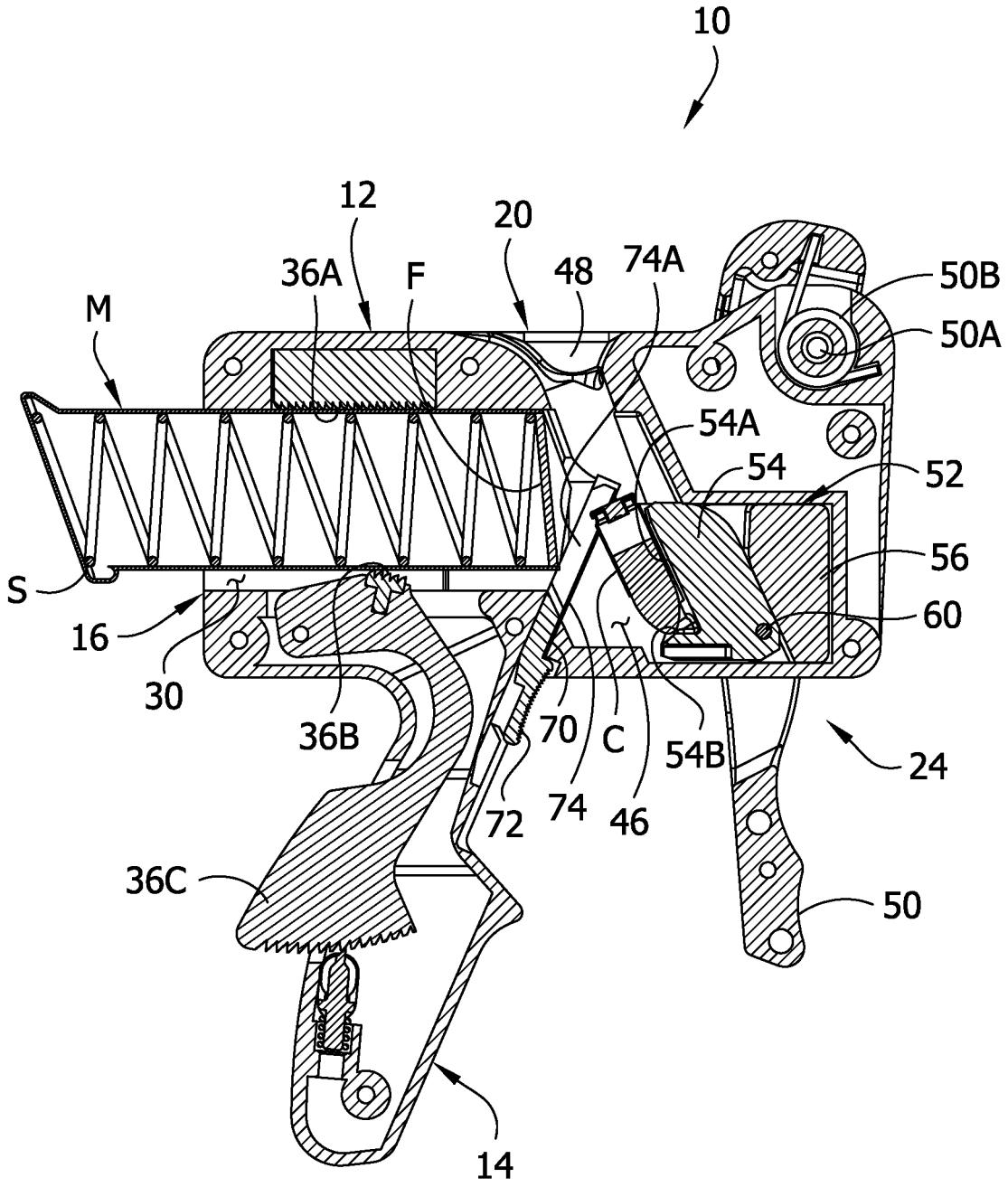
FIG. 14 is a section of the loader similar to the section of FIG. 5 but showing a cartridge in the loader ready to be loaded into the magazine.
Figure 15:
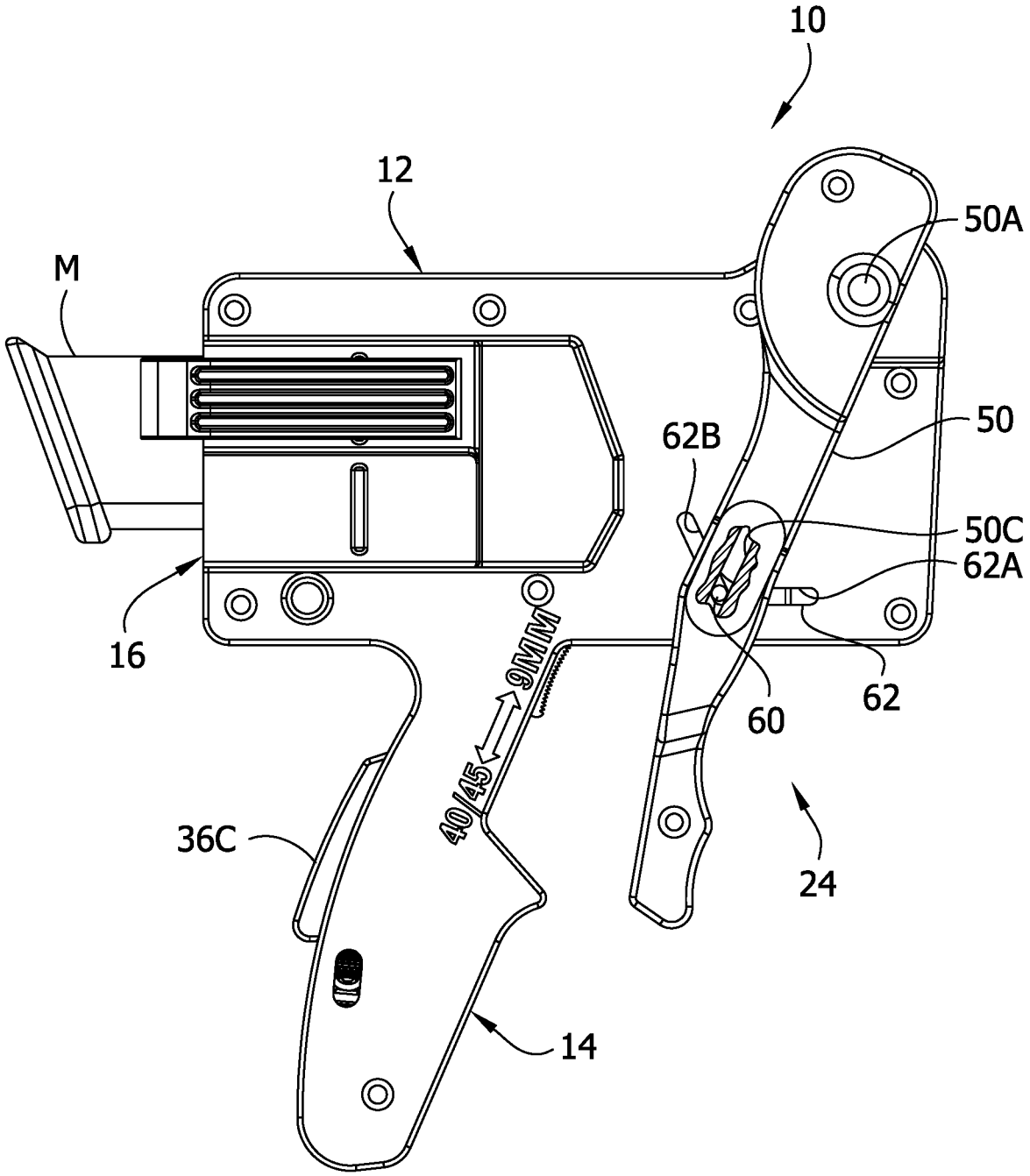
FIG. 15 is a side elevation of the loader showing the actuator in a partially actuated position and having a portion broken away to show the pin connection.
Figure 21:
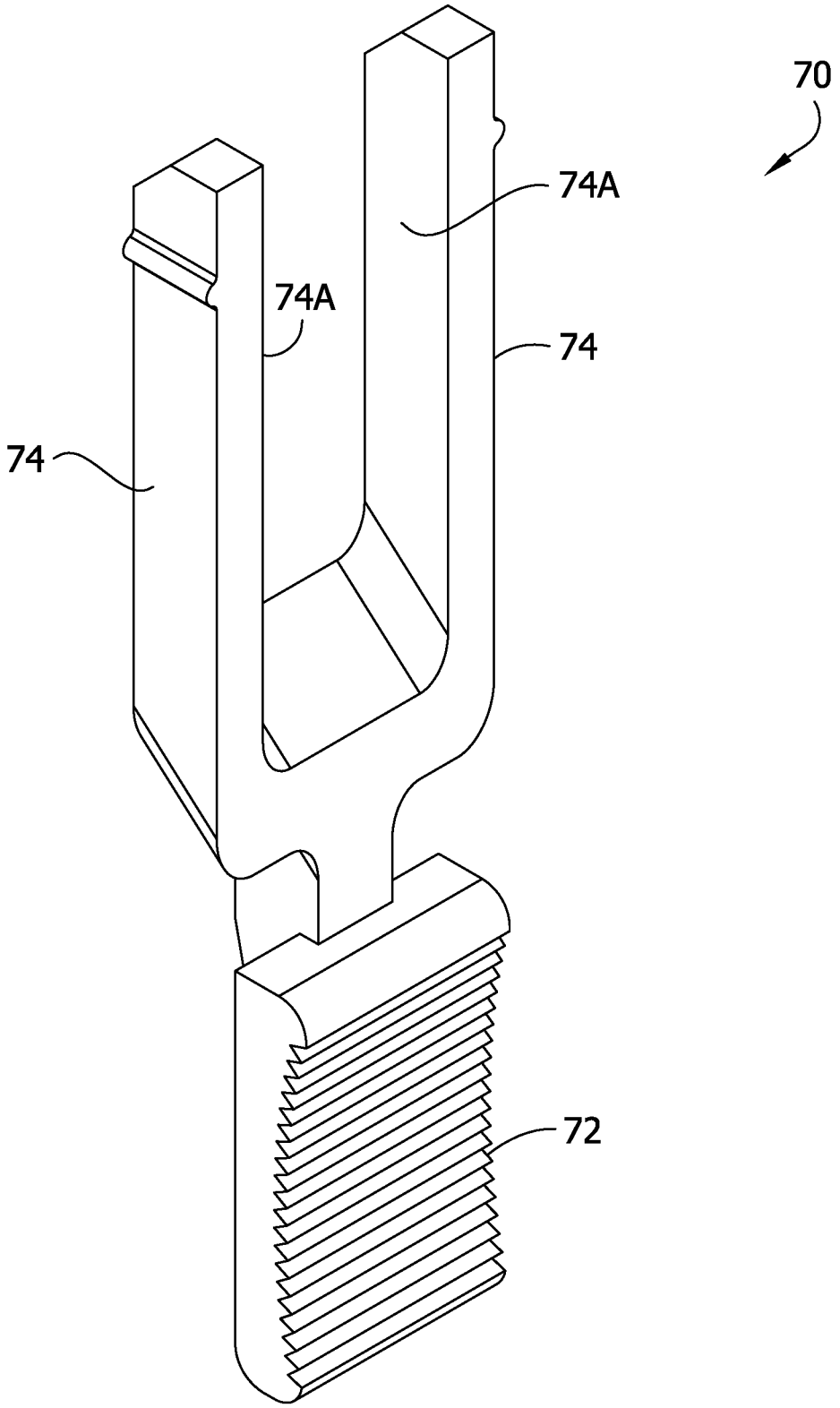
FIG. 21 is an enlarged perspective of an aligner of the magazine loader.
Figure 22:
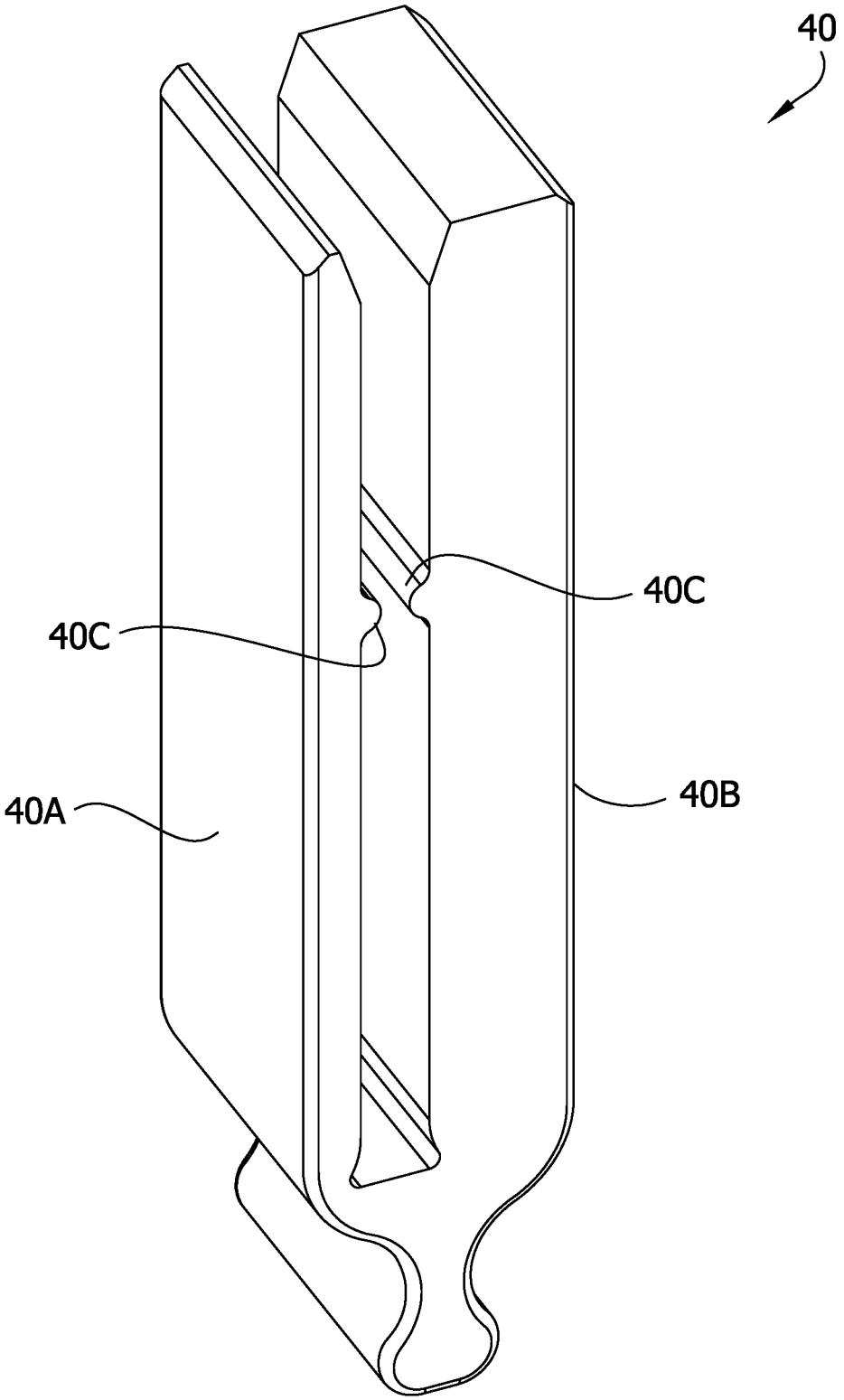
FIG. 22 is an enlarged perspective of one of the reducers of the magazine loader.
Figure 23:
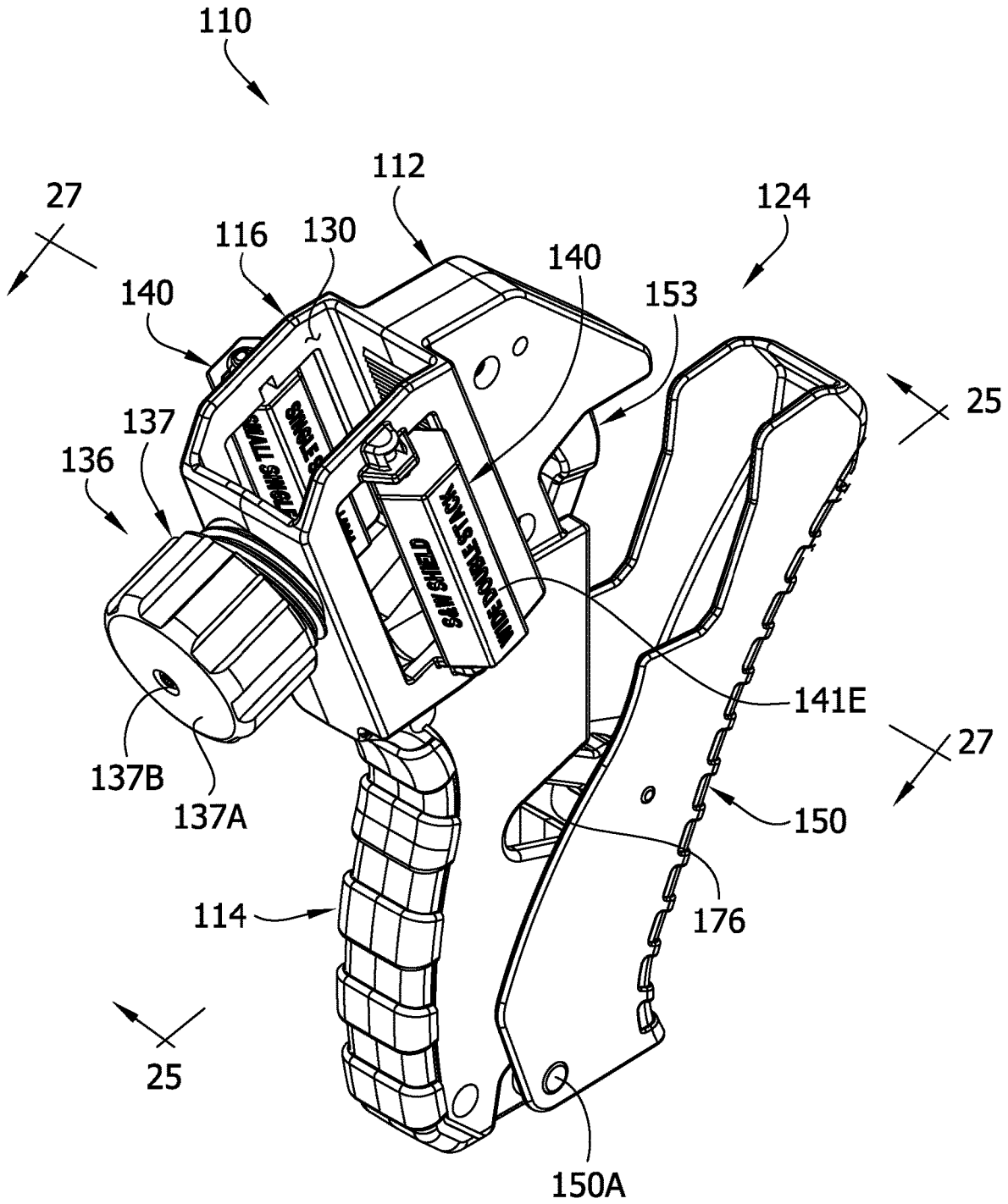
FIG. 23 is a rear perspective of a second embodiment of a magazine loader embodying aspects of the present invention.
Figure 24:
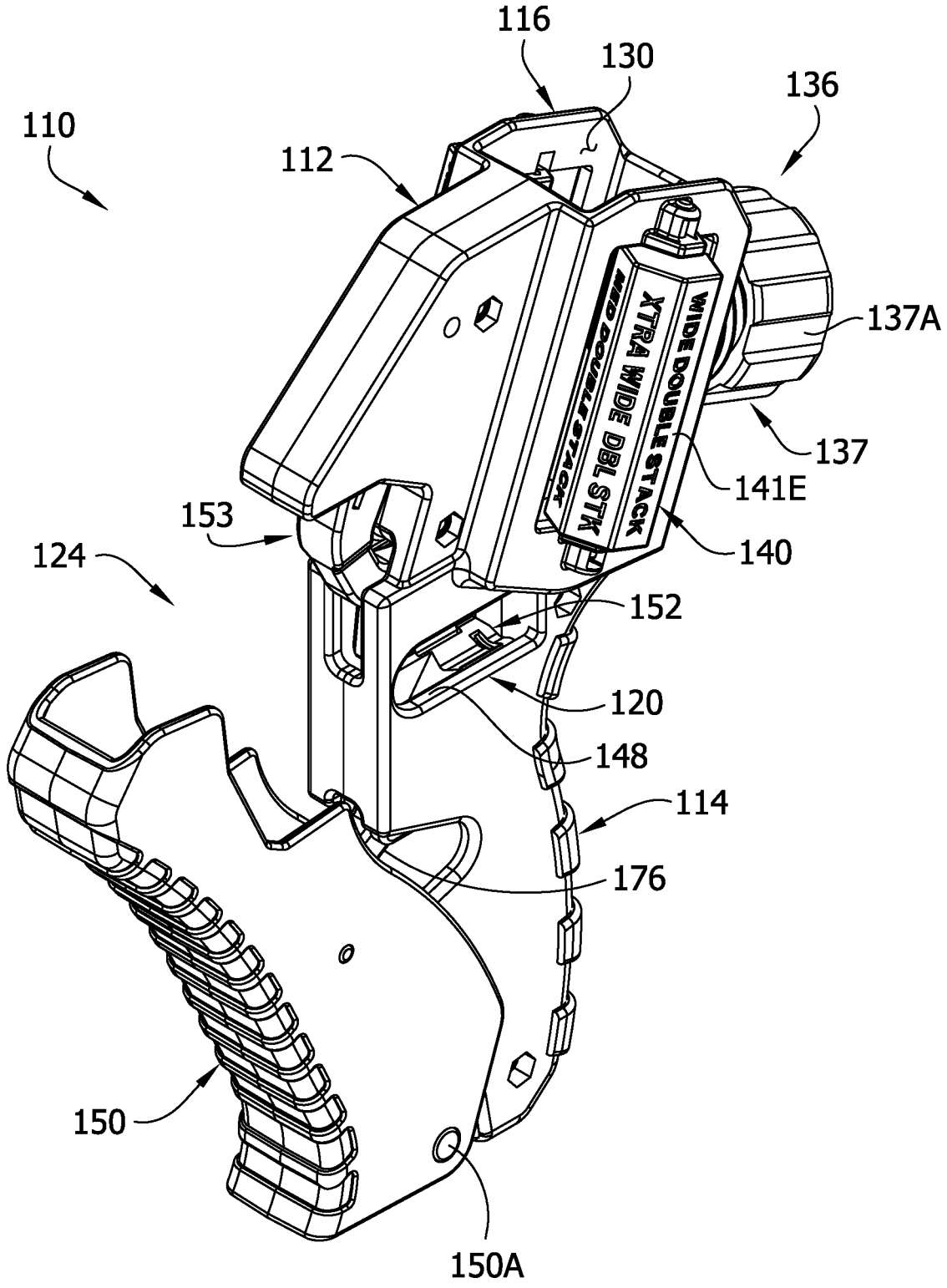
FIG. 24 is a front perspective of the magazine loader of FIG. 23.

Referring to FIGS. 5, 14, and 21, in the illustrated embodiment, the loader 10 includes an aligner 70 for aligning cartridges with the mouth end of the magazine M. As explained above, the handgun magazine loader 10 is universal in the sense of permitting multiple types of cartridges to be loaded into various types of handgun magazines. The aligner 70 assists in accommodating cartridges of different calibers by properly aligning cartridges with the mouth end of the handgun magazine to be loaded therein. In the illustrated embodiment, the aligner 70 has an operative position (e.g., FIG. 14) and a non-operative position (not shown). The aligner 70 is in the operative position in the illustrated example because the cartridge being loaded is a 9 mm caliber cartridge C having a relatively small diameter. If the aligner 70 were not used, the primer end of the cartridge C may not be in alignment with the cartridge opening of the mouth end of the magazine M in the plunging stroke, causing the cartridge to jam without entering the magazine. Referring to FIG. 21, the aligner 70 comprises a fork including an actuator 72 and two legs 74 extending upward therefrom. The legs 74 have opposing inward facing alignment surfaces 74A spaced from each other sufficiently for receiving the cartridge C therebetween, and positioned sufficiently close to each other to align the cartridge with respect to the mouth end of the magazine M. If the loader 10 is used for loading larger caliber cartridges (e.g., .40 or .45 caliber cartridges), the aligner 70 is moved to its non-operative position. As shown by an indicator on the right side of the handle (see FIG. 1), the aligner 70 is slidable (using the actuator 72 on the front side of the handle 14) downward to move the aligner to the non-operative position. This brings the legs 74 out of register with the mouth end of the magazine M, so a cartridge moved by the cartridge driver 24 passes above instead of between the alignment surfaces 74A. The side walls of the cartridge receiver 20 are desirably constructed to align larger diameter cartridges with the mouth end of the magazine M. Other types or configurations of aligners can be used without departing from the scope of the present invention. Referring to FIGS. 23 and 24, a second embodiment of a handgun magazine loader embodying aspects of the present invention is designated generally by the reference number 110. The loader is configured for loading several rounds of ammunition, also referred to as cartridges, into a handgun magazine M in a relatively short time period. The loader 110 reduces hand fatigue associated with loading the magazine M. As will become apparent, in the illustrated embodiment, the loader 110 is a universal handgun magazine loader in that the loader can be used to load a plurality of types of cartridges (e.g., ranging from 9 mm to .45 caliber) into a plurality of types of handgun magazines, including "single stack" and "double stack" magazines, for various types of handguns.

As shown in FIGS. 23 and 24, the loader 110 includes a main body 112 and a handle 114 in the form of a pistol grip extending downward from a lower end of the main body. The loader 110 includes a magazine receiver 116 on a rear side of the main body 112. The loader 110 also includes a cartridge receiver 120 in the main body 112 opening out a side of the main body. A cartridge driver 124 is provided for moving cartridges from the cartridge receiver 120 into the magazine receiver 116. As will become apparent, a user can hold the loader 110 by the handle 114, insert the magazine M into the magazine receiver 116, and repeatedly load a cartridge into the cartridge receiver 120 and actuate the cartridge driver 124 to place a plurality of cartridges in the handgun magazine. The various parts of the loader 110 can be made of any suitable material, such as molded plastic and/or metal.

Use of the loader 110 is described and illustrated herein with the double stack magazine M and the 9 mm cartridge C described in detail above with respect to FIG. 3. It will be understood other types of cartridges (e.g., other calibers) and magazines (e.g., single stack and/or for holding other calibers, etc.) can be used without departing from the scope of the present invention.

Figure 25:
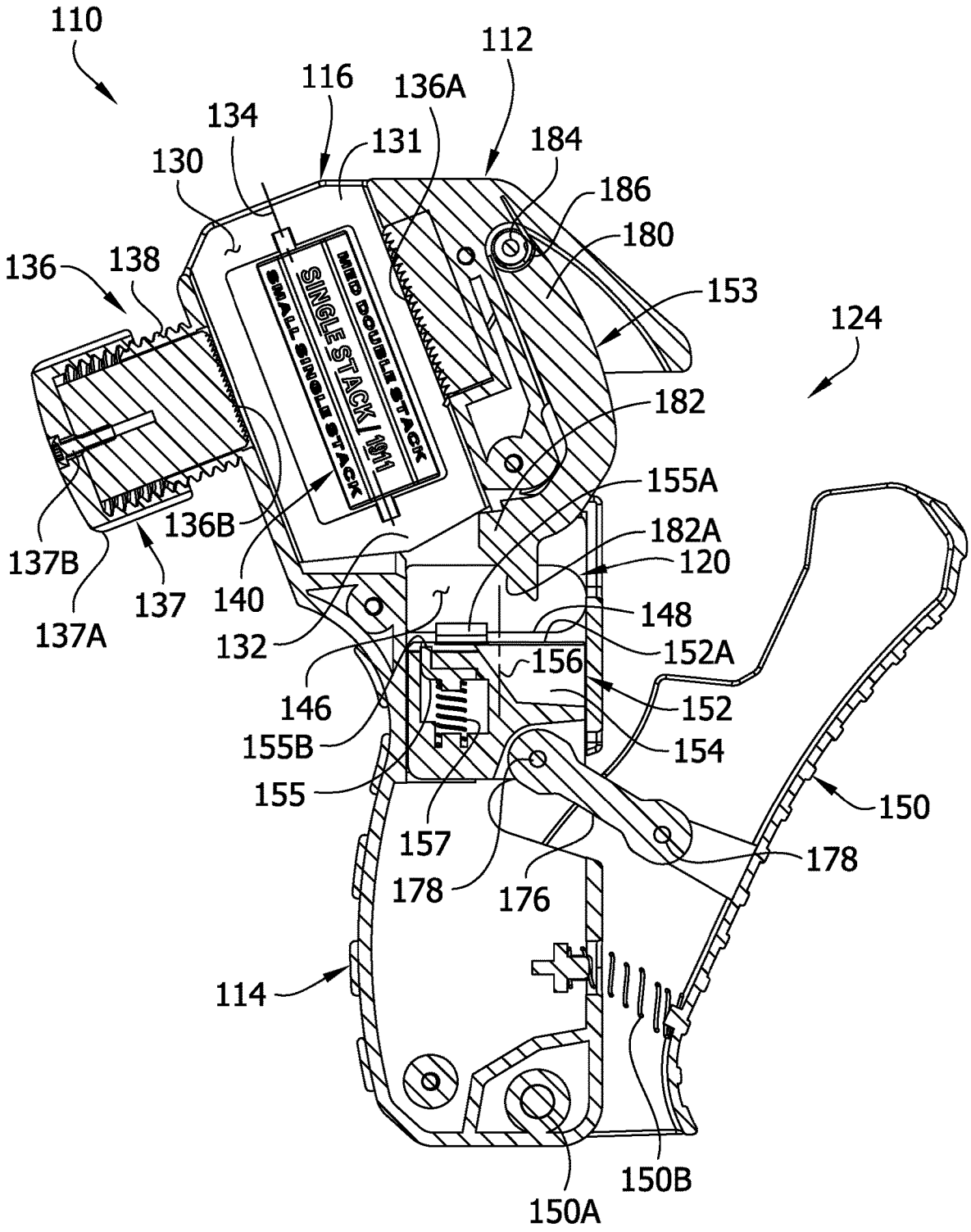
FIG. 25 is a section of the loader taken in the plane including line 25-25 shown in FIG. 23.
Figure 26:
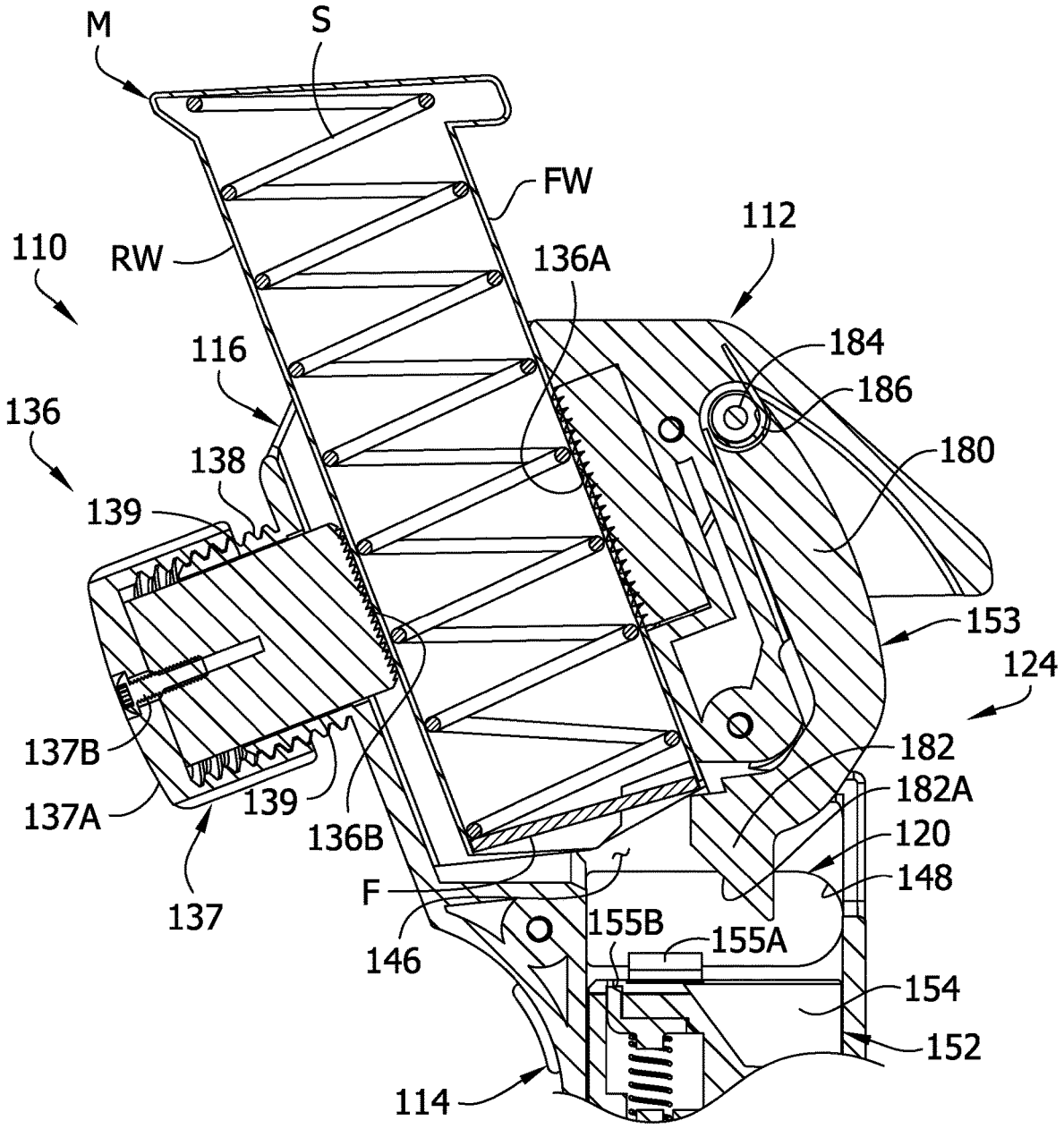
FIG. 26 is a fragmentary section of the loader similar to FIG. 25 but showing the magazine in a magazine well of the loader.

Referring now to FIG. 25, the magazine receiver 116 is shown in closer detail. The magazine receiver 116 includes a magazine well 130 for receiving the handgun magazine. The magazine well 130 extends from an outer (upper) end 131 to an inner (lower) end 132. When the magazine M is received in the magazine well 130, the mouth end of the magazine is in the inner end 132, and the cartridge opening of the magazine faces downward and to the right, as viewed in FIG. 26. The inner end 132 opens to the cartridge receiver 120 for receiving cartridges therefrom. As shown in FIG. 25, the magazine well 130 has a magazine well axis 134 (e.g., longitudinal axis) along which the longitudinal axis LA of the magazine M extends when received therein. In the illustrated embodiment, the magazine M is inserted in the magazine well 130 along the magazine well axis 134. Other types or configurations of magazine wells can be used without departing from the scope of the present invention.

The magazine receiver 120 includes a magazine retainer 136 for releasably retaining the magazine in the magazine well. In the illustrated embodiment, the magazine retainer 136 includes a clamp having opposing first and second clamp members 136A, 136B. The magazine retainer 136 has a non-retaining position (e.g., FIG. 25) in which the clamp is open and not clamped on a magazine, and a retaining position (e.g., FIG. 26) in which the clamp is clamped on the magazine M for retaining it in the magazine well 30. For example, the clamp members can be rubber pads 136A, 136B configured for frictionally gripping the front and rear walls FW, RW of the magazine M. The first clamp member 136A is mounted on a wall of the magazine receiver 130 and is stationary. The second clamp member 136B is part of a press 137. The press includes a knob 137A, the clamp member 136B, and a connector 137B (e.g., pin, screw, bolt, etc.) connecting the knob to the clamp member. The press 137 is operatively connected to the magazine receiver 116 by threaded connection of the knob 137A with a collar 138 on the magazine receiver. The clamp member 136B is movable in the collar 138 for engaging and disengaging the clamp member with the magazine M in the magazine receiver 124. The clamp member 136B is movable between a retracted position (e.g., FIG. 25) and an extended clamping position (e.g., FIG. 26). Rotation of the knob 137A in the clockwise direction moves the knob and clamp member 136B inward (toward the magazine well axis 134), and rotation of the knob in the counter-clockwise direction moves the knob and clamp member outward (away from the magazine well axis). The knob 137A rotates with respect to the clamp member 136B about the connector 137B, such that the clamp member moves inward and outward without rotating. The clamp member 136B has a generally cylindrical body with two guides or ribs 139 (see FIGS. 26-28) and protruding radially therefrom and extending along the length of the body. The guides 139 are received in corresponding tracks inside the collar 138 for guiding the clamp member 136B inward and outward and preventing the clamp member from rotating in the collar. The arrangement is such that rotation of the knob 137A drives the clamp member 136B into and out of clamping engagement with the magazine M without rotating the surface of the clamp member against the magazine. In the illustrated embodiment, the collar 138 has a four lead thread (four start thread) having a relatively long pitch. The multi lead thread provides substantial travel of the clamp member 136B in less rotation of the knob 137A and provides a strong holding force of the clamp member against the magazine M. Other thread configurations (e.g., one lead thread, at least two lead threads, at least three lead threads, etc.) can be used without departing from the scope of the present invention. Moreover, other types of presses and/or other types of retainers can be used without departing from the scope of the present invention.

Figure 27:
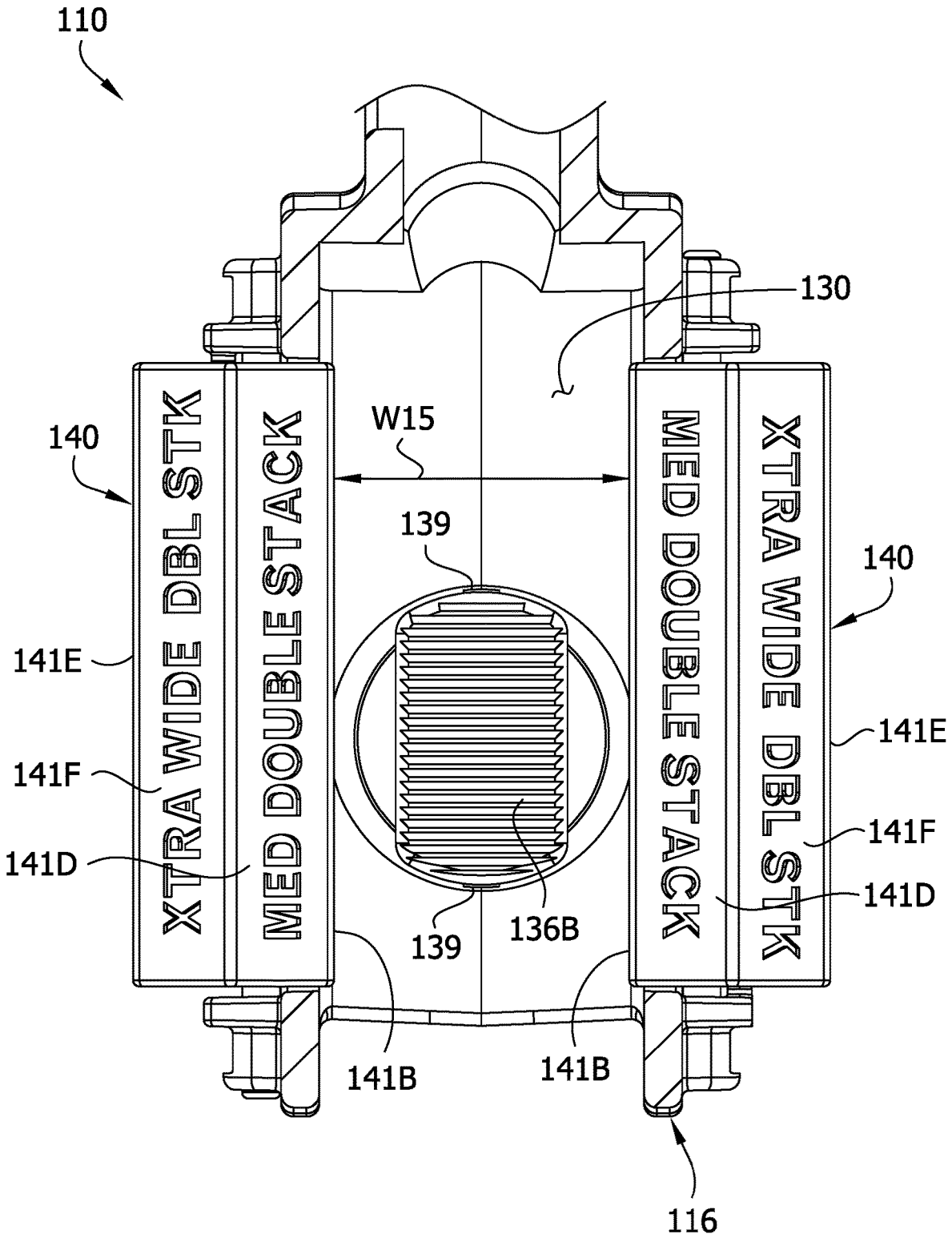
FIG. 27 is a fragmentary section of the loader taken in the plane including line 27-27 shown in FIG. 23.
Figure 28:
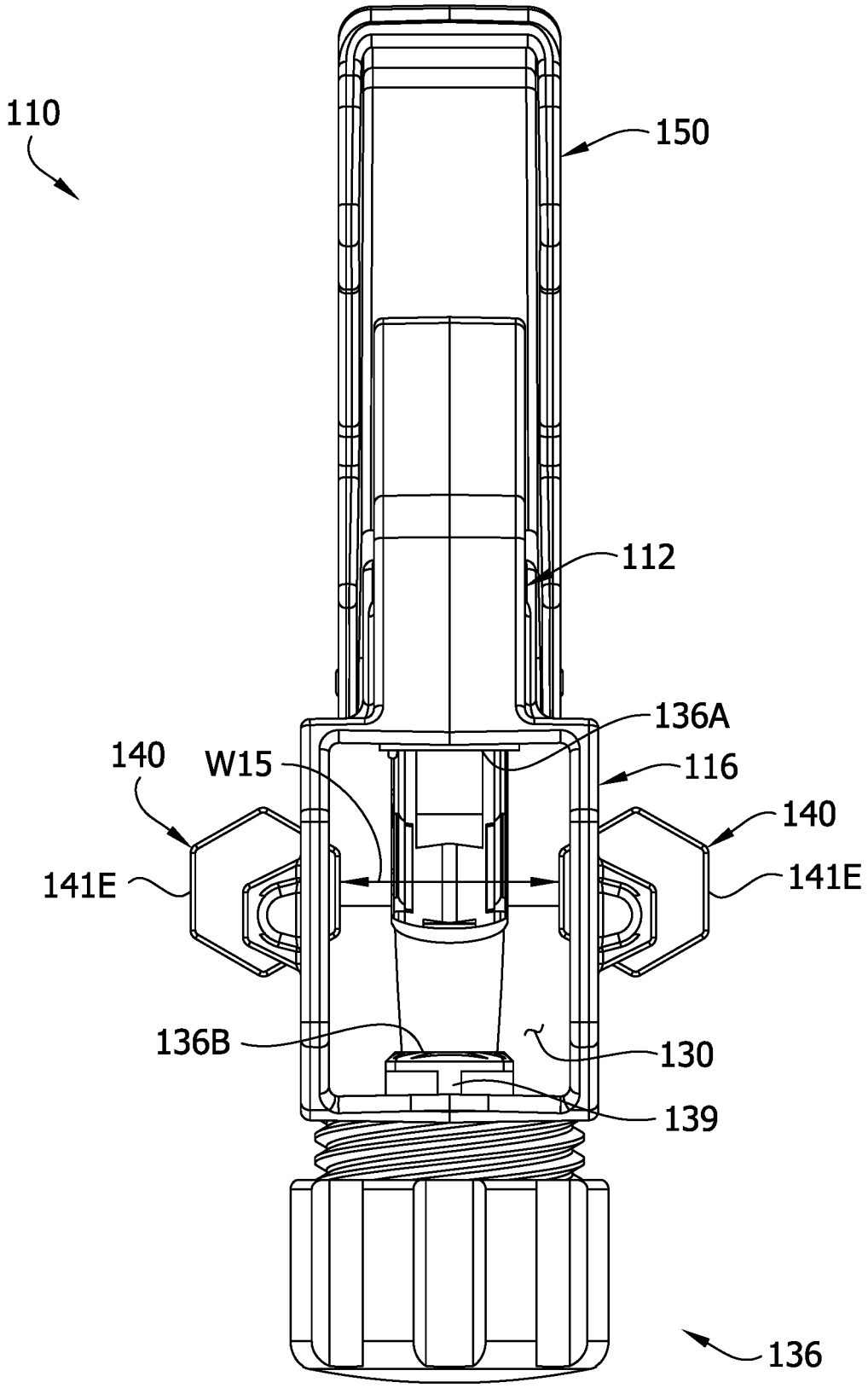
FIG. 28 is a top view of the loader.

The magazine receiver 116 includes a centering system for centering the mouth end of the magazine M for receiving cartridges from the cartridge driver 124. The magazine well 130 desirably has a sufficient width to permit handgun magazines of various widths to be inserted therein. For example, double stack magazines are usually wider than single stack magazines, and the widths of single and double stack magazines can vary based on the type of handgun and/or caliber of cartridges receivable in the magazines. As shown in FIGS. 23, 27, and 28, the centering system includes a set of reducers 140. The reducers 140 are configured for reducing the width of the magazine well 130 an amount selected to provide the magazine well with a width corresponding closely to the width of the selected magazine. The reducers 140 reduce the width of the magazine well 130 in a direction perpendicular to the direction in which the press 137 presses on the magazine M, but the reducers can reduce the width of the magazine well in the same direction in which the press presses on the magazine or in another direction without departing from the scope of the present invention.

Figure 29:
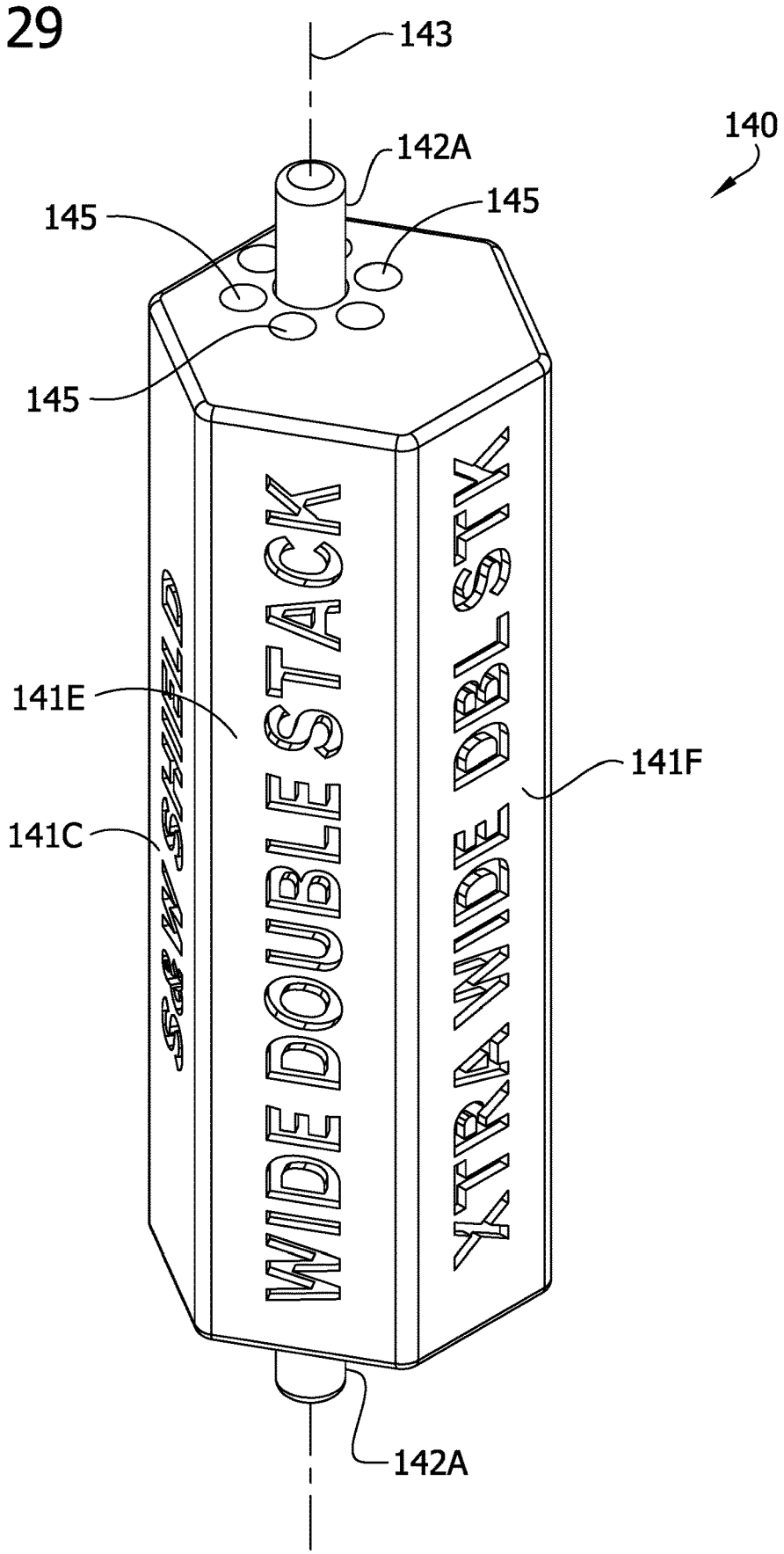
FIG. 29 is an enlarged front perspective of a reducer of the loader.
Figure 30:
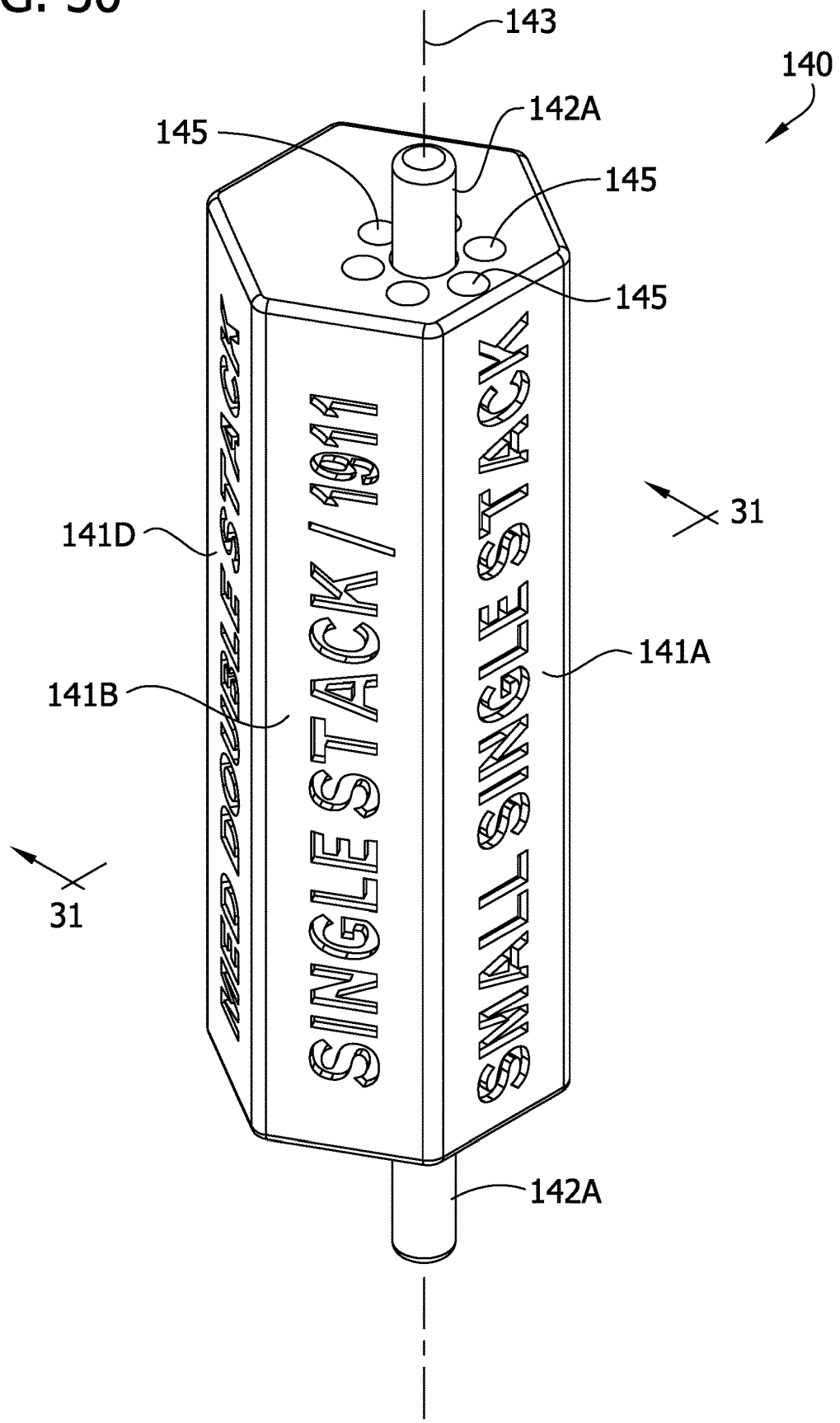
FIG. 30 is an enlarged rear perspective of the reducer.
Figure 31:
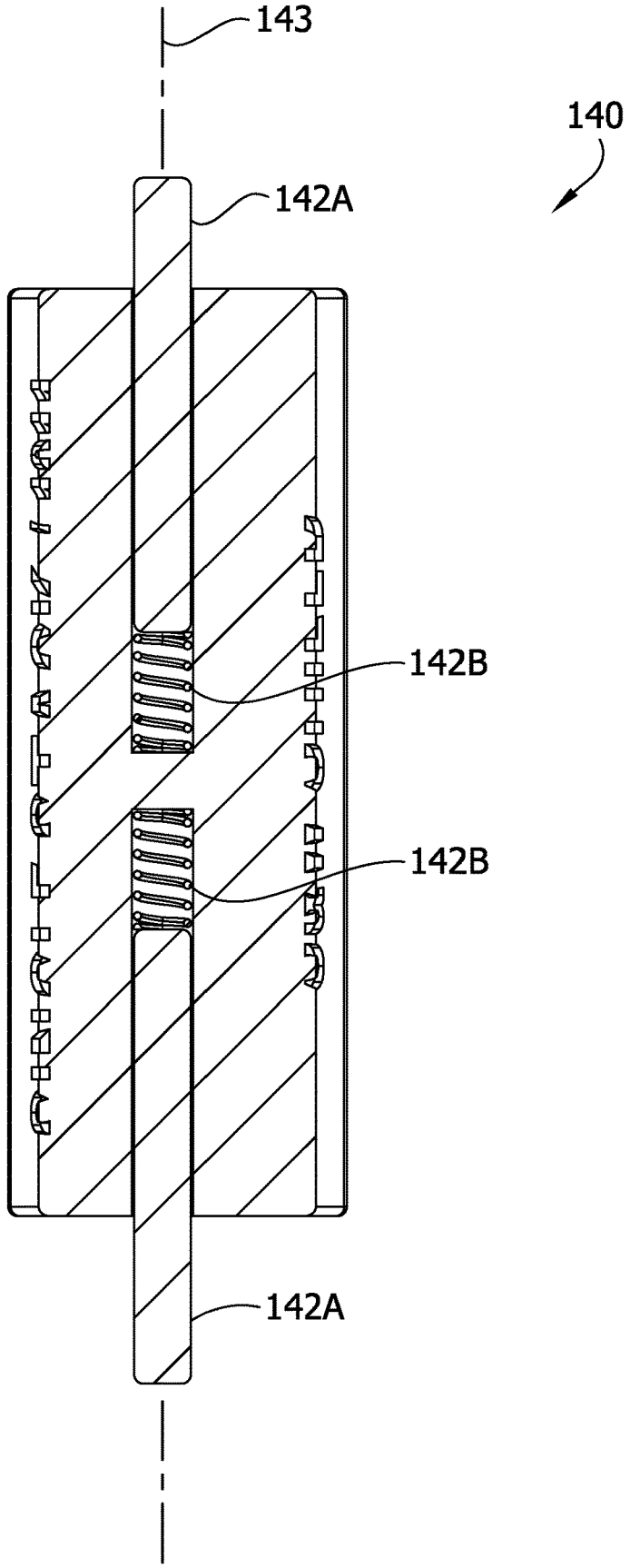
FIG. 31 is a section of the reducer taken in the plane including line 31-31 shown in FIG. 30.
Figure 33:
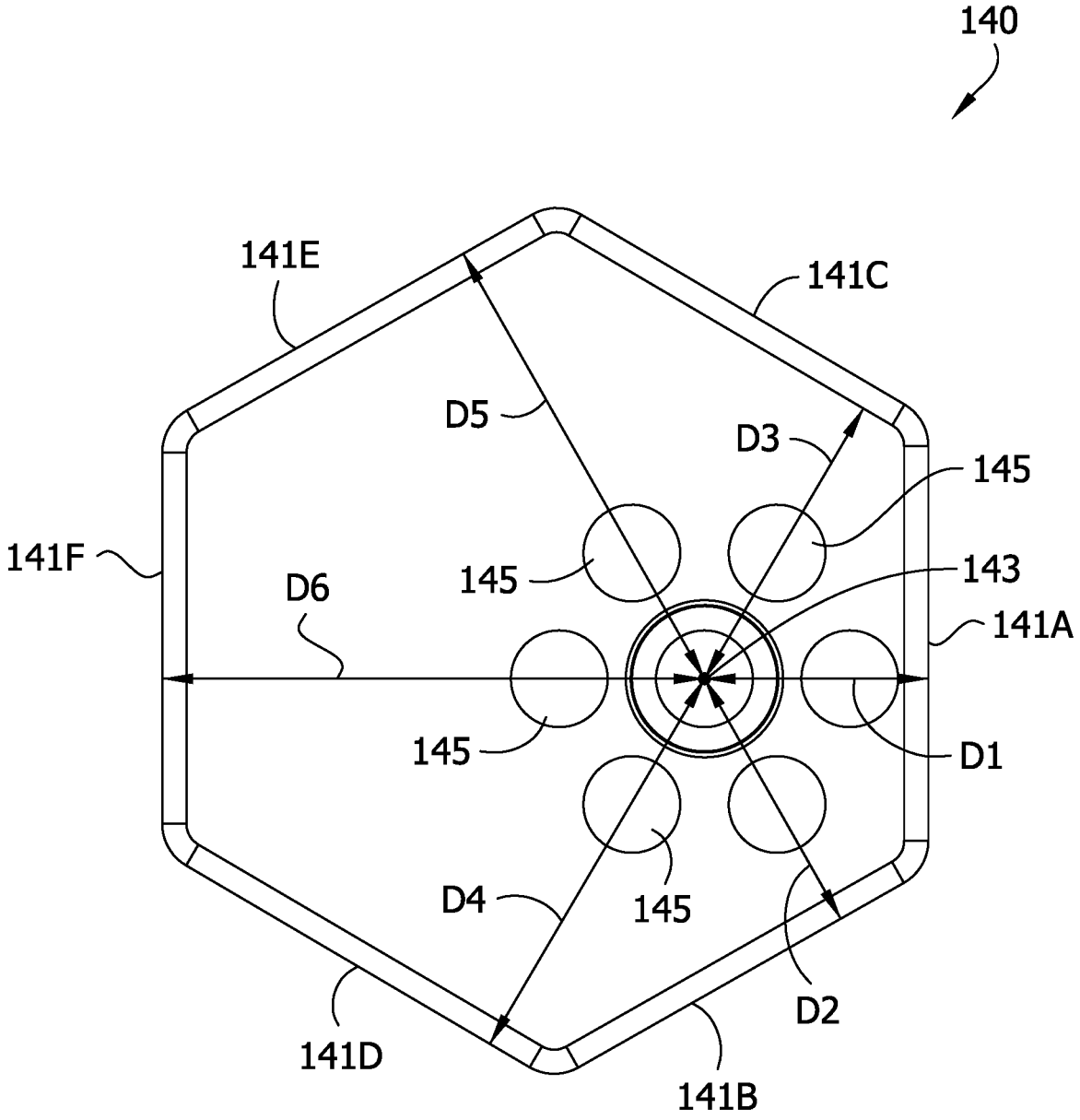
FIG. 33 is an enlarged top view of one of the reducers.

In the illustrated embodiment, two reducers 140 are provided, and the reducers are mounted on opposite left and right walls of the magazine receiver 116. The reducers 140 have pin connections with the left and right walls of the magazine receiver at upper and lower ends of the reducers. The reducers 140 have identical construction, but are mounted on the magazine receiver 116 in inverse orientations. One of the reducers 140 is shown in closer detail in FIGS. 29 and 30. The reducer 140 has a body shaped as a hexagonal prism having opposite hexagonal ends and six generally flat side faces 141A-141F extending between the opposite ends. Each of the six side faces 141A-141F corresponds to a different reduction in the width of the magazine well. The reducers 140 can be arranged in various configurations with respect to the magazine well axis 134 by rotating the reducers 140 about the pin connections. As shown in FIGS. 29-31, pins 142A biased outwardly by springs 142B extend from the upper and lower ends of the reducer 140. The pins 142A are received in sockets in the magazine receiver 116 and define an axis of rotation 143 of the reducer. The axis of rotation 134 is eccentric with respect to the side faces 141A-141F. As shown in FIG. 33, the axis of rotation 134 is spaced a different amount or distance (D1-D6) from each side face 141A-141F as measured normal to the side face. The arrangement is such that rotation of the reducer 140 about the axis of rotation 143 selectively positions the side faces 141A-141F of the reducer to face the magazine well axis 134 for reducing the width of the magazine well 130. Because of the eccentric arrangement of the axis of rotation 143, each side face 141A-141F, when positioned for reducing the width of the magazine well 130, reduces the width of the magazine well a different amount than the other side faces.

As shown in FIGS. 29 and 30, the reducer side faces 141A-141F have respective magazine type indicators (e.g., text and/or graphic indicators) indicating one or more magazine types. In the illustrated embodiment, the indicator "SMALL SINGLE STACK" is provided on the side face 141A, the indicator "SINGLE STACK/1911" is provided on the side face 141B, the indicator "S&W SHIELD" is provided on the side face 141C, the indicator "MED DOUBLE STACK" is provided on the side face 141D, the indicator "WIDE DOUBLE STACK" is provided on the side face 141E, and the indicator "XTRA WIDE DBL STK" is provided on the side face 141F. Each indicator corresponds to the magazine well width provided by arranging the side face having the indicator to face outward, away from the magazine well axis 134. In other words, the indicators correlate to the reduced width of the magazine well 130 provided when the side face opposite the indicator faces the magazine well axis 134 for reducing the width of the magazine well. In the example shown in FIGS. 23, 27, and 28, both reducers 140 are arranged to have the side face 141E with the indicator "WIDE DOUBLE STACK" facing outward to reduce the width of the magazine well 130 to closely correspond to the width of the 9 mm cartridge double stack magazine M to be received therein. The configuration of a reducer and any labelling on the reducer can be different in other, unillustrated embodiments.

Figure 32:
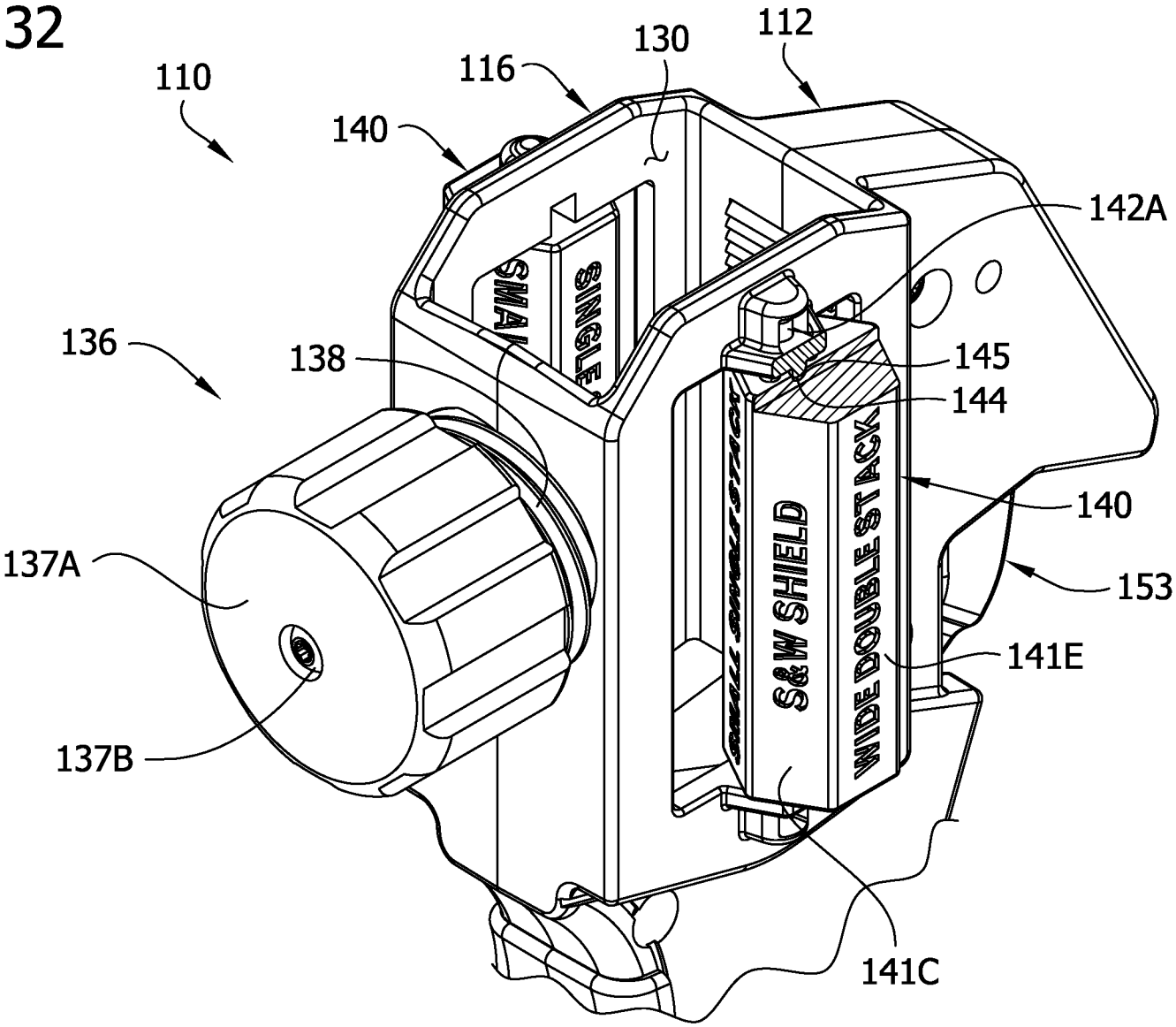
FIG. 32 is a fragmentary elevation of the loader having a portion of the reducer and a portion of the housing broken away to show details of a detent configuration.

In the illustrated embodiment, the reducers 140 are maintained in selected configurations by detents 144 (e.g., FIG. 32). Referring to FIGS. 29 and 30, the upper end of the reducer includes a plurality of detent receiving openings 145 spaced from each other and arranged in a circle pattern concentric with the axis of rotation 143. As shown in FIG. 32, a detent 144 on the magazine receiver 116 is positioned for reception in the openings 145. The spring biased pin 142A on the end of the reducer opposite the detent receiving openings 145 bottoms out in its respective socket on the magazine receiver 116 and thus biases the reducer toward the detent 144. Reception of the detent 144 in one of the openings 145 together with the spring bias tends to hold the reducer 140 in a predetermined configuration until a user applies sufficient rotational force on the reducer to dislodge the detent from the opening to rotate the reducer to a different predetermined configuration. It will be understood that the other reducer 140 is held in position by a similar detent.

Figure 34:
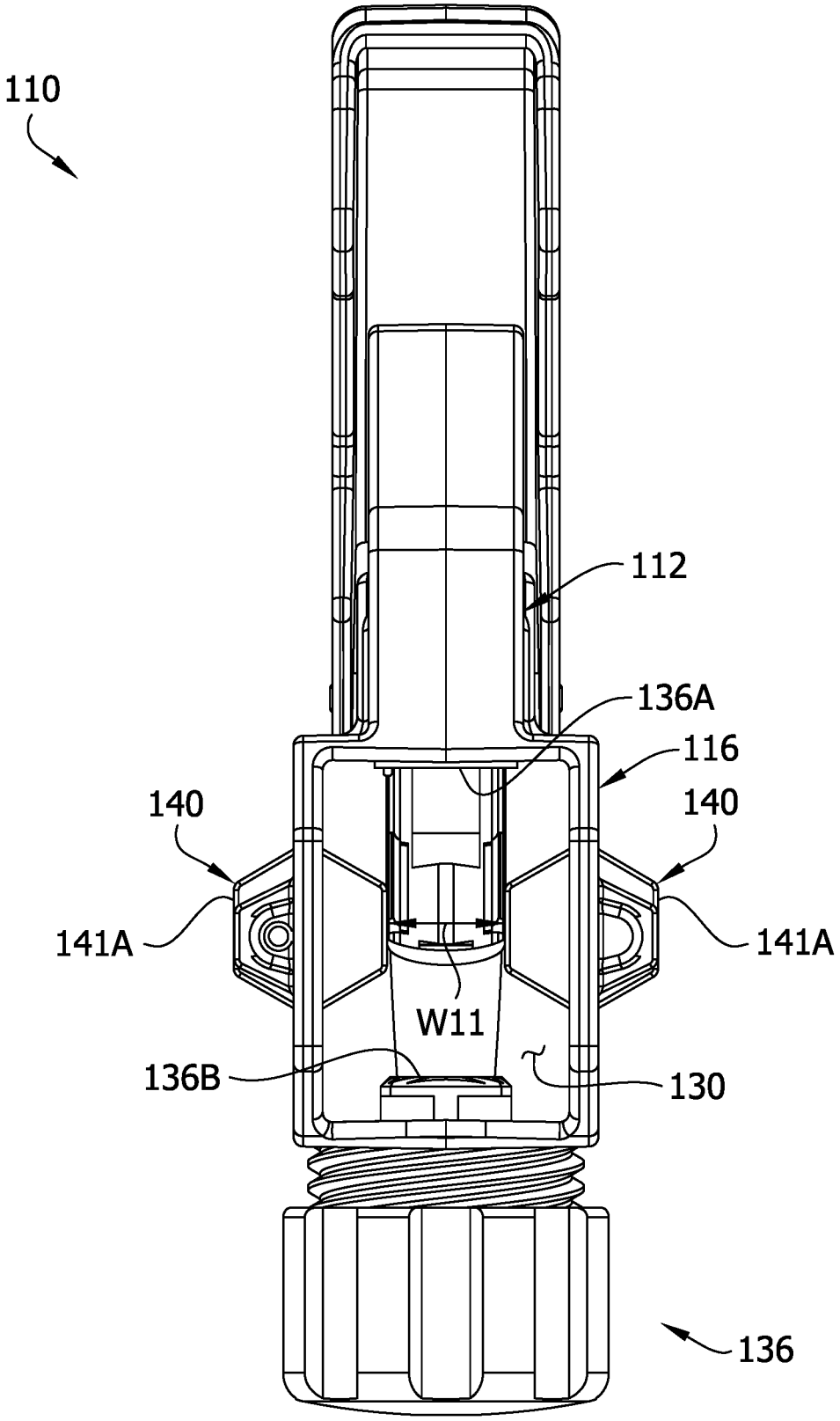
FIGS. 34-38 are a top views of the loader similar to FIG. 28 but showing the reducers configured differently for providing different magazine well widths.
Figure 35:
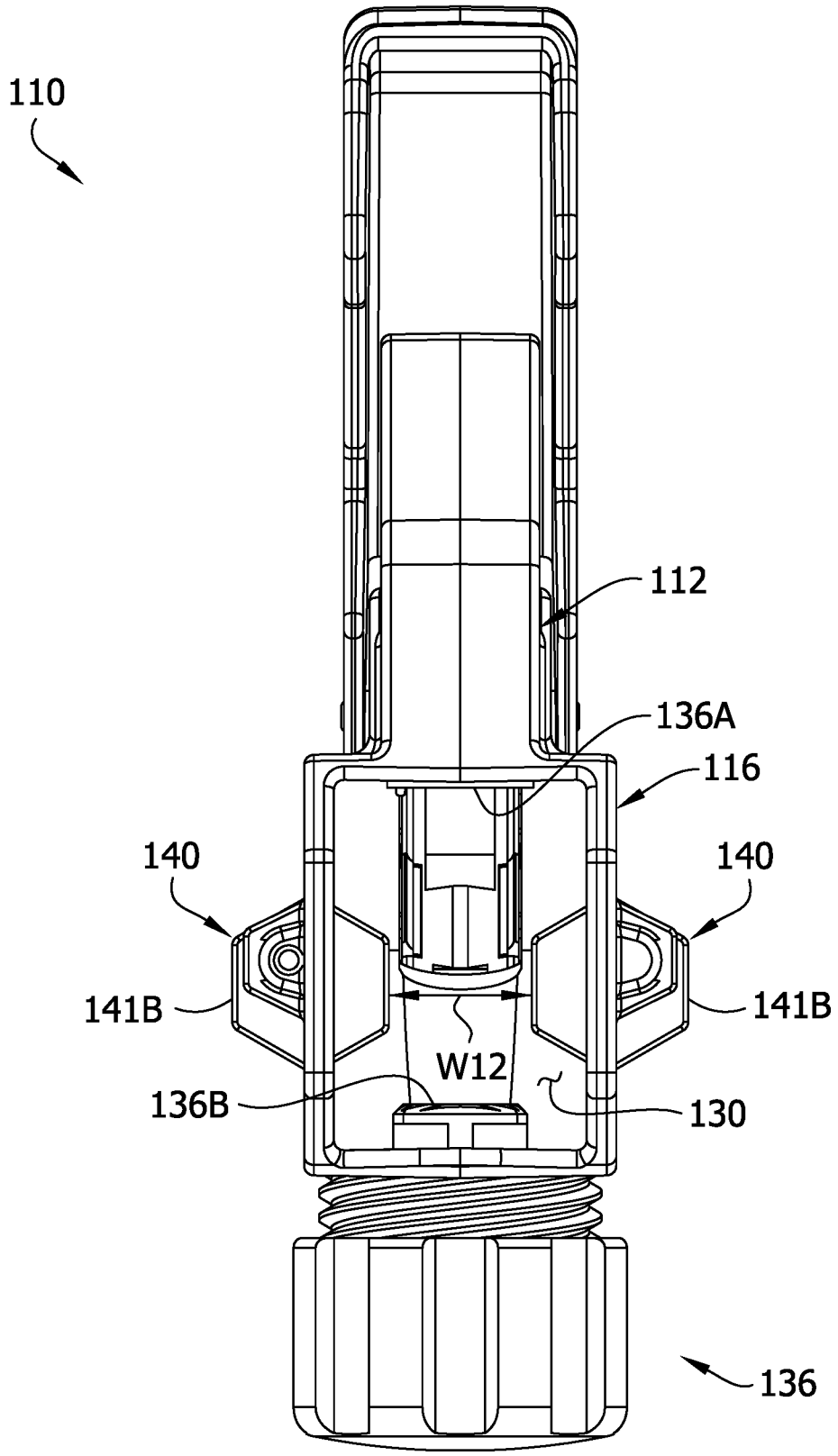
Figure 36:
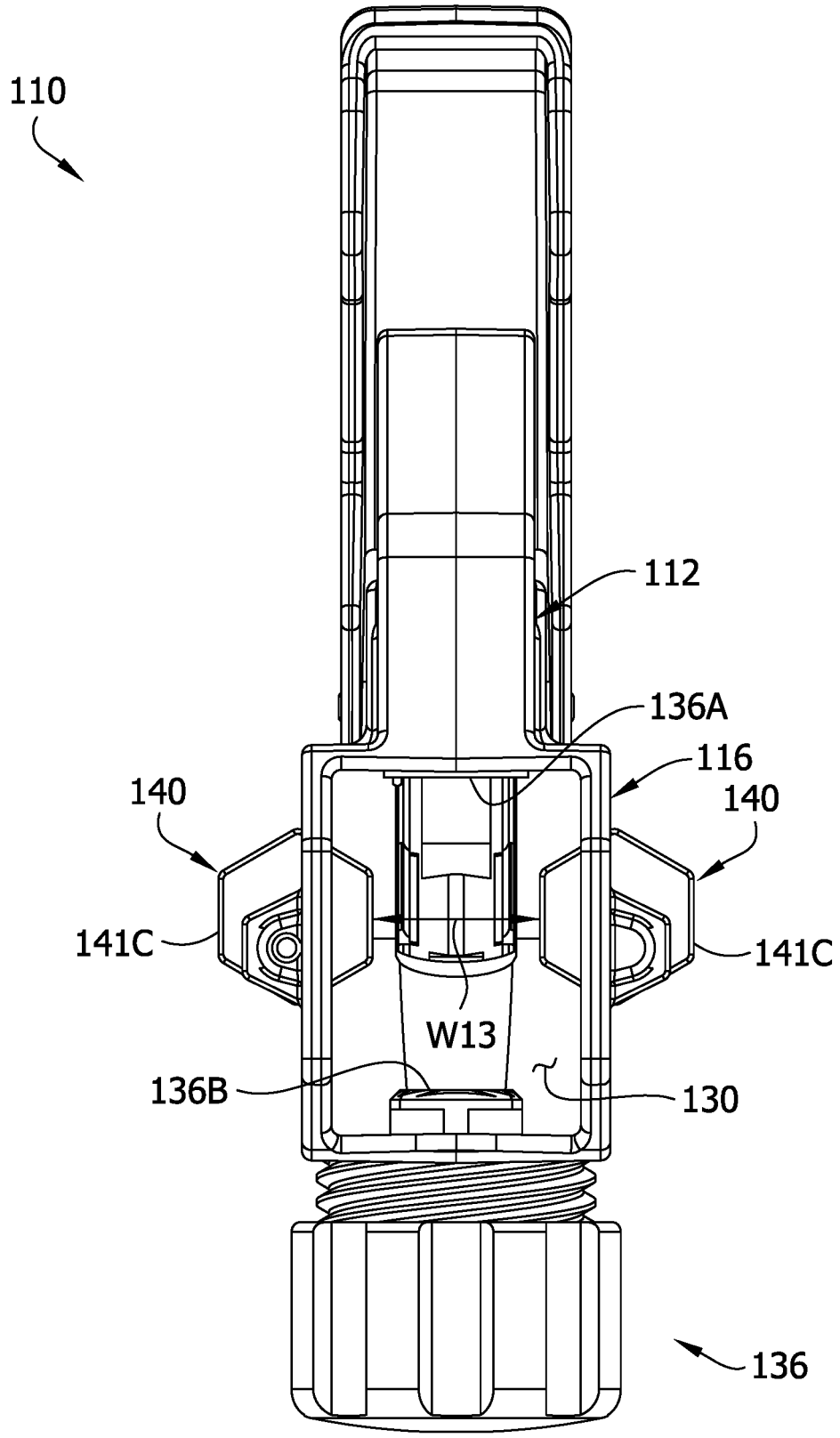
Figure 37:
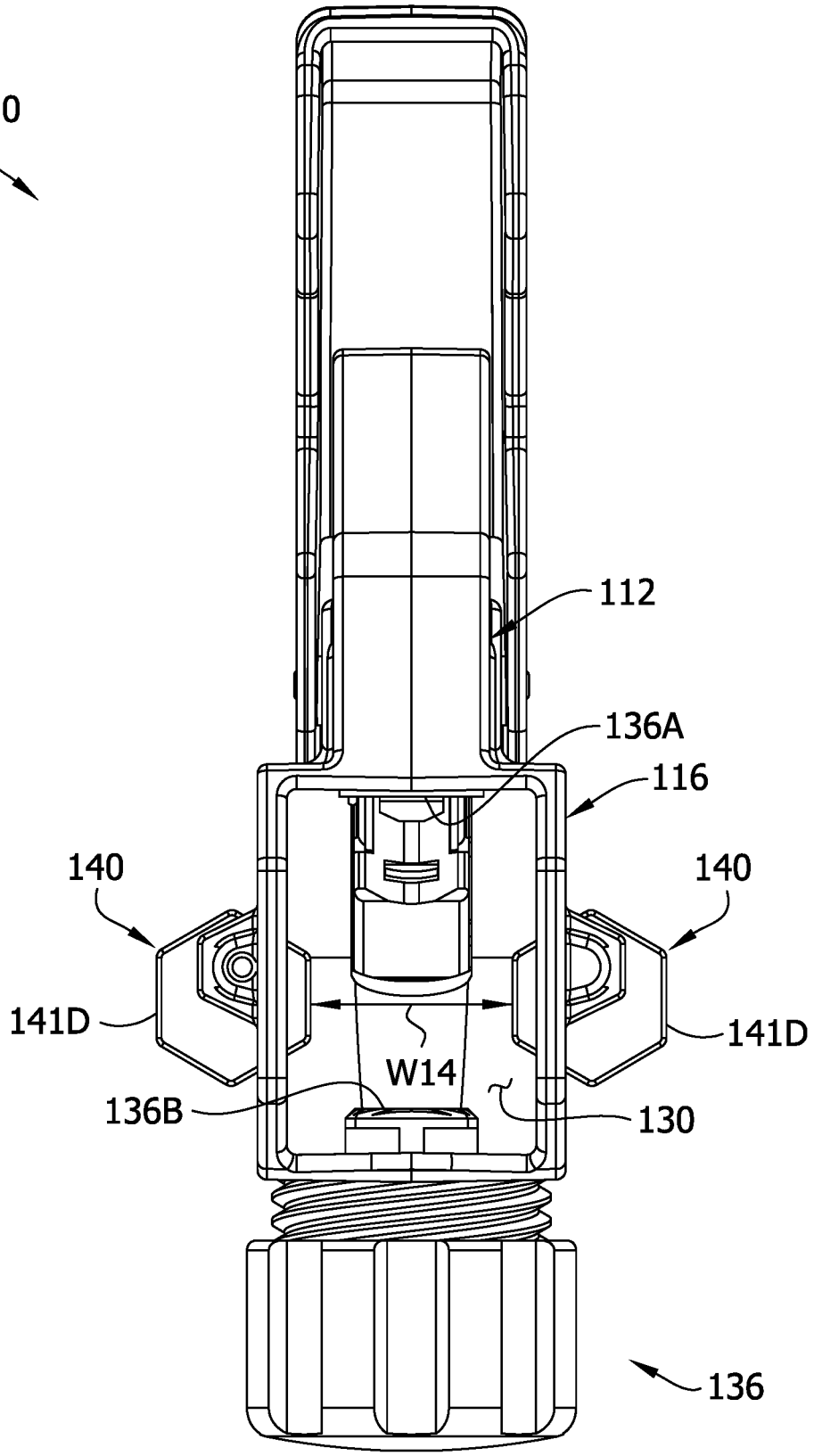
Figure 38:
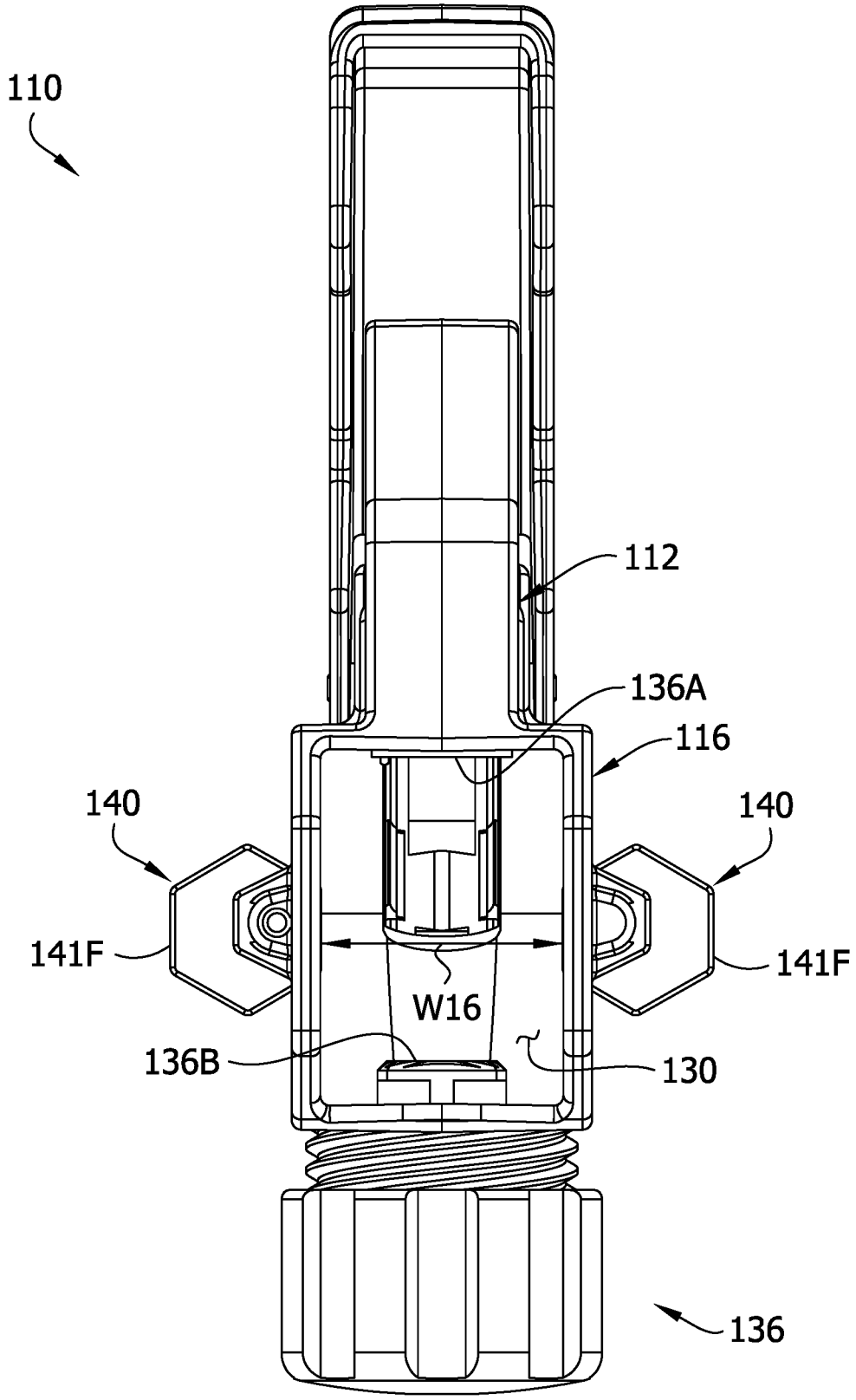

As is now apparent, the reducers 140 can be arranged in six predetermined different configurations to provide the magazine well 130 with six different reduced widths W11-W16 (FIGS. 28 and 34-38), with W11 being less than W12, W12 being less than W13, and so forth. As explained above, in the example illustrated in FIGS. 23, 27, and 28, the reducers 140 are arranged in a configuration having the side faces 141E with the indicator "WIDE DOUBLE STACK" facing outward. This configuration provides an effective width W15 corresponding to the 9 mm double stack magazine M. In FIGS. 34-38, the reducers 140 are shown arranged in other configurations for providing widths corresponding to other magazines. For example, FIG. 34 shows the reducers 140 rotated so the side faces 141A having the indicator "SMALL SINGLE STACK" face outward away from the magazine well 130 to provide an effective magazine well width W11. FIG. 35 shows the reducers 140 rotated so the side faces 141B having the indicator "SINGLE STACK/1911" face outward away from the magazine well 130 to provide an effective magazine well width W12. FIG. 36 shows the reducers 140 rotated so the side faces 141C having the indicator "S&W SHIELD" face outward away from the magazine well 130 to provide an effective magazine well width W13. FIG. 37 shows the reducers 140 rotated so the side faces 141D having the indicator "MED DOUBLE STACK" face outward away from the magazine well 130 to provide an effective magazine well width W14. FIG. 38 shows the reducers 140 rotated so the side faces 141F having the indicator "XTRA WIDE DBLE STK" face outward away from the magazine well 130 to provide an effective magazine well width W16. It will be appreciated that using the same configuration for the left and right reducers 140 reduces the magazine well width on center for centering the mouth end of the magazine M with respect to the cartridge driver 124.

Other types or configurations of magazine centering systems can be used without departing from the scope of the present invention. For example, one, two, or more reducers can be provided that have one or more side surfaces movable toward and away from the magazine well axis for configuring the reducer to change the width of the magazine well.

Now referring to FIG. 25, in the illustrated embodiment, the cartridge receiver 120 includes a cartridge passage 146 downstream from a cartridge receiving opening 148 for delivering a cartridge to the cartridge driver 124. The cartridge receiver 120 is constructed for presenting one cartridge C at a time to the cartridge driver 124. The cartridge passage 146 opens into the magazine well inner end 132. The user can pass a cartridge through the cartridge receiving opening 148 into the cartridge passage 146, actuate the cartridge driver 124, and then pass another cartridge through the cartridge receiving opening, etc. Other types and configurations of cartridge receivers can be used without departing from the scope of the present invention. For example, the cartridge receiver can include a hopper sized for holding a plurality of cartridges to be fed to the cartridge driver for being loaded into the magazine.

The cartridge driver 124 will now be described in further detail. The cartridge driver 124 is configured for driving one cartridge at a time into the magazine M. Referring now to FIGS. 23, 24, and 25, the cartridge driver 124 comprises a cartridge loading mechanism including an actuator 150, a main or primary plunger 152, and a secondary plunger 153. The actuator 150 is provided in the form of a lever having a pivot connection 150A at a proximal end of the lever with the lower end of the handle 114, and a distal end that extends upward in front of the handle. The lever 150 is selectively pivotable about the pivot connection 150A in an actuation or actuating stroke from a non-actuated position (e.g., FIGS. 23, 24, and 39) toward an actuated position (e.g., FIG. 41), and in a return stroke from the actuated position back to the non-actuated position. The lever 150 is shown in an intermediate position between the non-actuated and actuated positions in FIG. 40. A spring 150B (e.g., FIG. 25) biases the lever 150 toward the non-actuated position.

As shown in FIG. 25, the main plunger 152 is configured for moving a cartridge from the cartridge receiver 120 into the inner end 132 of the magazine receiver 116 for introducing the cartridge into the mouth end of the magazine M. The plunger 152 is positioned with respect to the actuator 50 and movable with respect to the actuator for driving the cartridge C toward the magazine well and into the magazine M responsive to movement of the actuator. In the illustrated embodiment, the main plunger 152 is a follower movable along a track in the main body and handle. The track defines a travel axis 156 (FIG. 25) of the main plunger. The main plunger 152 is movable along the travel axis 156 in a plunging stroke from a retracted position (e.g., FIGS. 25 and 39) toward a plunged position (e.g., FIG. 41), and movable in a retracting stroke from the plunged position back to the retracted position.

Figure 42:
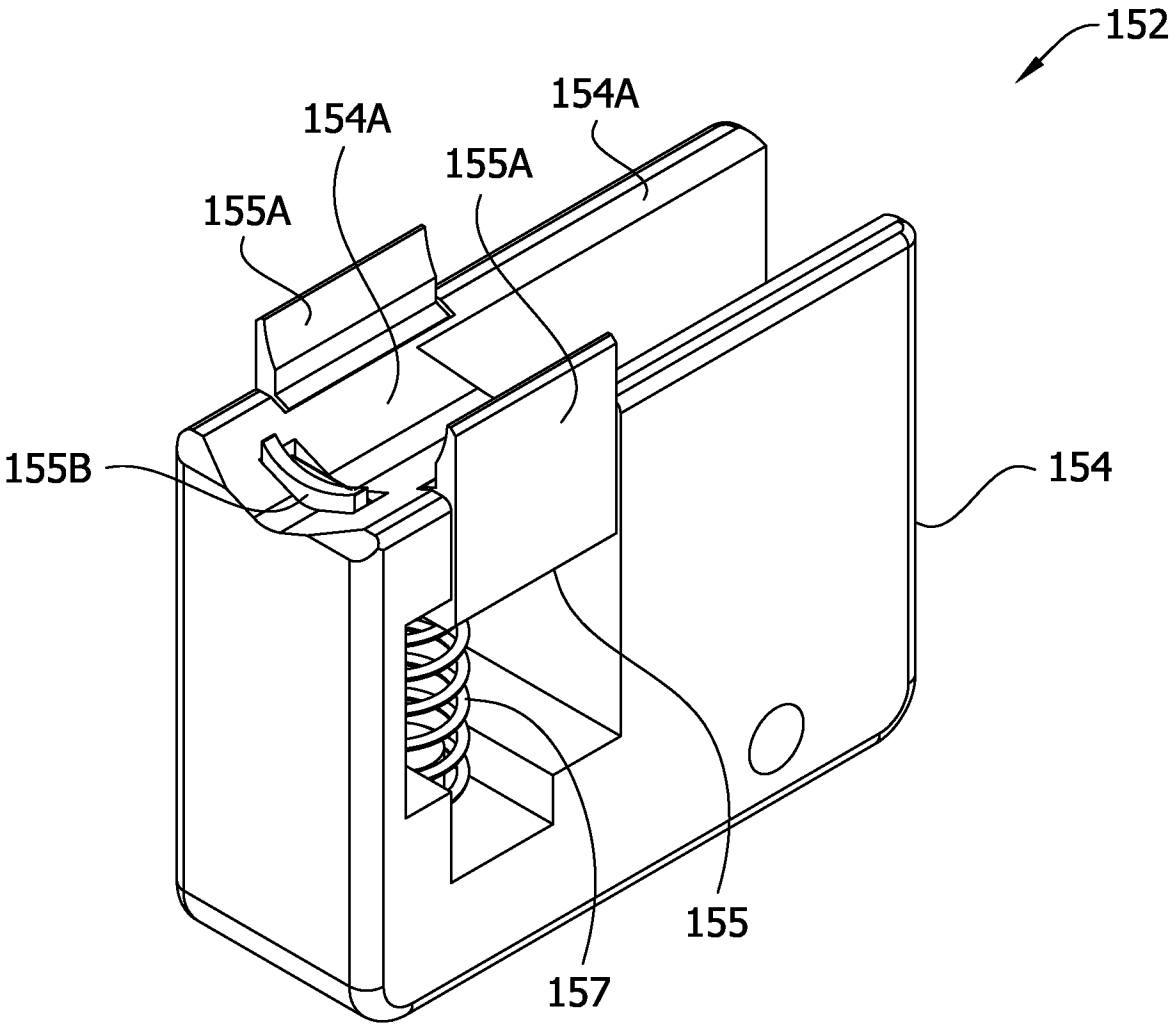
FIG. 42 is an enlarged perspective of a plunger of the loader.
Figure 43:
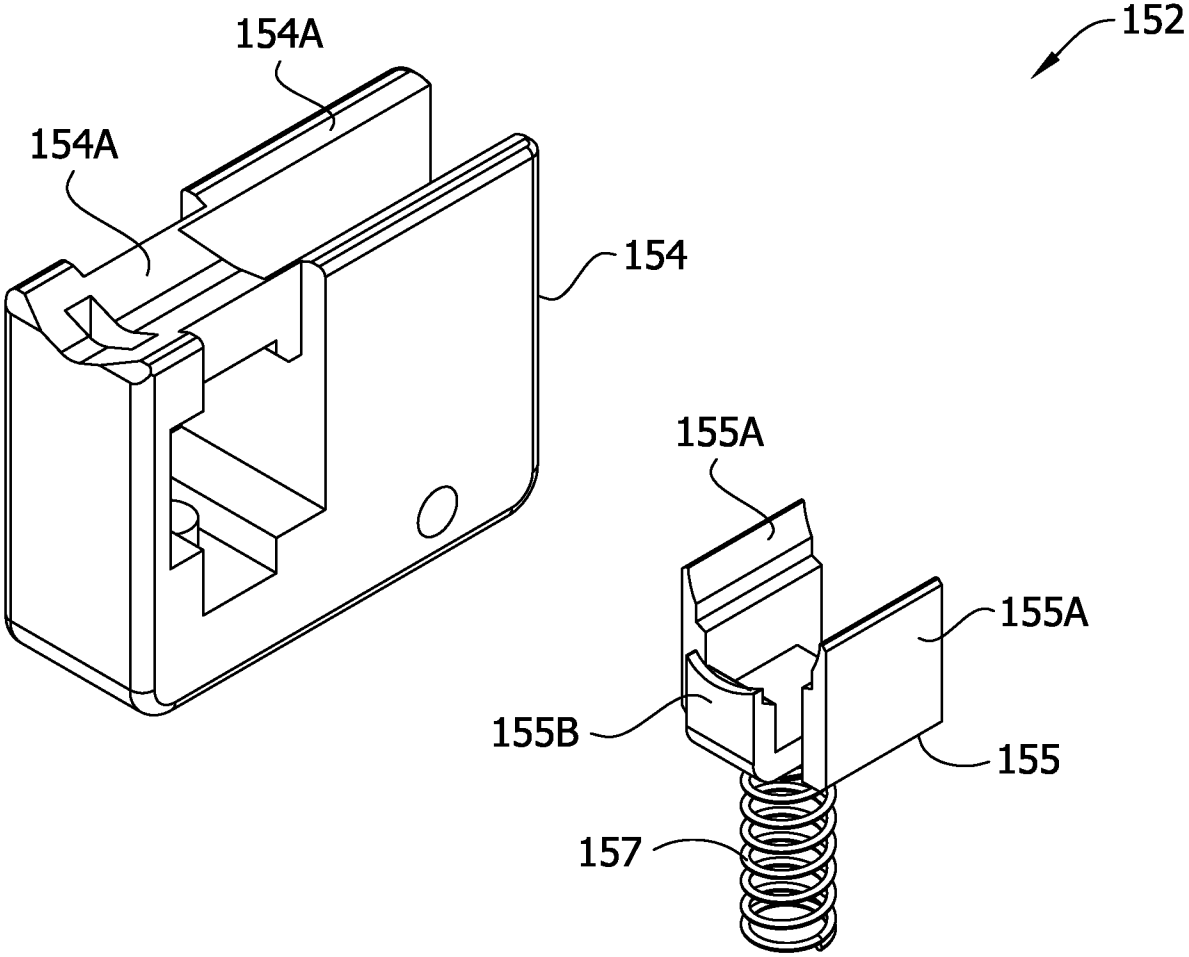
FIG. 43 is an exploded view of the plunger.
Figure 44:
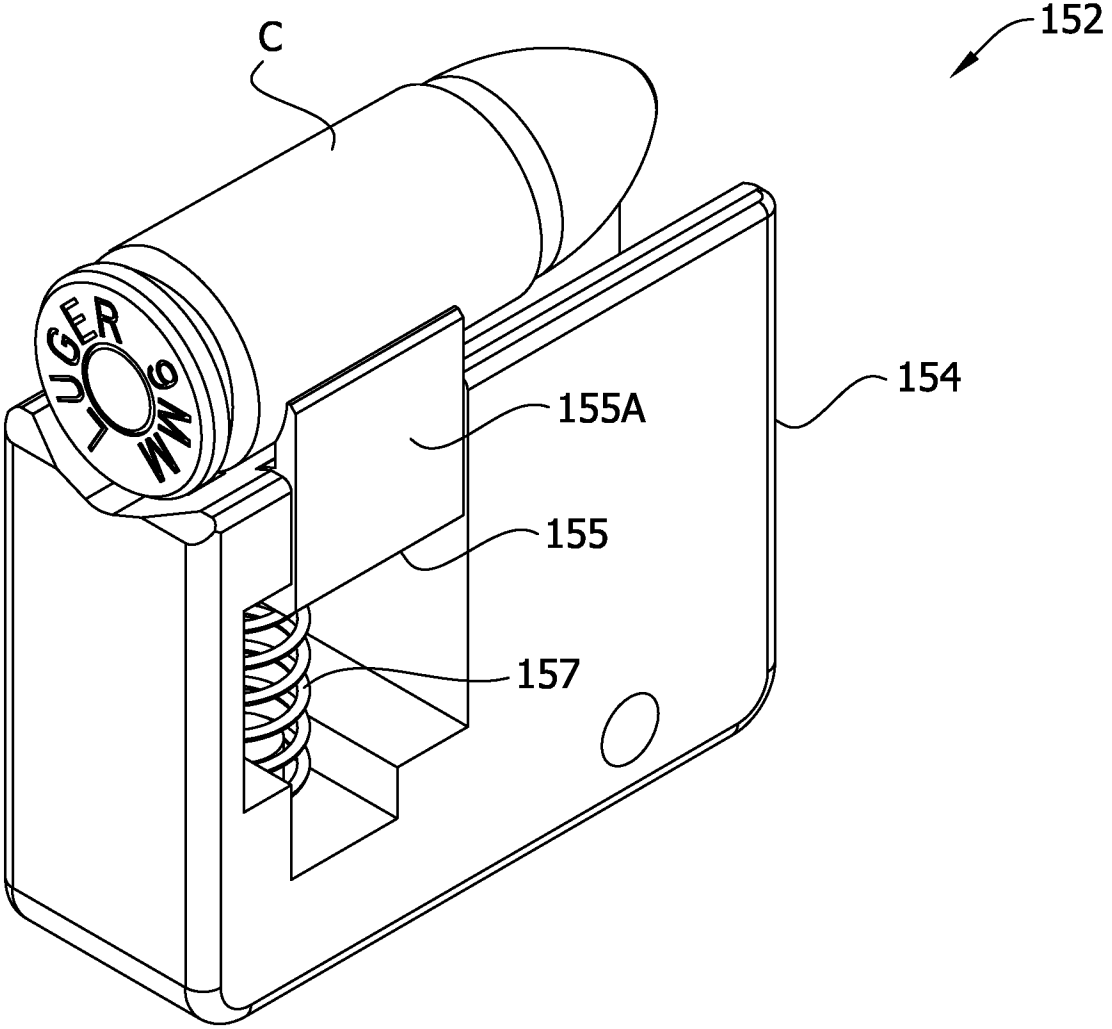
FIG. 44 is a perspective of the plunger having a 9 mm cartridge on the plunger.
Figure 45:
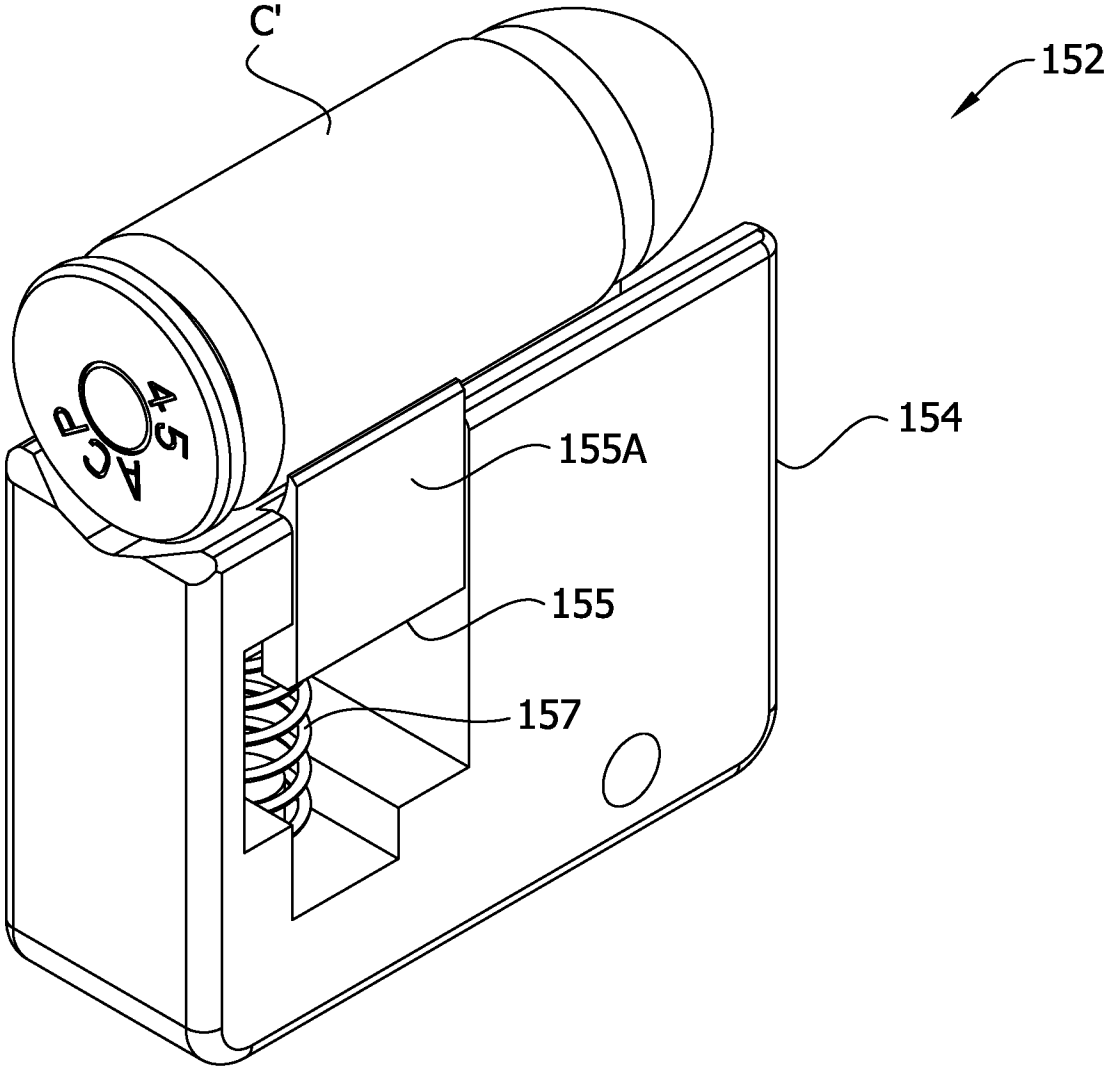
FIG. 45 is a perspective of the plunger having a 45 caliber cartridge on the plunger.

As shown in FIGS. 25 and 42, the main plunger 152 includes a body 154 and an aligner 155. The body 154 includes a cartridge side engagement surface 154A (e.g., cartridge case side engagement surface). The cartridge side engagement surface 154A receives the cartridge C when the cartridge is in the cartridge passage 146. The cartridge side engagement surface 154A is contoured (e.g., defines a valley for receiving a portion of the cartridge) for cradling the cartridge C. The aligner 155 includes two braces or arms 155A that extend upward with respect to the cartridge side engagement surface 154A. In the illustrated embodiment, the aligner 155 also includes a cartridge retainer 155B that extends upward with respect to the cartridge side engagement surface 154A for engaging the circumferential groove of the cartridge case to maintain the cartridge C in position with respect to the mouth end of the magazine M, as explained in further detail below. The aligner 155 is received in an opening in the body 154 and is biased toward an upper end of the opening by a spring 157 in the opening. The braces 155A are spaced from one another sufficiently to receive a relatively small cartridge therebetween. The cartridge retainer 155B is positioned for engaging the circumferential groove of the relatively small cartridge received between the braces 155A. For example, the illustrated 9 mm cartridge fits between the braces 155A, as shown in FIG. 44. The braces 155A and the cartridge side engagement surface 154A can collectively be referred to as a cradle. The cradling of the cartridge C by the cartridge side engagement surface 154A and the braces 155A assists in centering the cartridge C for being driven into the magazine M. When loading cartridges of larger diameter, the braces 155A are pushed (e.g., by the cartridge) from the extended position (e.g., FIGS. 42 and 44) to a retracted position (e.g., FIG. 45). For example, a .45 caliber cartridge C' is shown on the plunger in FIG. 45. The weight of the cartridge C' may cause the aligner 155 to move toward the retracted position against the bias of the spring 157 so the cartridge fully engages the cartridge side engagement surface 154A, and/or the aligner may move toward the retracted position as the main plunger 152 drives the cartridge toward and/or into the magazine M. The cartridge retainer 155B also retracts when cartridges of larger diameter are loaded. Cartridges of larger diameter tend to be relatively long and do not need the cartridge retainer 155B for holding the cartridge in position, for reasons which will become apparent. It will be appreciated that the aligner 155 assists in making the loader 110 universal for loading various types of cartridges into magazines. Other configurations and types of plungers can be used without departing from the scope of the present invention.

Figure 39:
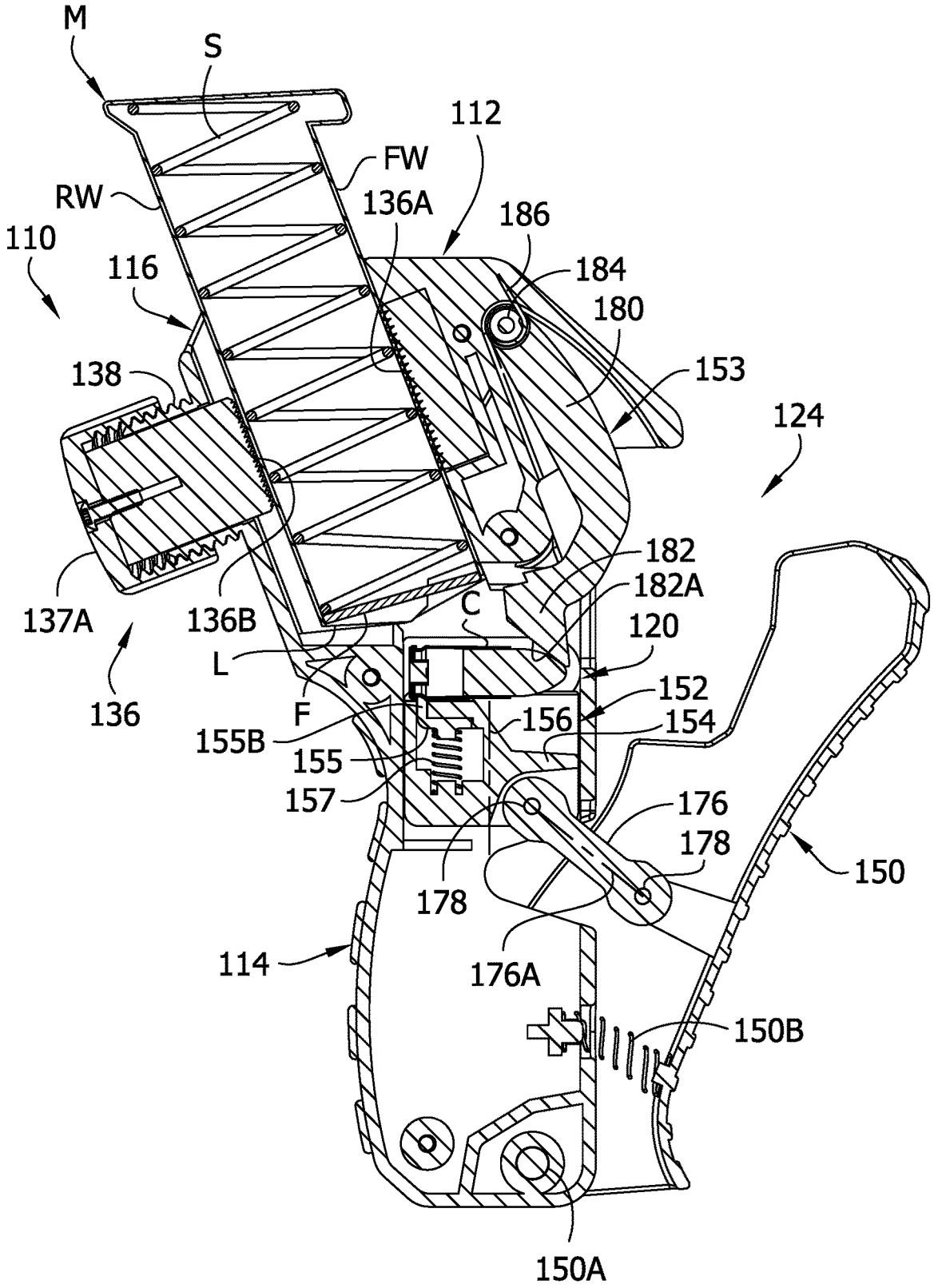
FIG. 39 is a section of the loader similar to FIG. 25 but showing the magazine in the magazine well and a cartridge in the loader ready for being loaded into the magazine.

As shown in FIG. 39, the main plunger 152 is operatively connected to the lever 150 via a linkage 176 and two pivot connections 178 at opposite ends of the linkage. The pivot connections 178 include pins extending through respective openings in the linkage 176, lever 150, and plunger 152. The connection of the plunger 152 to the lever 150 via the linkage 176 and pivot connections 178 permits the plunger to pivot and translate with respect to the lever 150. The linkage 176 has a linkage axis 176A extending through the two pivot connections 178. The arrangement of the lever 150, linkage 176, and main plunger 152 is such that incremental movement of the plunger per unit movement of the lever reduces as the plunger approaches the magazine well 130. More specifically, as the lever 150 is moved in the actuating stroke, the plunger 152 initially moves substantially per unit of pivoting movement of the lever (e.g., over about the first 10 degrees pivoting), but as the plunger approaches the magazine well 130, the plunger moves significantly less per the same unit of pivoting movement of the lever. As shown by comparison of FIGS. 39 and 40, as the linkage axis 176A approaches a parallel relationship with the travel axis 156 of the plunger 152, the incremental movement of the plunger along the travel axis is marginal or very little as the lever 150 continues to move in the actuating stroke to a position in which the linkage axis becomes parallel with the travel axis and slightly passes the parallel relationship with the travel axis. This aspect facilitates coordination of the main and secondary plungers 152, 153 for driving the cartridge C in the magazine, as explained in further detail below.

Referring to FIG. 39, the secondary plunger 153 includes an arm 180 and a head 182. The arm 180 is connected to the main body 112 by a pivot connection 184. The secondary plunger 153 is biased by a torsion spring 186 toward a plunged position (e.g., FIG. 40). The head 182 includes a ramp 182A. As explained in further detail below, the ramp 182A in conjunction with the spring bias assists in guiding the cartridge C toward the mouth end of the magazine M as the main plunger 152 drives the cartridge upward. The secondary plunger 153 moves in a retracting stroke from the plunged position to a retracted position (e.g., FIG. 40) as the cartridge C moves upward and the bullet end rides on the ramp 182A. The secondary plunger 153 is movable in a plunging stroke from the retracted position to a plunged position (e.g., 41). The secondary plunger 153 is operatively connected to the lever 150 via the main body 112, the handle 114, and the respective pivot connections 150A, 184. The secondary plunger 153 is positioned with respect to the lever 150 and movable with respect to the lever for driving the cartridge C in the mouth end of the magazine M to the fully seated position in which the cartridge is between the lips L and spring S and is inboard of the front wall FW of the magazine. As shown by comparison of FIGS. 39-41, the distal end of the lever 150 is configured for engaging an intermediate portion of the arm 180 at a later stage in the actuating stroke of the lever to drive the head 182 toward the mouth end of the magazine M. The lever 150 begins driving the secondary plunger 153, and in turn, the head 182 pushes against the bullet end of the cartridge C for fully seating the cartridge in the magazine M.

Desirably, the main plunger 152 drives the cartridge C sufficiently into the mouth end of the magazine M to compress the spring S such that the cartridge clears the lips L of the magazine before the secondary plunger 153 drives the cartridge farther into the mouth end. The primary plunger 152 holds the primer end of the cartridge C in the mouth end of the magazine M as the secondary plunger 153 drives the cartridge. It will be appreciated that the main plunger 152 drives the cartridge C in a first direction (e.g., along the travel axis 156 of the main plunger) into the mouth end of the magazine M such that the primer end of the cartridge enters the magazine, and the secondary plunger 153 drives the cartridge in a second direction nonparallel to the first direction for fully seating the cartridge in the mouth end of the magazine. For example without limitation, the lever 150 does not cause the secondary plunger 153 to drive the cartridge C into the mouth end until the linkage axis 176A is substantially parallel with the portion of the travel axis 156 that the primary plunger 152 is traveling for reducing the incremental movement of the primary plunger per unit of pivoting movement of the lever 150. The term "substantially parallel" as used herein means the axes are parallel or form an acute angle in the range of 0 to 15 degrees (e.g., before or after the linkage axis 176A reaches the parallel relationship with the travel axis 156). It will be appreciated that other configurations can be used without departing from the scope of the present invention. For example, the travel axis 156 of the main plunger 152 does not need to be a straight line.

As is now apparent, the cartridge driver 124 is configured for, in the actuating stroke of the lever 150, moving the cartridge C (with the main plunger 152) in a first direction for introducing the cartridge into the mouth end of the magazine M and then moving the cartridge in a second direction nonparallel to the first direction (with the secondary plunger 153) for fully seating the cartridge in the mouth end of the magazine. As shown by comparison of FIGS. 39 and 40, as the lever 150 begins the actuating stroke, the main plunger 152 drives the cartridge C upward. The plunger moves along the travel axis 156. The braces 155A align the cartridge C with the mouth end of the magazine M. The bullet end of the cartridge C rides on the ramp 182A of the secondary plunger 153. If the cartridge C is relatively far forward on the main plunger 152, the ramp 182A can guide the cartridge rearward to be better positioned for the primary plunger to drive the primer end of the cartridge into the magazine M. The cartridge C riding on the ramp 182A causes the secondary plunger 153 to move outward to the retracted position shown in FIG. 40, which can vary based on the length of the particular cartridge. The cartridge retainer 155B engages the circumferential groove of the cartridge C for maintaining the primer end in position for entering the mouth end of the magazine M. Eventually the primer end of the cartridge C enters the mouth end of the magazine M, compressing the spring S of the magazine. The reaction force of the magazine spring S against the cartridge C may tend to force the cartridge forward toward the head 182 of the secondary plunger 153, and the cartridge retainer 155B assists in resisting forward movement of the cartridge.

Figure 40:
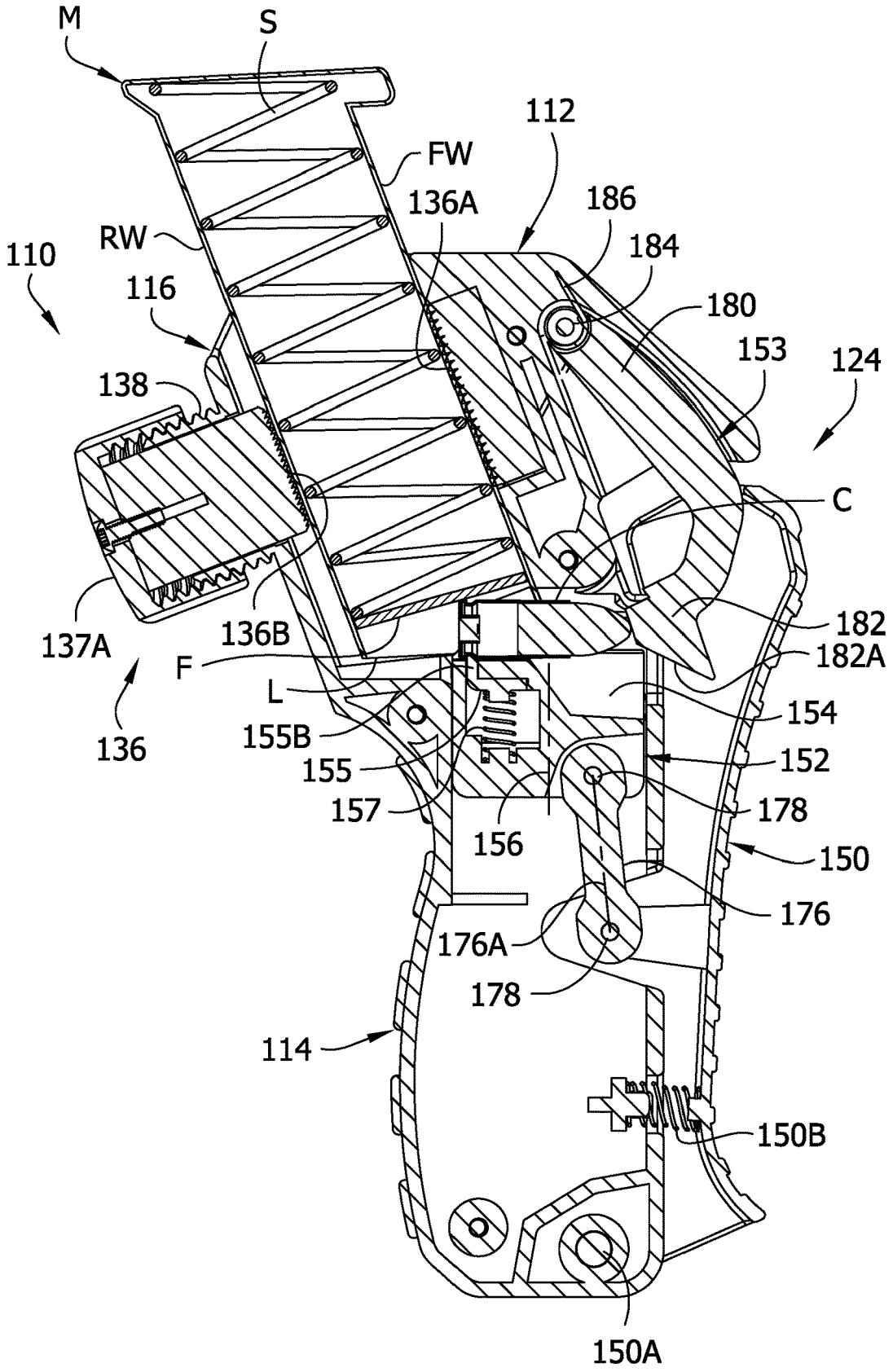
FIG. 40 is a section of the loader similar to FIG. 39 but showing an actuator of the loader in a partially actuated configuration.
Figure 41:
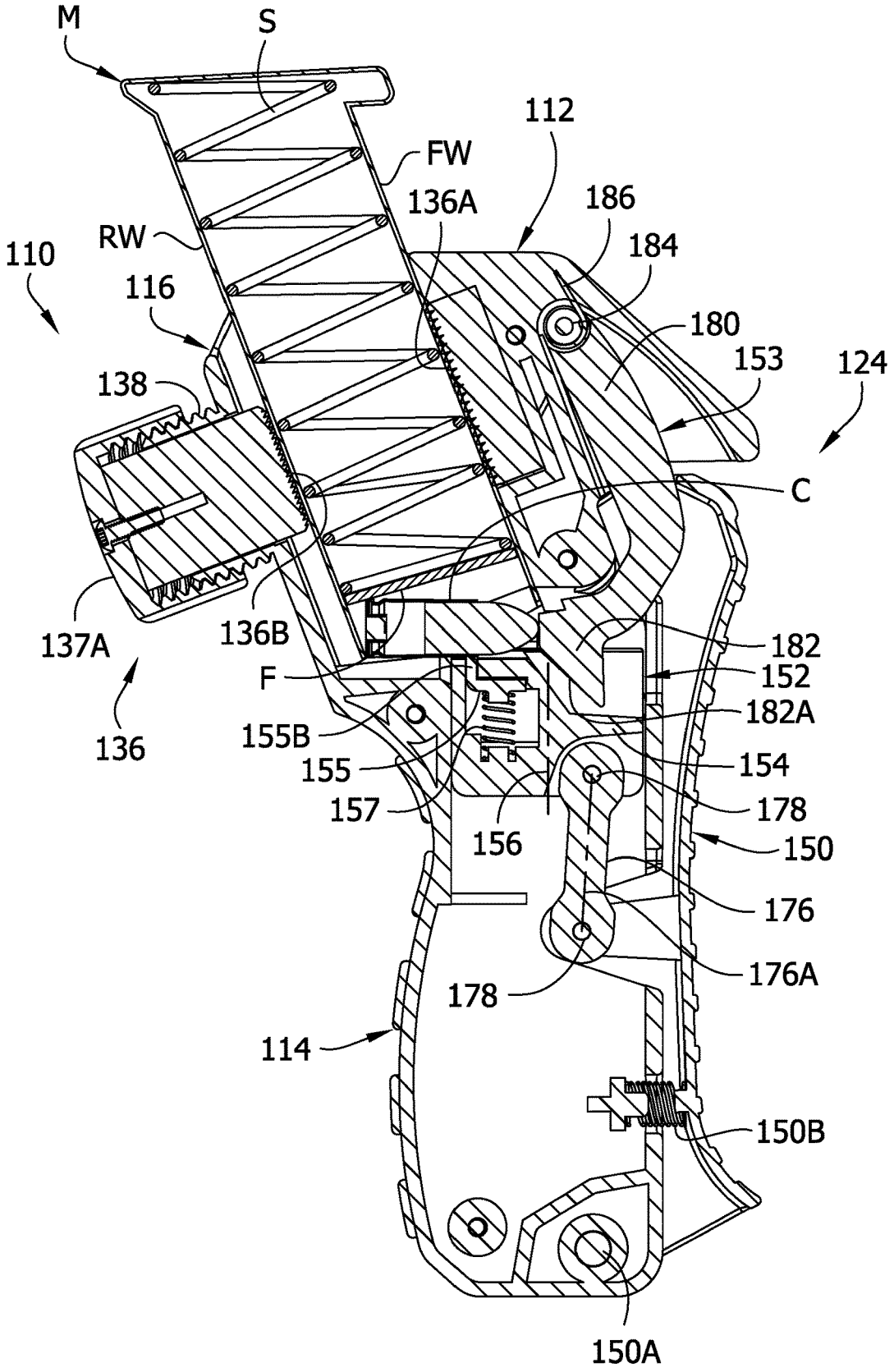
FIG. 41 is a section of the loader similar to FIG. 39 but showing the actuator in a fully actuated position.

As shown by comparison of FIGS. 40 and 41, in a second phase of the actuating stroke, the primary plunger 152 remains relatively stationary to hold the primer end of the cartridge C in the magazine M, and the secondary plunger 153 drives the cartridge (e.g., in the direction of the longitudinal axis of the cartridge) to the fully seated position in the magazine M in which the bullet end is inboard of the front wall FW of the magazine, as shown in FIG. 41. In the fully seated position, the cartridge is held in the magazine M by the lips L. If a larger diameter cartridge were being loaded, the loading steps would be similar, except the cartridge may cause the braces 155A and cartridge retainer 155B to retract, as explained above. When the user releases pressure on the lever 150, the lever moves in the return stroke, the main plunger 152 moves in the retracting stroke, and the cartridge C remains in the fully seated position (e.g., such as shown in FIGS. 3 and 41) in which the cartridge is between the spring S and the lips L, and the bullet end is inboard of the front wall FW of the magazine M. In the fully seated position, the primer end of the cartridge C may or may not be in engagement with the rear wall (stop) RW of the magazine. It will be understood that the fully seated position of the cartridge C in the mouth end of the magazine M permits a subsequent cartridge to be loaded in the mouth end of the magazine, with the seated cartridge having sufficient clearance with respect to the magazine front wall FW to move against the bias of the spring S as the subsequent cartridge is loaded according to the steps described above. Other types or configurations of cartridge drivers can be used without departing from the scope of the present invention. For example, there can be fewer or more plungers and/or the plungers can be integrally formed with the actuator (e.g., not be operatively connected via a pivot connection).

Figure 46:
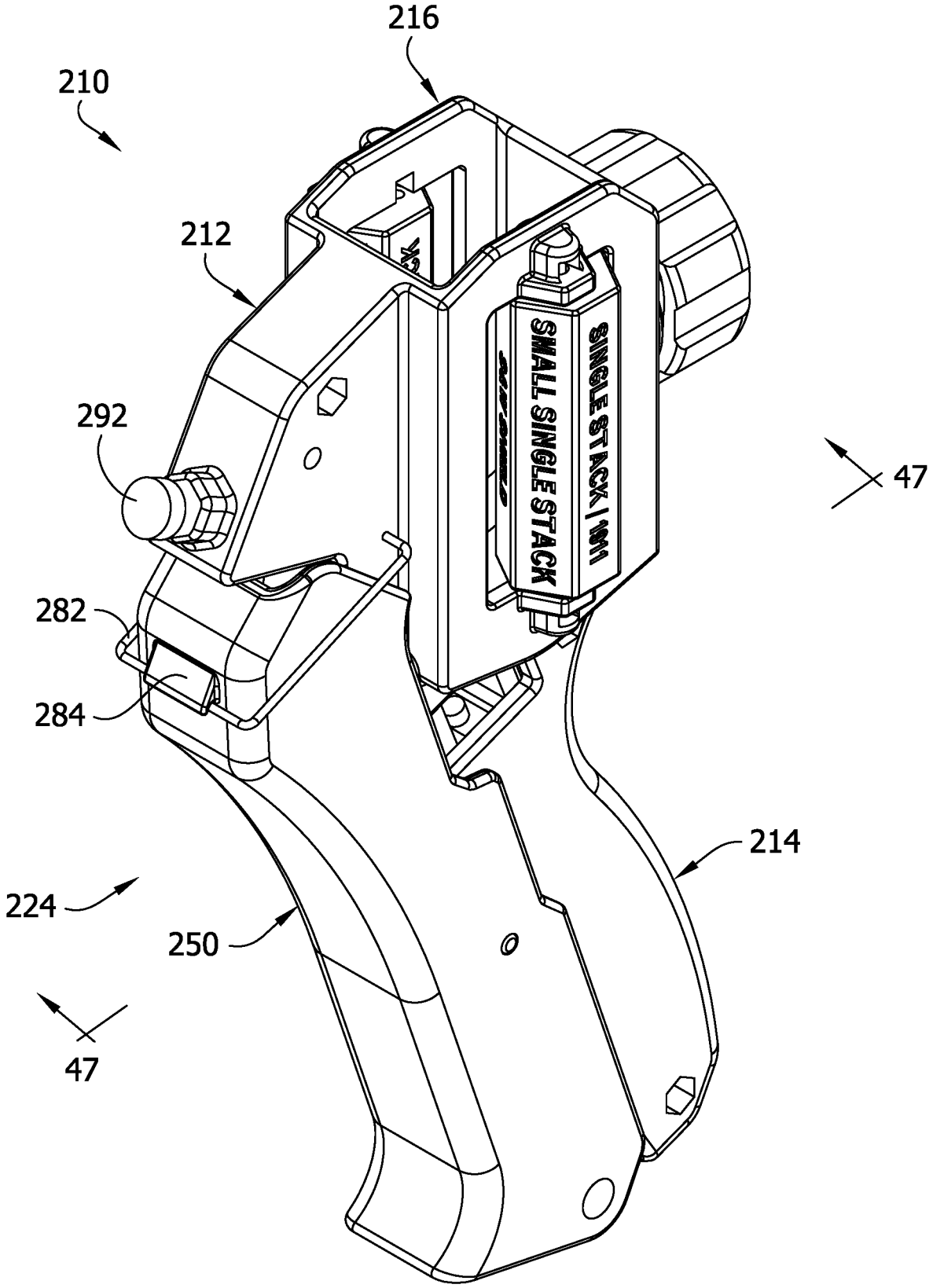
FIG. 46 is front perspective of a third embodiment of a magazine loader embodying aspects of the present invention, an actuator of the loader being shown in a stowed position.
Figure 47:
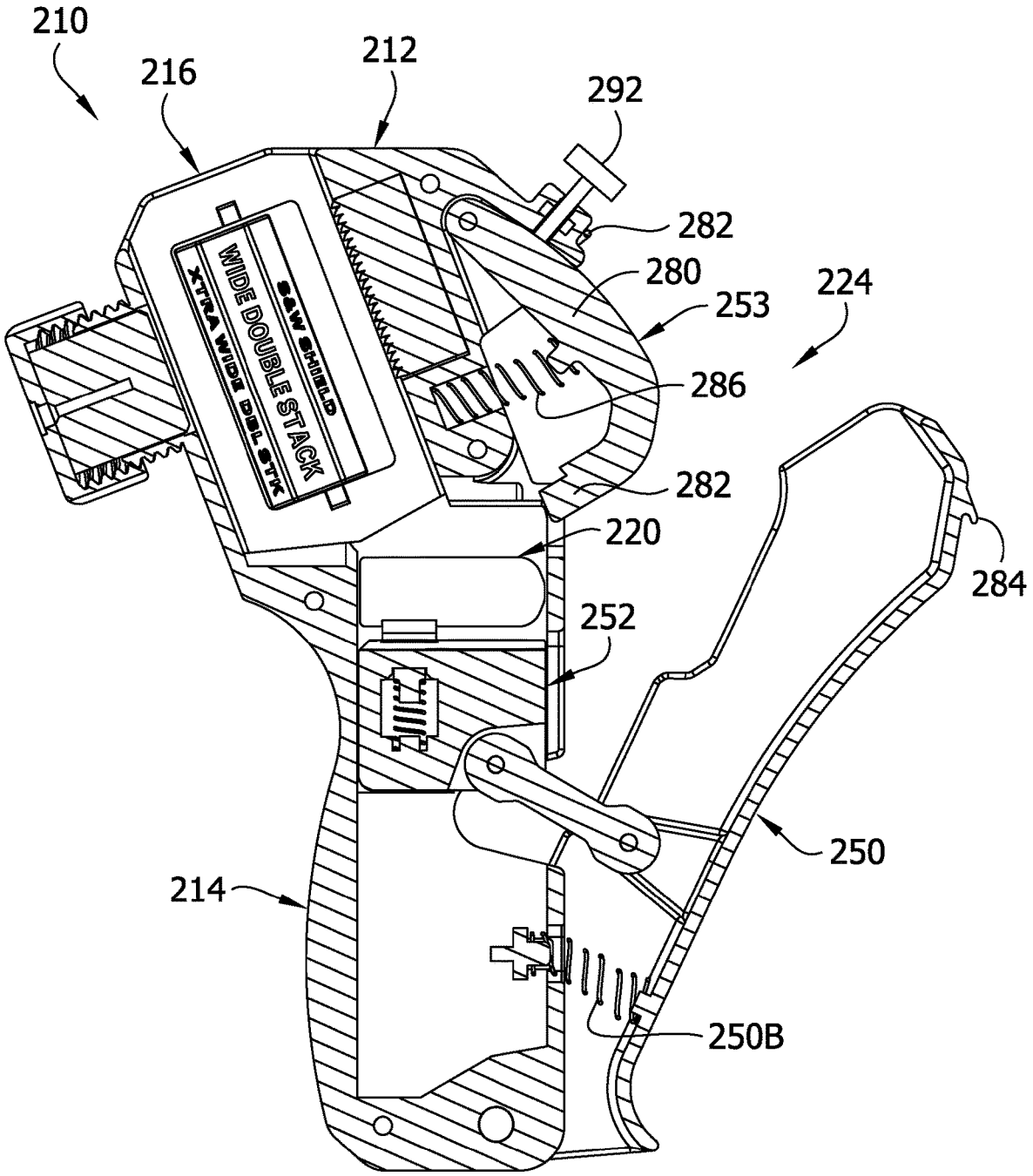
FIG. 47 is a section of the magazine loader of FIG. 46 taken in the plane including line 47-47 shown in FIG. 46, the actuator of the loader being shown in a non-stowed position.

Referring to FIGS. 46 and 47, a third embodiment of a handgun magazine loader embodying aspects of the present invention is designated generally by the reference number 210. The loader is similar to the loader 110, and like parts are indicated by like reference numbers, plus 100. For example, the loader 210 further includes a main body 212 and a handle 214. The loader 210 includes a magazine receiver 216, a cartridge receiver 220, and a cartridge driver 224. The loader 210 is used in a similar fashion as the loader 110 for loading cartridges into a magazine M.

In this embodiment, as shown in FIG. 46, the lever 250 can be held in a stowed position for making the loader 210 relatively compact for storage. In the illustrated embodiment, a wire clip 282 is pivotally mounted to the main body 212 and is sized to be pivoted over the distal end of the lever 250 in its actuated position. A catch 284 on the outer surface of the lever 250 is configured to retain the clip 282 on the distal end of the lever 250. The catch 284 is formed as a hook that catches the clip 282 after the clip is pivoted sufficiently to pass over the hook. The spring 250B biasing the lever 250 outward forces the hook 284 outward to catch the clip 282 when the clip passes the hook. To return the lever 250 to its home or retracted position for further use of the loader 210, the lever can be pressed against the bias of the spring 250B to provide clearance between the hook 284 and clip 282 and permit the clip to be pivoted off the distal end of the lever.

In another aspect of the loader 210, the secondary plunger 253 is biased by a spring 286 toward the retracted position instead of toward the plunged position. The retracted position of the secondary plunger is adjustable. For example, in the illustrated embodiment, an adjuster 292 in the form of a bolt is received in a threaded opening in the main body 212. The bolt 292 has a distal end positioned for engaging the arm 280 of the secondary plunger 253 for limiting movement of the plunger in the retracting stroke to define the retracted position of the plunger. This feature can be useful in positioning the head 282 of the plunger 253 to assist the main plunger 252 in introducing the cartridge C into the mouth end of the magazine M. For example, if the cartridge C happens to come to rest relatively far forward on the primary plunger 252, engagement of the bullet with the head 282 of the secondary plunger 253 as the primary plunger drives the cartridge upward can deflect the cartridge rearward. Moreover, as the primer end of the cartridge C is driven into the mouth end of the magazine M by the primary plunger 252, the force of the spring S against the primer end can cause the cartridge C to slide forward toward the head 282 of the secondary plunger 283. If the retracted position of the secondary plunger 253 is properly adjusted, the head 282 of the secondary plunger is positioned to limit forward travel of the cartridge because the bullet end of the cartridge engages the head of the secondary plunger. Limiting forward travel of the cartridge C facilitates smooth loading of the cartridge into the magazine M by the cartridge driver 224. It will be appreciated that the optimal retracted position of the secondary plunger 253 will be based on the length of the particular cartridge being loaded. The retracted position can be adjusted by threading the bolt 292 into or out of the threaded opening to move the head 282 of the secondary plunger 253 closer to or farther away from the magazine M in the retracted position.

As is now apparent, the loader can be used to load a plurality of cartridges in a handgun magazine. Various features described above make the loader universal for loading cartridges of various sizes into magazines of various types. After a magazine is positioned in the magazine receiver, the user can repeatedly load cartridges from the cartridge receiver into the handgun magazine by actuating the cartridge driver. The magazine loaded with cartridges can be removed from the loader for shooting the cartridges, and the loading process can be repeated when desired. The loader provides a convenient method for loading cartridges into handgun magazines, requiring less time and producing less hand fatigue.

Having described the invention in detail, it will be apparent that modifications and variations are possible without departing from the scope of the invention defined in the appended claims.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A method of loading a cartridge into a handgun magazine using a handgun magazine loader, the cartridges each including a case and a bullet seated in the case, the handgun magazine including a housing having a distal end, a mouth end opposite the distal end, a pair of lips at least partially closing the mouth end, and a spring, the method comprising:

inserting the handgun magazine at least partially into a magazine well of the handgun magazine loader, operating the handgun magazine loader to load a first cartridge in the magazine in a top cartridge location in which the first cartridge is in engagement with the lips and the spring urges the first cartridge toward the lips, positioning a second cartridge with respect to a cartridge driver of the handgun magazine loader for being driven into the magazine by the cartridge driver, actuating an actuator of the cartridge driver to move the actuator with respect to the magazine well to move a plunger of the cartridge driver with respect to the actuator to reciprocate the plunger by moving the plunger along a reciprocating path in a plunging stroke and back along the reciprocating path in a return stroke opposite the plunging stroke, wherein moving the plunger along the reciprocating path in the plunging stroke causes the plunger to push against the case of the second cartridge to drive the second cartridge against the first cartridge to move the first cartridge out of engagement with the lips from the top cartridge location and away from the lips further into the magazine while the plunger in the plunging stroke pushes the second cartridge partially into the mouth end of the magazine in a first direction with respect to the magazine well to introduce the second cartridge into the mouth end of the magazine, and after pressing the second cartridge against the first cartridge to move the first cartridge out of engagement with the lips from the top cartridge location, operating the cartridge driver to push the second cartridge in a second direction with respect to the magazine well nonparallel to the first direction to fully seat the second cartridge in the mouth end of the magazine between the spring and the lips of the magazine to take the top cartridge location.

2. A method as set forth in claim 1 wherein moving the plunger along the reciprocating path in the plunging stroke comprises moving the actuator along an actuator travel path with respect to the magazine well in an actuating stroke from a home position to an actuated position, and wherein moving the plunger along the reciprocating path in the return stroke comprises moving the actuator back along the actuator travel path in a return stroke from the actuated position back to the home position.

3. A handgun magazine loader as set forth in claim 1 wherein operating the cartridge driver to push the second cartridge in the second direction comprises pushing the second cartridge in the second direction with the plunger to fully seat the second cartridge in the mouth end of the magazine between the spring and the lips of the magazine.

4. A handgun magazine loader as set forth in claim 1 wherein the plunger is a first plunger and the cartridge driver further comprises a second plunger, and wherein operating the cartridge driver to push the second cartridge in the second direction comprises pushing the second cartridge in the second direction with the second plunger to fully seat the second cartridge in the mouth end of the magazine between the spring and lips of the magazine.

5. A method as set forth in claim 4 further comprising holding the second cartridge in the mouth end of the magazine with the first plunger as the second plunger pushes the second cartridge in said second direction.

6. A method as set forth in claim 4 further comprising reducing incremental movement of the first plunger per unit movement of the actuator before pushing the second cartridge in said second direction with the second plunger.

7. A method as set forth in claim 4 wherein the second plunger is movable in a plunging stroke from a retracted position to a plunged position to push the second cartridge in said second direction further comprising and the method further comprises adjusting an adjuster to change a retracted position of the second plunger with respect to the magazine well.

8. A method as set forth in claim 4 wherein pushing the second cartridge in the second direction with the second plunger comprises pushing against the bullet of the second cartridge with the second plunger to drive the second cartridge in the second direction to fully seat the second cartridge in the mouth end of the magazine.

9. A method as set forth in claim 1 wherein moving the plunger of the cartridge driver with respect to the actuator comprises pivoting the plunger with respect to the actuator.

10. A method as set forth in claim 9 wherein moving the plunger of the cartridge driver with respect to the actuator comprises pivoting a linkage having a first portion pivotally connected to the actuator and a second portion pivotally connected to the plunger.

11. A method as set forth in claim 10 wherein the plunger is a first plunger and the cartridge driver further comprises a second plunger that pushes the cartridge in the second direction, wherein moving the first plunger along the reciprocating path in the plunging stroke causes the first plunger to move along a travel axis to compress the spring with the second cartridge to introduce the second cartridge into the magazine well, and wherein an axis of the linkage extending between pivot connections where the linkage is pivotally connected to the actuator and to the plunger is parallel or substantially parallel with the travel axis when the second plunger begins pushing the second cartridge in the second direction.

12. A method as set forth in claim 1 wherein the cartridge driver reduces incremental travel of the plunger per unit movement of the actuator as the plunger approaches the magazine well.

13. A method as set forth in claim 1 wherein the plunger cradles the second cartridge for centering the second cartridge for introduction to the mouth end of the magazine.

14. A method as set forth in claim 13 wherein the plunger cradles the second cartridge by receiving the second cartridge in a valley in the plunger sized for at least partially receiving the second cartridge therein.

15. A method as set forth in claim 13 wherein the plunger cradles the second cartridge by receiving at least a portion of the second cartridge between first and second braces of the plunger.

16. A method as set forth in claim 15 wherein the braces move against a spring bias to a retracted position to cradle the second cartridge.

17. A method as set forth in claim 1 further comprising engaging a circumferential groove of the second cartridge with a cartridge retainer to limit movement of the second cartridge on the plunger.

18. A method as set forth in claim 17 wherein engaging the circumferential groove of the second cartridge with the cartridge retainer comprises moving the cartridge retainer to a retracted position against a spring bias.

19. A method as set forth in claim 1 wherein the handgun magazine includes a front wall, and wherein moving the plunger along the reciprocating path in the plunging stroke comprises pushing the second cartridge with the plunger in the first direction partially into the mouth end such that the second cartridge extends inboard of the front wall but not fully inboard of the front wall, and wherein operating the cartridge driver to push the second cartridge in the second direction comprises pushing the second cartridge in the second direction fully inboard of the front wall.

20. A method as set forth in claim 1 wherein the reciprocating path is a straight line reciprocating path.

21. A method of loading a cartridge into a handgun magazine using a handgun magazine loader, the handgun magazine including a housing having a distal end, a mouth end opposite the distal end, a pair of lips at least partially closing the mouth end, and a spring, the method comprising:

inserting the handgun magazine at least partially into a magazine well of the loader, operating the handgun magazine loader to load a first cartridge in the magazine in a top cartridge location in which the first cartridge is in engagement with the lips and urged toward the lips by the spring, positioning a second cartridge with respect to a cartridge driver of the handgun magazine loader for being driven into the magazine by the cartridge driver, actuating an actuator of the cartridge driver to move a plunger of the cartridge driver with respect to the actuator and to move the actuator with respect to the magazine well in a reciprocating travel path in an actuating stroke in an actuating stroke from a home position to an actuated position and back along the reciprocating travel path in a return stroke back along the reciprocating travel path from the actuated position back to the home position, wherein, in the actuating stroke, the cartridge driver pushes the second cartridge to press the second cartridge against the first cartridge to move the first cartridge out of engagement with the lips from the top cartridge location and away from the lips farther into the magazine while the cartridge driver pushes the second cartridge partially into the mouth end of the magazine in a first direction with respect to the magazine well to introduce the second cartridge into the mouth end of the magazine, and wherein, in the actuating stroke after pressing the second cartridge against the first cartridge to move the first cartridge out of engagement with the lips from the top cartridge location, the cartridge driver pushes the second cartridge in a second direction with respect to the magazine well nonparallel to the first direction to fully seat the second cartridge in the mouth end of the magazine between the spring and lips of the magazine to take the top cartridge location.

22. A method as set forth in claim 21 wherein the plunger is a first plunger, and the cartridge driver comprises a second plunger for pushing the second cartridge in said second direction, and wherein the method further comprises holding the second cartridge in the mouth end of the magazine with the first plunger as the second plunger pushes the second cartridge in said second direction.

23. A method of loading a cartridge into a handgun magazine using a handgun magazine loader, the cartridges each including a case and a bullet seated in the case, the handgun magazine including a housing having a distal end, a mouth end opposite the distal end, a pair of lips at least partially closing the mouth end, and a spring, the method comprising:

inserting the handgun magazine at least partially into a magazine well of the loader, operating the handgun magazine loader to load a first cartridge in the magazine in a top cartridge location in which the first cartridge is in engagement with the lips and urged toward the lips by the spring, positioning a second cartridge with respect to a cartridge driver of the loader for being driven into the magazine by the cartridge driver, actuating the cartridge driver to move the cartridge driver with respect to the magazine well and to push against a side of the case of the second cartridge to push the second cartridge linearly to press the second cartridge against the first cartridge to move the first cartridge out of engagement with the lips from the top cartridge location and away from the lips farther into the magazine while the cartridge driver pushes the second cartridge partially into the mouth end of the magazine to introduce the second cartridge into the mouth end of the magazine, and actuating the cartridge driver to, after pressing the second cartridge against the first cartridge to move the first cartridge out of engagement with the lips from the top cartridge location, push the cartridge driver against the bullet of the second cartridge to fully seat the second cartridge in the mouth end of the magazine between the spring and the lips of the magazine to take the top cartridge location.

24. A method as set forth in claim 23 wherein actuating the cartridge driver causes a plunger of the cartridge driver to move along a reciprocating travel path in a plunging stroke and back along the reciprocating travel path in a retracting stroke, and wherein actuating the cartridge driver to push against a side of the second cartridge comprises moving the plunger in the plunging stroke to push the plunger against the side of the case of the second cartridge.

25. A method as set forth in claim 24 wherein the plunger is a first plunger and the cartridge driver includes a second plunger, and wherein actuating the cartridge driver comprises pushing the second plunger against the bullet of the second cartridge to fully seat the second cartridge in the mouth end of the magazine between the spring and the lips of the magazine to take the top cartridge location.

* * * * *